US012779298B2

(12) United States Patent
Anderson et al.

(10) Patent No.: US 12,779,298 B2
(45) Date of Patent: Nov. 3, 2026

(54) CARRIER ASSEMBLY FOR ELONGATE ITEMS

(71) Applicant: Heather Margaret Anderson, Auckland (NZ)

(72) Inventors: Heather Margaret Anderson, Auckland (NZ); Gwyn Walter David Jones, Dunedin (NZ); Tomas Antonio Dos Santos Mendes, Auckland (NZ)

(73) Assignee: Heather Margaret Anderson, Auckland (NZ)

( * ) Notice: Subject to any disclaimer, the term of this patent is extended or adjusted under 35 U.S.C. 154(b) by 50 days.

(21) Appl. No.: 18/839,685

(22) PCT Filed: Feb. 22, 2023

(86) PCT No.: PCT/NZ2023/050020
§ 371 (c)(1),
(2) Date: Aug. 19, 2024

(87) PCT Pub. No.: WO2023/163601
PCT Pub. Date: Aug. 31, 2023

(65) Prior Publication Data

US 2025/0153013 A1 May 15, 2025

(30) Foreign Application Priority Data

Feb. 23, 2022 (NZ) ..... 785426

(51) Int. Cl.
*A63B 55/40* (2015.01)
*A63B 55/00* (2015.01)
(Continued)

(52) U.S. Cl.
CPC ..... *A63B 55/40* (2015.10); *A63B 55/404* (2015.10); *A63B 55/60* (2015.10); *A63B 60/58* (2015.10);
(Continued)

(58) Field of Classification Search
CPC ..... A63B 55/00; A63B 55/10; A63B 55/30; A63B 55/40; A63B 2055/402;
(Continued)

(56) References Cited

U.S. PATENT DOCUMENTS 1,570,500 A * 1/1926 Kennedy ..... A45F 5/1566 206/315.6
1,575,023 A * 3/1926 Walton ..... A63B 55/10 473/282
(Continued)

FOREIGN PATENT DOCUMENTS

DE 102021118467 A1 1/2023
GB 2269786 A 2/1994
(Continued)

OTHER PUBLICATIONS

International Search Report for PCT/NZ2023/050020, mailed May 19, 2023, 4 pages.
(Continued)

*Primary Examiner* — Prince Pal
(74) *Attorney, Agent, or Firm* — NIXON & VANDERHYE

(57) ABSTRACT

A carrier assembly (1) for holding golf clubs (2), has a central substantially trapezoidal elongate housing having one or more doors for storage of accessories and having external club storage housings (54) on the outside of the bag. Each of the external club storage housings has an outwardly facing slit between a pair of resilient members to allow easy insertion or removal of a golf club, and at least one anti-rotation member (96) for holding a golf club.

13 Claims, 53 Drawing Sheets

(51) Int. Cl.

| | |
|---|---|
| ***A63B 55/53*** | (2015.01) |
| ***A63B 55/57*** | (2015.01) |
| ***A63B 55/60*** | (2015.01) |
| ***A63B 60/58*** | (2015.01) |
| ***A63B 102/02*** | (2015.01) |
| ***A63B 102/14*** | (2015.01) |

(52) U.S. Cl.
CPC ..... *A63B 2055/403* (2015.10); *A63B 55/53* (2015.10); *A63B 55/57* (2015.10); *A63B 2102/02* (2015.10); *A63B 2102/14* (2015.10); *A63B 2225/682* (2013.01)

(58) Field of Classification Search
CPC ..... A63B 55/404; A63B 55/60; A63B 55/50; A63B 55/408; A63B 55/20; A63B 2055/403
USPC ..... 206/315.6, 315.3, 315.5, 315.7, 315.8, 206/315.2, 215.4; 211/70.2; 248/96
See application file for complete search history.

(56) References Cited

U.S. PATENT DOCUMENTS 1,678,353 A * 7/1928 Reach ..... A47F 7/0028 473/282
1,737,967 A * 12/1929 Hall ..... A63B 55/00 206/315.5
2,307,350 A * 1/1943 Anderson, Jr. ..... B65D 5/504 211/183
2,520,226 A * 8/1950 Smith ..... B62B 1/04 280/DIG. 6
2,590,154 A * 3/1952 Burns ..... B62B 1/262 280/DIG. 6
3,014,732 A * 12/1961 Schemenauer ..... B62B 5/085 280/DIG. 6
3,154,314 A 10/1964 Mccune, Jr.
3,503,518 A * 3/1970 Black ..... A63B 55/40 206/315.6
4,319,616 A * 3/1982 Light ..... A63B 55/40 206/315.6
4,673,082 A * 6/1987 Hemme ..... A63B 55/40 280/DIG. 6
4,852,896 A * 8/1989 Mills ..... A63B 55/60 280/DIG. 6
4,915,221 A * 4/1990 Spangler ..... A63B 55/40 206/315.6
4,968,048 A * 11/1990 Lortie ..... A63B 55/60 150/159
5,152,483 A 10/1992 Maeng
5,168,992 A * 12/1992 Bowdy ..... A63B 55/40 280/DIG. 6
5,333,731 A * 8/1994 McCuaig ..... A63B 55/40 206/315.6
5,358,109 A * 10/1994 Nichols ..... A63B 55/408 206/315.6
5,366,075 A * 11/1994 Mills ..... A63B 55/40 280/DIG. 6
5,383,555 A 1/1995 Weinmeier
5,415,284 A * 5/1995 King ..... A63B 55/60 280/DIG. 6
5,469,960 A * 11/1995 Yuill ..... A63B 55/40 206/315.6
5,505,300 A * 4/1996 Joh ..... A63B 55/40 206/315.6
5,573,122 A * 11/1996 Williams ..... A63B 55/40 206/315.6
5,613,604 A * 3/1997 Maeng ..... A63B 55/57 206/315.6
5,645,166 A * 7/1997 Su ..... A63B 55/40 206/315.6
5,647,568 A * 7/1997 Nettles ..... A63B 55/408 211/16
5,681,016 A * 10/1997 Wang ..... A63B 55/53 248/96
5,699,906 A * 12/1997 Lombardo ..... A63B 55/40 206/315.3
5,722,253 A * 3/1998 Todd ..... F25D 3/08 62/331
5,730,285 A * 3/1998 Sheehan ..... A63B 55/40 206/315.6
5,816,398 A * 10/1998 Wang ..... A63B 55/40 206/315.6
5,819,829 A * 10/1998 Matthews ..... A63B 55/406 150/159
5,842,564 A * 12/1998 Clement ..... A63B 55/40 206/315.6
5,842,565 A * 12/1998 Hagaman ..... A63B 55/40 206/315.6
5,860,520 A * 1/1999 Tang ..... A63B 55/40 206/315.6
5,921,387 A * 7/1999 Arzoomanian ..... A63B 55/00 150/159
5,947,282 A * 9/1999 Merrill ..... A63B 55/40 206/315.6
6,145,660 A * 11/2000 Chou ..... A63B 55/40 206/315.6
6,202,840 B1 * 3/2001 Chang ..... A63B 55/00 150/159
6,244,438 B1 * 6/2001 Weinmeier ..... A63B 57/00 206/315.6
6,299,000 B1 * 10/2001 Cabrera ..... A63B 57/60 211/89.01
6,315,115 B1 * 11/2001 Bradshaw ..... A63B 60/62 150/159
6,330,944 B1 * 12/2001 DeMichele ..... A63B 55/408 206/315.6
6,352,154 B1 * 3/2002 Miura ..... A63B 55/40 206/315.6
6,434,800 B1 * 8/2002 James ..... A63B 60/62 24/298
6,464,076 B2 * 10/2002 Tan ..... A63B 55/00 206/315.6
6,659,477 B2 * 12/2003 Jung ..... A63B 55/60 206/315.3
6,742,789 B1 * 6/2004 Nowak ..... B25H 3/00 280/652
6,966,439 B2 * 11/2005 Weleczki ..... A45C 7/0077 206/315.6
7,281,398 B1 * 10/2007 Sims ..... A63B 55/40 70/64
7,337,898 B2 * 3/2008 Lewter ..... A63B 55/60 206/315.6
7,481,311 B1 * 1/2009 Old ..... A63B 55/408 206/315.6
7,559,423 B2 * 7/2009 Vosloo ..... A45C 11/00 206/315.1
7,712,752 B2 * 5/2010 Horning ..... A47B 81/00 280/652
7,832,557 B2 * 11/2010 Amin ..... B62B 5/0083 280/DIG. 6
8,371,050 B2 * 2/2013 Kirkpatrick ..... G09F 9/35 40/606.03
8,640,866 B1 * 2/2014 Dow ..... A63B 55/408 206/315.9
8,757,373 B2 * 6/2014 Aubery ..... A63B 55/00 206/315.7
8,991,598 B2 * 3/2015 Whitworth ..... A63B 55/40 D3/261
10,099,098 B2 10/2018 Snyder
10,159,877 B2 12/2018 Weinmeier
10,722,769 B1 * 7/2020 Kim ..... A63B 55/50
D924,562 S * 7/2021 Miller ..... D3/904
11,167,188 B1 * 11/2021 Mais ..... B60R 9/06
11,673,031 B2 * 6/2023 Burgess ..... A63B 55/40 206/315.6
11,752,408 B2 * 9/2023 Zhang ..... A63B 55/30 248/96

(56) References Cited

U.S. PATENT DOCUMENTS 11,786,790 B2 * 10/2023 Martell ..... A63B 55/40 53/411
D1,075,306 S * 5/2025 Anderson ..... D3/315
12,337,219 B2 * 6/2025 Hutchins ..... A63B 55/40
2002/0134894 A1 * 9/2002 Wang ..... A63B 55/57 248/560
2003/0029750 A1 * 2/2003 Boardman ..... A63B 55/60 150/159
2003/0094390 A1 * 5/2003 Thompson ..... A63B 55/408 190/110
2004/0074791 A1 4/2004 Lewter
2005/0072695 A1 * 4/2005 Shaanan ..... A63B 55/10 206/315.3
2005/0082184 A1 * 4/2005 Lewter ..... A63B 55/00 206/315.6
2006/0163893 A1 * 7/2006 Gascoigne ..... A63B 55/10 294/143
2006/0207899 A1 * 9/2006 Handa ..... A63B 55/10 206/315.6
2007/0074982 A1 4/2007 Wu
2007/0215500 A1 * 9/2007 Jung ..... A63B 55/408 206/315.6
2008/0116092 A1 * 5/2008 Tan ..... A63B 55/40 206/315.6
2008/0135431 A1 * 6/2008 Tan ..... A63B 55/40 206/315.3
2008/0217193 A1 * 9/2008 Amin ..... B62B 3/12 220/756
2008/0245689 A1 * 10/2008 He ..... A63B 55/40 206/315.6
2008/0308436 A1 * 12/2008 Chun ..... A63B 55/40 206/315.6
2009/0178950 A1 * 7/2009 Quartarone ..... A63B 60/42 206/579
2010/0320105 A1 * 12/2010 Aubery ..... A63B 55/57 206/315.7
2011/0215013 A1 * 9/2011 Young ..... A63B 57/207 473/282
2011/0269564 A1 * 11/2011 Mitchell ..... A63B 47/02 473/282
2013/0105341 A1 * 5/2013 Whitworth ..... A63B 55/408 206/315.6
2013/0306505 A1 * 11/2013 Walsh ..... A63B 55/00 206/315.7
2014/0008254 A1 * 1/2014 Weinmeier ..... A63B 55/406 206/315.6
2014/0061075 A1 * 3/2014 Leposky ..... A63B 55/00 206/315.3
2014/0332421 A1 * 11/2014 Jones ..... A63B 55/40 206/315.6
2015/0174462 A1 * 6/2015 Loudenslager ..... A63B 55/60 206/315.3
2015/0367208 A1 * 12/2015 Mittiga ..... A63B 55/40 206/315.6
2016/0059096 A1 * 3/2016 Meyer ..... A63B 55/408 206/315.3
2016/0175670 A1 * 6/2016 Bom ..... A63B 55/57 206/315.3
2018/0361212 A1 * 12/2018 Morton ..... A63B 55/40
2019/0344137 A1 11/2019 Eze
2020/0215400 A1 * 7/2020 Martell ..... A63B 55/53
2021/0060394 A1 * 3/2021 Arsovic ..... A63B 55/40
2021/0299528 A1 * 9/2021 Logan ..... A63B 55/30
2023/0001276 A1 1/2023 Browning
2023/0173353 A1 * 6/2023 Poirier ..... A63B 55/404 206/315.3
2023/0218959 A1 * 7/2023 Isgar ..... A63B 71/0622 206/315.3
2024/0009528 A1 * 1/2024 Hutchins ..... A63B 55/40
2025/0153015 A1 * 5/2025 Anderson ..... A63B 55/00
2025/0256164 A1 * 8/2025 Eshleman ..... A63B 47/005

FOREIGN PATENT DOCUMENTS

GB 2278062 A 11/1994
KR 20220073952 A 6/2022
WO 9219334 A1 11/1992
WO 1996001668 A1 1/1996
WO 2007109831 A1 10/2007

OTHER PUBLICATIONS

Written Opinion of the ISA for PCT/NZ2023/050020, mailed May 19, 2023, 8 pages.
Non-Final Rejection, issued in U.S. Appl. No. 18/839,694 dated Mar. 3, 2026.

* cited by examiner

CARRIER ASSEMBLY FOR ELONGATE ITEMS

CROSS-REFERENCE TO RELATED APPLICATIONS

This application is the U.S. national phase of International Application No. PCT/NZ2023/050020 filed Feb. 22, 2023, which designated the U.S. and claims priority to NZ 785426 filed Feb. 23, 2022, the entire contents of each of which are hereby incorporated by reference.

The present invention relates to a carrier assembly and portable carrier assembly for storing elongate shaped members or elongate shaped members as part of other objects or equipment, anti-rotation members to hold elongate items, a central storage system and to a method of inserting or removing at least one elongate shaped item or member to said assemblies. The invention is directed particularly but not solely towards a carrier assembly for peripheral storage of elongate items such as for example golf clubs and including central storage area for accessories, having a detachable portable carrier assembly for elongate items e.g., golf clubs. A method of insertion and removal of an elongate item e.g., a golf club is also disclosed.

BACKGROUND OF INVENTION

Golf is an example of the use of elongate members or items with a carrier, such as golf clubs with a golf bag which was invented in Scotland in the 15th century. Golf is now an important worldwide game and sport for over 20 million players worldwide, with recent reports that there are over 500,000 players in New Zealand and over 1.3 million players in Australia. Golf has many desirable attributes such as competition, camaraderie, the outdoors, nature, physical, mental and health benefits which can be played by yourself, in teams, with friends or with strangers.

A modern set of golf clubs typically consists of three woods (the 1-driver, 3, and 5), at least 1 hybrid (3H) seven irons (4, 5, 6, 7, 8, 9, and PW), and a putter. This gives you a total of twelve clubs, although up to 14 clubs are allowed.

In contrast to other sports, golf is closely linked with its golf bag which has been around since the $18^{th}$ century which functions for storing and holding golf clubs and associated playing equipment. The golf bag is carried by its shoulder strap, golf trundler or golf cart (motorised golf car) and because of the structure of the game and golf course, needs to be on hand throughout the game. Ergonomically, existing bags are of such poor design or elongate over flexible tubular shape, that because of the long game and distance involved, it is common to get sore arms and shoulders. Caddies in particular get back, shoulder or ankle sprains when twisting to lift the bag up and down from the ground Typically, golf bags are formed of a flexible material and the golf clubs centrally stored in central pockets of a central storage area. The bags are so flexible that they can easily be damaged by impact and by moisture. Accessories are housing in zipped pockets which are randomly positioned on the outside of a bag which are in turn needed to be separately affixed such as by threading which combined with the flexible material are prone to wear and failure presenting a frayed or tatty look.

These bags provide an outer shape and weight that are bulky and heavy to move having curved edges with protruding pockets which does not provide for safe stable storage especially during transport in a vehicle. That is the clubs could act like weapons in a car accident.

Furthermore, and most importantly golf clubs must be vertically lifted to be removed and then downwardly inserted into to be replaced from the central storage area. This lifting and downward insertion/removal is very awkward making it difficult to manoeuvre each club upwardly and downwardly into or from separate pockets of the golf bag, whereby such movement or jostling of clubs can be a strain on a players arms. The central sloppy club storage location and the dropping and pulling up of the clubs can also cause a rattling noise which can be distracting or disrespectful to other players. This noise including rattling can also occur when the bag is moving during walking between shots, this is especially disrespectful as it is golf etiquette to remain quiet while others play their shots. It is also golf etiquette to maintain a swift pace of play, which can often include walking to your next shot quietly while others prepare and play their shots. The knocking or rattling together of clubs can also damage clubs, especially their heads.

During the use of a golf bag, there are difficulties in struggling to remove each club and place club head covers on the heads of each club, which can become tedious when having to constantly speed off to the next hole to repeat the process all day. As a result, golf club head covers are very easy to lose on a golf course.

The central sloppy location of golf clubs also makes it harder to see which club is which, which tends to cause the clubs to be in an uncontrollable noisy jumble. This makes club selection difficult, frustrating and time consuming.

Other problems can occur during bad weather such as having handy but conveniently stored, wet weather gear, windproof clothing, warm clothing and sun shade clothing. One solution for wet weather has been to cover the golf bag in a plastic bag or pouch with access via another zip. This can be tedious and not very convenient. If water does get in, it can't escape and it soaks everything.

It is very hard to find anything in existing golf bags, space is wasted with golf clubs always being too loose, and storage is haphazardly sized and positioned, with a lot of waste space with random outward pockets everywhere, with each requiring individual opening. Making it very difficult to remember what pocket items are in. Also, when moving a bag with a golf cart, one needs to fiddle with several straps.

There are problems with having to carry all the golf clubs in the one bag which are very heavy, close to the green on every hole on a golf course only to recover ground back to the next golf hole tee box. Many golfers park their golf clubs next to the next hole tee box and then remove and carry a putter and one or two chipping clubs only to the green. This also can make it easy to loose clubs after they have been used as they are left lying in the grass around the green. Also, clubs lying on the ground in this fashion end up with wet handles which makes using them difficult. There is a need for something portable, self-supporting, weatherproof, lightweight, easy to use other than the awkward vertical golf club installation/removal without the need to carry yet another item separate to the bag.

The setting up and pairing of traditional golf bags and trundlers requires many steps and efforts upon removal from the boot of your car.

Examples of sporting and golf club bags are shown in:

KR 20220073952 with internal clips for holding clubs in place.

US2023001276 with provision for covers for clubs.

US 2007/0074982 golf bag structure

US S 2003/0094390 golf bag with interchangeable pockets

U.S. Pat. No. 5,730,285 Alternative Golf Club Bag

U.S. Pat. No. 6,330,944 Multi-Function Golf Bag

U.S. Pat. No. 4,968,048 Caddy for Baseball and Softball Bats

All references, including any patents or patent applications cited or mentioned in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications may be referred to herein; this reference does not constitute an admission that any of these documents form part of the common general knowledge in the art, in any country.

OBJECT OF THE INVENTION

It is an object of the present invention to provide an improved carrier assembly and for holding elongate shaped items and to methods that ameliorates some of the disadvantages and limitations of the known art or at least provide the public with a useful choice.

SUMMARY OF INVENTION

In a first broad aspect the invention resides in a carrier assembly 1, 56 which is an elongate shaped body for holding or storing at least one elongate shaped item 2 being in use oriented in an upright orientation wherein the elongate shaped body includes a wall support housing assembly 46 which includes side walls 76, 80 having a thickness between an inner surface 66 and outer surface 64 having an upper end and lower end which includes a floor assembly 48, and the side walls 76, 80 having a shape defining an internal side there between and connectively to an outside of the side walls 76, 80 there includes at least one elongate shaped housing 54 in the form of a elongate shaped space 94 having a front wall 86, rear wall 76, 80, 88, side walls 92, a floor 108 shaped and configured of a volume to be able to house when in use at least one elongate item 2 therein and the front wall 86 comprising a planar member including at least one elongate slit shaped opening 120 extending continuously from at least part of the front wall 86 having an enlarged aperture 122 located at an upper end of the opening 120, and the space 94 also configured to removably receive a portion of the elongate shaped item to be able to hold the elongate item therein, whereby in use the at least one elongate item 2 is horizontally and rotationally insertable and/or removable from the elongate shaped space 94 through the elongate slit shaped opening 120 which flexibly parts temporally to allow this insertion and to allow for the elongate item 2 to be removably held vertically therein whereby in use one elongate item 2 is locatable in space 94 to have a portion upwardly protruding through enlarged aperture 122 to hold the elongate item 2 in place.

Preferably at least one anti-rotation member 96, 96*a*, 96*b*, 96*c* is configured to removably receive a portion of the elongate shaped item 2 to be able to hold the elongate item therein, wherein the at least one rotation member 96 is removably attachable to at least one of the walls 76, 80, 88, 92 of one housing 54 therein whereby the anti-rotation member 96 is able to hold the elongate item 2 in place.

Preferably at least one anti-rotation member 96, 96*a*, 96*b*, 96*c* is configured to removably receive a portion of the elongate shaped item 2 to be able to hold the elongate item therein, wherein the at least one rotation member 96 is removably attachable to at least one of the walls 76, 80, 88, 92 of each housing 54 therein whereby the anti-rotation member 96 is able to hold the elongate item in place.

Preferably the at least one anti-rotation member 96, 96*a*, 96*b*, 96*c* has a body having arms 138 extending from a base 39, 136, which is provided and located in space 94 of housing 54 by being affixed to the inside of at least one side wall 92 or rear wall 76, 80, 88 of elongate shaped housing 54 having its splayed arms 138 outwardly protruding from the inner side of walls 92 of the elongate shaped spaces 94 whereby when inserting or removing each elongate item 2 through the slit 120, any horizontal side insertion into adjacent recesses 137 of the anti-rotation member 96 causes the elongate item 2 to be removably held within a space 137 between the arms 138 of anti-rotation member 96, 96*a*, 96*b*, 96*c*.

Preferably the at least one anti-rotation member 96, 96*a*, 96*b*, 96*c* is removably mounted to each end wall 72 of each housing 54.

Preferably the portable carrier includes at least two housings 54.

Alternatively, the portable carrier includes at least four housings 54.

Preferably there is an anti-rotation member for use midway in the wall 92 between housings 54 which includes base 39 or 136 and central rib 136*a* between back-to-back splayed walls 138 whereby the base 136 and rib 136*a* form an H shape in cross section.

Preferably there is an anti-rotation member for use at one end of wall 92 at an end of housing 54 which includes base 39 or 136 and central rib 136*a* forming an H shaped in cross section wherein a portion of the H shaped forms a T shape outwardly protruding beyond base 136.

Preferably there is an anti-rotation member 96 for use at one end of wall 92 at an end of housing 54 which includes base 39 or 136 and central rib 136*b* forming an H shaped in cross section wherein a portion of the H shaped forms a T shape outwardly protruding beyond base 136*c*, and the T has a head portion which extends in length beyond the ends of the base 136 and splayed walls 138.

Preferably the arms 138 are of equal extent beyond the base 136, 136*a*.

Preferably the arms 138 are of unequal extent beyond the base 136*c*.

Preferably, the wall support housing assembly 46 includes a rear wall 78 wherein at least one rear support member 62 is affixed to an outside of the rear wall 78 to provide strength and rigidity to the carrier assembly 1 and to provide means to removably affix accessories thereon wherein at least one strap supporting member 8 is slidably and adjustably attached by gripping to rear support member 62 to provide a pair of spaced slotted apertures for sliding receipt of part of at least one carry strap there through to allow when in use a user to hold by hand/arm/shoulder by itself or in combination with holding the handle 6 to lift or move the carrier assembly 1.

Preferably, there are several elongate shaped housing spaces 54 parallel and abutting with each other located peripherally around outside the wall 76, 80 and the at least one anti-rotation member 96 is located adjacent to a lower end of the space 94 of housing 54 which is also at a lower end of the elongate item 2.

Preferably the anti-rotation members 96, 96*a*, 96*b*, 96*c* are channel shaped members having side walls forming a splayed U cross sectional shape including base 39, 136 removably attached to side wall(s) 92 or rear wall 76, 80, 88 of housing 54 and splayed arms 138 and including the holding space or recess 137 there between the arms 138, wherein in each space 94 of housing 54 there is at least one anti-rotation members 96 to allow a part or end portion 141 of one elongate item (e.g., club) to be inserted there between at least the arms 138 whereby the arms 138 are formed and configured of a material to allow the flexing without deforming to accommodate the elongate item to hold it therein and there between, where upon removal of the elongate item allows the arms 138 to return to their relaxed splayed configuration.

Preferably there are different shaped anti-rotation members 96 (see FIGS. 15-26) for use in different parts of the space 94 of housing 54 such as mid members 96, first end members 96*a* and second end members 96*b*, wherein the mid member anti rotation member 96 includes channel shaped member abutting or joined to each side of base 136 (base 136 being a simple elongate member extending the length of the channel), wherein first end member anti rotation member 96*a* includes one channel member with a base formed of a T cross section extending the length of the channel member and wherein the second end member anti-rotation member 96*b* also includes one channel member with the base being T shaped in cross section and extending beyond the length of the channel member.

Preferably each side wall 92 as located within space 94 of housing 54 being elongate in shape, are formed as spaced elongate wall portions providing at least one space, gap or aperture there between, which are useful for air circulation and/or for allowing protruding portions of elongate items 2 to protrude there through e.g., the head of a tennis racket.

Preferably the anti-rotation member 96 are formed of a flexible but resilient material (e.g., rubber?) to allow repeated flexing, holding and return to original shape, and the front wall 86 of the housing 54 is formed of a flexible material to allow repeated flexing and return to original shape and the housing 54 of the carrier and portable carrier is formed of a polymer composite material suitable to allow moulding to shape, have some degree of water resistances and impact resistance for everyday use of elongate items being inserted and retrieved and movement during transport.

Preferably, the at least one elongate shaped housing 54 has a roof 110 formed of a planar member connected to or formed with the front wall 86, and the roof 110 includes a elongate slit shaped opening 120 connected with the elongate slit shaped opening 120 in the front wall 86, wherein the elongate slit shaped opening 120 in the roof 110 is shaped to include a widened area 122 shaped to match a cross sectional area of an elongate item being shaped to removably hold the said at least one elongate item in place in the elongate shaped housing 54.

Preferably the at least one elongate shaped housing 54 is formed as part of side walls 76, 80 of the wall housing assembly 46 or rear wall 88 forming at least one elongate shaped space 94.

Preferably the at least one elongate shaped housing 54 is formed as part of a portable carrier assembly 56 forming at least one elongate shaped space 94 wherein a portion of the outside of side wall 76, 80 includes an external recess 68 shaped and configured to removably hold the portable carrier assembly 56 therein.

Preferably, the said internal side there between the housing 46, side walls 76, 80 is an internal storage space which includes an upper minor storage space and a lower major storage space wherein the upper minor storage space includes an upper planar space and a lower wedge shaped space and the lower major storage space includes at least one shelf accessed by at least one door.

Preferably, the upper planar space includes a planar space covered by a see through planar shaped first lid member 200, and having a floor 224 wherein the first lid member 200 and floor 224 are each hinged at a rear end of the carrier assembly to allow individual hinging or combined hinging and the upper planar space is formed as a space between the first lid member 200 and floor 224 having a depressed planar portion, and the lower wedge shaped space including a second lid member 204 which also functions as the floor of the upper planar space above, with the lower wedged space including a minor plinth 240 on one side and major plinth 242 on the other side where the minor plinth 240 includes recesses 238 shaped and configured to hold at least one tee 244 therein and the major plinth 242 is shaped and configured having at least one recess 246 to hold at least one golf ball therein.

Preferably, the wedge shaped space has housing walls 199 including side walls and rear walls and a floor 224 to form a housing, the side walls being contiguous with side walls 76, 80 of housing assembly 46, and the rear walls being angled with respect to rear walls of the housing angled forwards towards the front of the carrier assembly to a top and being contiguous from rear wall 78, first lid member 200 and second lid member 204 are angled upwardly from the front of the carrier assembly towards the rear of the carrier assembly to a ridge forming a handle 6 and aperture 7.

Preferably, each recess 238 for the at least one tee 244 includes a separate recess which is adapted to provide a friction fit to removably hold each tee 244 therein and the major plinth 242 includes spaced cylindrically shaped recesses 246 for stacked balls therein.

Preferably, the lower major space is accessible by at least one door 300 vertically oriented and hinged by side hinges 302 each door 300 having an L shaped cross section, forming an accessible central opening at the front of the carrier assembly, wherein there is an internal storage space in the shape of an elongate vertical rectangular space between the walls 76, 80 of the housing 46 having a floor housing 48, a roof 260 and door storage in an elongate vertical rectangular shaped space immediately behind and part of each door 300, wherein the space between the walls 76, 80 of the housing 46 include at least one horizontal oriented space bordered shelf 342 and the door storage has at least one shelf formed as a shallow pocket 336.

Preferably the shelf includes a drawer and/or tray thereby providing five horizontal spaces, and four pockets 336 on a rear side of each door.

Preferably, the at least one door 300 has a side hinge 302 extending from top to bottom of each door 300 attached to a side pillar 71*a* of a front edge of the housing walls 76, 80 wherein each side pillar 71*a* includes a door opening constraint mechanism 340 in the form of a protuberance positioned to prevent each door 300 from opening too wide to fold back to intersect with a portion of the elongate shaped space housing 54.

Preferably, the at least one door 300 is latchable and/or lockable which includes a pivoting lever member 318 articulated to one door 300 in its own recess 319 wherein the pivoting lever member 318 has a latch end and another door 300 has recess 325 with a lever landing member which includes a latch edge whereby when the door or doors 300 are to be opened, the pivoting lever member 318 is levered to rotate out of latching engagement and vice versa for closing.

Preferably, the carrier assembly 1 includes a floor assembly 48 attached to or formed with a lower end of the wall support housing assembly 46, include a roof, side walls and floor forming an enclosed housing, the floor and walls are recessed back from the edge of the roof forming a substantially U shape with side wing portions 361 wherein the wing portions 361 provide extra storage for the length of any stored elongate members there within selected elongate shaped spaces 94 as located at the rear end of the carrier assembly.

Preferably, the wall support housing assembly 46 which includes at least one recess 68 for latchable holding or removal of a portable carrier assembly 56 wherein portable carrier assembly 56 includes a portable carrier housing including elongate shaped housing 54 and support stand apparatus 150, whereby portable carrier assembly 56 is formed in the shape of an elongate rectangular cuboid which includes at least one elongate shaped housing 54 shaped and configured of a volume to be able to house when in use at least one elongate item 2 therein, operatively combined with a support stand apparatus 150, which such assembly 56 is shaped for removable or insertable storage in external recess 68 of the housing assembly 46, the at least one elongate shaped housing 54 which includes at least one elongate shaped space 94 for removable storage for at least one elongate item 2 (e.g., golf club) therein, includes side walls 92, front wall panel 86 and floor, roof 110 wherein the roof 110 and front wall panel 86 include an elongate slit shaped opening 120 connected to widened opening 122 wherein the widened opening 122 is located in the roof, at least two anti-rotation members 96 are provided by being affixed to the inside of each side wall 92 or walls 76, 80, 88 of each elongate shaped housing 54 having its splayed arms 138 outwardly protruding from the inner side of walls 92 of the elongate shaped spaces 94, whereby the connection of the elongate slit shaped openings 120 in the front wall 86 to the elongate slit shaped openings 120 in the roof 110 allows for horizontal translation combined with vertical rotation by an angle 147 about a lower or bottom end 140 and horizontal side insertion into adjacent recesses 137 of adjacent anti-rotation members 96, of one elongate shaped item 2 (e.g., golf club) there through slit 120 into the space 94 of elongate shaped housing 54 which are then caused to upwardly rotate about the lower end 140 through an upper portion of slit 120 to end up having an upper end to upwardly protrude therefrom to allow the elongate item (e.g., golf club) head(s) 144 to upwardly protruding there through and there from the widened opening 122 of roof 110, the support stand apparatus 150 is located on a rear side of the wall support housing 46 opposite to the side including the housing 54, and said stand apparatus 150 includes a rear housing 151 being substantially channel shaped for operatively supporting and rotatably connecting together by a trunnion mechanism, containing a push plate 152, push pull elongate member 154, trunnion 156 and leg members 162, wherein when the portable carrier assembly 56 is taken out of the carrier assembly 1 and the push plate 152 is depressed by tilting the portable carrier assembly 56 about the push plate 152 which automatically actuates the extension of the legs 162 to splay apart in an unfolded configuration to allow the portable carrier assembly 56 to be free standing in a lean-to configuration and/or in reverse when tilting in the opposite direction to automatically fold the legs 162 back into the rear housing 151 in a folded configuration.

Preferably the portable carrier includes at least two housings 54.

Alternatively, the portable carrier includes at least four housings 54.

Preferably, the portable carrier assembly 56 includes a latch holding system to allow removable attaching of the portable carrier assembly 56 to a rear side of one door 300 to within outer recess 68, wherein a button 178 is pressed to release the latch and in combination of a handle recess 177 to allow said removal and insertion.

Preferably, the portable carrier housing which includes a body being rectangular in cross section whereby there are ends and sides, the push plate 152 is oriented in a horizontal plane at an in use bottom of the portable carrier housing, and push pull elongate member 154 being vertically oriented, wherein the trunnion provides four angled axis of rotation on each side to interconnect one end of the legs 162 and push rod 154 to each other and to the rear housing via actuation from the push plate 152, the push plate 152 is a planar shaped member having sides and ends commensurate with the ends and sides of the portable carrier housing, which is movably pivotally or rotationally connected adjacent its side facing inwardly of recess 68 and on the same side as the support stand 150 (opposite to housing 54), to one end (e.g., in use lower) of push pull elongate member 154 by a pivot clip 155, another end (e.g., in use upper end) of push pull elongate member 154 is movably connected and supported to each end of each link arm **156*e*, wherein the other end of each link arm 156*e* are movably connected to a leg end cap 156*c*, each leg end cap 156*c* is movably connected to the trunnion 156 wherein the trunnion 156 is supported by an upper end of the rear housing 151, wherein push rod 154 vertical translation causes link arms 156*e* to move and rotate, to then cause leg end caps 156*c*** to angular rotate about angled but splayed fixed position about fixed position of the trunnion.

Preferably, the trunnion is shaped as a three limbed member (tray shaped-half a trapezoid) comprising a central base **156*a* with angled arms 156*b* which is oriented in a horizontal orientation close to top of the rear housing 151 of portable carrier housing to provide angled vertical rotation there about from the push rod 154 to the arms 156*e* while being stationary in position in the rear housing 151**.

Preferably, the base of the push pull elongate member 154 includes an upside-down T section end member **156*h* movably end supported by a clip 155 on push plate 152 wherein the T section includes a tubular stem portion shaped and adapted to be captured by the end of the push pull elongate member 154**.

Preferably, the trunnion mechanism includes leg end caps **156*c*, push rod end cap 156*d*, link arms 156*e*, pivot pins 156*f* and pivot sleeves 156*g***, operatively connected to together.

Preferably, the push rod end cap **156*d* is substantially T shaped having splayed pivoted end connections to the lower end of the link arms 156*e* and other end is tubular to capture a lower end of the push pull elongate member 154**.

Preferably pivot clip 155 is a T shape having a stem and head wherein the head is held in position in the push plate 152 but is adapted to allow vertical pivoting in a horizontal plane of the head with respect to the clip 155 while transferring a vertical upward translationary movement to push rod 154 which pushes it.

Preferably, the push rod end cap **156*d* includes one end tubular shaped to capture one end of the push pull elongate member 154 therein and has one angled vertical pivot connection for the upper end of the link arm 156*e* and a second pivot connection to one side of the trunnion base 156**.

Preferably push rod end cap **156*d*** provides splayed angled vertical rotation.

Preferably link arm **156*e* provides spaced transfer of angled vertical rotation from the push rod 154 to each top end of each of the arms 162**.

Preferably leg end caps 156*c* provides angled rotation transferred from each link arm 156*e* in combination with the angled vertical rotation about the trunnion base 156 in a similar angle of rotation but spaced apart from each other.

Preferably push rod end cap 156*d* provides splayed angled vertical rotation.

Preferably, the rear housing 151 is shaped to substantially house the support stand apparatus 150 in a folded configuration therein.

Preferably, the rear housing 151 has guide slots for each leg 162 locate near the bottom.

Preferably, the push rod end cap 156*d* is substantially slidably guided within a separate guide slot at the top of and in the rear housing 151.

Preferably, a towel recess 170 is provided beside the rear housing 151, for removable receipt of a magnetic towel.

Preferably, the rear housing 151 includes at least one corner indentation 198 for allowing finger access when removing or holding the portable carrier assembly 56 from the recess 68 of the carrier assembly.

Preferably, at least one biased latch member 178 is provided on one of the sides of the assembly 56 to removably hold the portable carrier assembly 56 in the carrier assembly 1 recess 68.

Preferably, the push plate 152 includes a front aperture (on opposite side to the pivoting side—underneath lower end of housing 54) which is shaped and configured to provide receipt of corresponding upstand on the carrier assembly 1 recess 68 to removably hold the assembly 56 therein.

Preferably the push plate 152 as side pivoted to underneath the bottom end of the portable carrier housing has a wedge-shaped gap 152*a* there between which is at its maximum extent when the arms/legs 162 are in the folded configuration as a so-called relaxed position or non-extended, in rear housing 151 and when the arms/legs are in the unfolded configuration or extended with gap 152*a* as its minimum extent pivoted from and outside of the rear housing.

Preferably, the push plate 152 has at least one downwardly pointing protuberance to provide some gripping or stability of the assembly 56 on a substrate 4.

Preferably, an accessories container or storage box 166 is provided above the rear housing 151 at the rear behind housing 54.

In a second broad aspect the invention resides in a portable carrier assembly 56 being shaped and configured when in use for removable latching receipt in a carrier assembly 1 having a housing assembly 46 wherein the portable carrier assembly 56 includes a portable carrier housing including at least one elongate shaped housing 54 and support stand apparatus 150 in the shape of an elongate rectangular cuboid which includes at least one elongate shaped housing 54 operatively combined with a support stand apparatus 150, which such assembly 56 is shaped for removable or insertable storage in external recess 68 of the housing assembly 46, the at least one elongate shaped housing 54 which includes at least one elongate shaped space 94 for removable storage for at least one elongate item 2 therein, includes side walls 92, front wall panel 86 and floor 108, roof 110 shaped and configured of a volume to be able to house when in use at least one elongate item 2 therein wherein the roof 110 and front wall panel 86 include an elongate slit shaped opening 120 connected to widened opening 122 wherein the widened opening 122 is located in the roof, whereby the connection of the elongate slit shaped openings 120 in the front wall 86 to the elongate slit shaped openings 120 in the roof 110 allows for horizontal translation combined with vertical rotation of the elongate item 2 by an angle 147 about a lower or bottom end 140 to removably hold the elongate item therein in housing 54 but not restrict rotation therein, of one elongate shaped item 2 (e.g., golf club) there through slit 120 into the space 94 of elongate shaped housing 54 which are then caused to upwardly rotate about the lower end 140 through an upper portion of slit 120 to end up having an upper end to upwardly protrude therefrom to allow the elongate item (e.g., golf club) head(s) 144 to upwardly protruding there through and there from the widened opening 122 of roof 110, the support stand apparatus 150 is located on a rear side of the wall support housing 46 opposite to the side including the housing 54, and said stand apparatus 150 includes a rear housing 151 being substantially channel shaped for operatively supporting and connected together by a trunnion mechanism, containing a push/foot plate 152, push pull elongate member 154, trunnion 156 and leg members 162, wherein when the portable carrier assembly 56 is taken out of the carrier assembly 1 and the push plate 152 is depressed by tilting the portable carrier assembly 56 about the push plate 152 which automatically actuates the extension of the legs 162 to splay apart in an unfolded configuration to allow the portable carrier assembly 56 to be free standing in a lean-to configuration and/or in reverse when tilting in the opposite direction to automatically fold the legs 162 back into the rear housing 151 in a folded configuration.

Preferably at least one anti-rotation member 96, 96*a*, 96*b*, 96*c* is configured to removably receive a portion of the elongate shaped item 2 to be able to hold the elongate item therein, wherein the at least one rotation member 96 is removably attachable to at least one of the walls 76, 80, 88, 92 of each housing 54 therein whereby the anti-rotation member 96 is able to hold the elongate item in place.

Preferably the at least one anti-rotation member 96, 96*a*, 96*b*, 96*c* has a body having arms 138 extending from a base 39, 136, which is provided and located in space 94 of housing 54 by being affixed to the inside of at least one side wall 92 or rear wall 76, 80, 88 of elongate shaped housing 54 having its splayed arms 138 outwardly protruding from the inner side of walls 92 of the elongate shaped spaces 94 whereby when inserting or removing each elongate item 2 through the slit 120, any horizontal side insertion into adjacent recesses 137 of the anti-rotation member 96 causes the elongate item 2 to be removably held within a space 137 between the arms 138 of anti-rotation member 96, 96*a*, 96*b*, 96*c*.

Preferably the at least one anti-rotation member 96, 96*a*, 96*b*, 96*c* is removably mounted to each end wall 72 of each housing 54.

Preferably the portable carrier includes at least two housings 54.

Alternatively, the portable carrier includes at least four housings 54.

Preferably there is an anti-rotation member for use midway in the wall 92 between housings 54 which includes base 39 or 136 and central rib 136*a* between back to back splayed walls 138 whereby the base 136 and rib 136*a* form an H shape in cross section.

Preferably there is an anti-rotation member for use at one end of wall 92 at an end of housing 54 which includes base 39 or 136 and central rib 136*a* forming an H shaped in cross section wherein a portion of the H shaped forms a T shape outwardly protruding beyond base 136.

Preferably there is an anti-rotation member for use at one end of wall 92 at an end of housing 54 which includes base 39 or 136 and central rib 136*b* forming an H shaped in cross section wherein a portion of the H shaped forms a T shape outwardly protruding beyond base 136*c* and the T has a head portion which extends in length beyond the ends of the base 136 and splayed walls 138.

Preferably the arms 138 are of equal extent beyond the base 136, 136*a*.

Preferably the arms 138 are of unequal extent beyond the base 136*c*.

Preferably, the portable carrier assembly 56 includes a latch holding system to allow removable attaching of the portable carrier assembly 56 to a rear side of one door 300 to within outer recess 68, wherein a button 178 is pressed to release the latch and in combination of a handle recess 177 to allow said removal and insertion.

Preferably, the portable carrier housing which includes a body being rectangular in cross section whereby there are ends and sides, the push plate 152 is oriented in a horizontal plane at an in use bottom of the portable carrier housing, and push pull elongate member 154 being vertically oriented, wherein the trunnion provides four angled axis of rotation on each side to interconnect one end of the legs 162 and push rod 154 to each other and to the rear housing via actuation from the push plate 152, the push plate 152 is a planar shaped member having sides and ends commensurate with the ends and sides of the portable carrier housing, which is movably pivotally or rotationally connected adjacent its side facing inwardly of recess 68 and on the same side as the support stand 150 (opposite to housing 54), to one end (e.g., in use lower) of push pull elongate member 154 by a pivot clip 155, another end (e.g., in use upper end) of push pull elongate member 154 is movably connected and supported to each end of each link arm 156*e*, wherein the other end of each link arm 156*e* are movably connected to a leg end cap 156*c*, each leg end cap 156*c* is movably connected to the trunnion 156 wherein the trunnion 156 is supported by an upper end of the rear housing 151, wherein push rod 154 vertical translation causes link arms 156*e* to move and rotate, to then cause leg end caps 156*c* to angular rotate about angled but splayed fixed position about fixed position of the trunnion.

Preferably, the trunnion 156 is shaped as a three limbed member comprising a central base 156*a* with angled arms 156*b* which is oriented in a horizontal orientation close to top of the rear housing 151 of portable carrier housing to provide angled vertical rotation there about from the push rod 154 to the arms 156*e* while being stationary in position in the rear housing 151.

Preferably the anti-rotation members 96, 96*a*, 96*b* are channel shaped members having side walls forming a splayed U cross sectional shape including a base 136 removably attached to side walls 92 or rear wall 76, 80, 88 of housing 54 and splayed arms 138 and including a holding space or recess 137 there between the arms 138, wherein in each space 94 of housing 54 there is at least one anti-rotation member 96 to allow a part or portion of one elongate item (e.g., club) to be inserted there between whereby the arms 138 are formed and configured of a material to allow the flexing without deforming to accommodate the elongate item (e.g., club) to hold it therein and there between, where upon removal of the elongate item allows the arms 138 to return to their relaxed splayed configuration.

Preferably the space 94 of housing includes two anti-rotation members spaced opposite each other on opposing spaced side walls 92, with the arms 136 outwardly protruding towards each other but spaced sufficiently from each other to allow a portion of the elongate item to be held there between an entrance part of the space 137 of the flexed arms of both anti-rotation members but not necessarily needing to be wholly captured in space 137 of both anti-rotation members 96, 96*a*, 96*b*.

Preferably the anti-rotation member 96 are formed of a flexible but resilient material (e.g., rubber?) to allow repeated flexing, holding and return to original shape, and the front wall 86 of the housing 54 is formed of a flexible material to allow repeated flexing and return to original shape and the housing 54 of the carrier and portable carrier is formed of a polymer composite material suitable to allow moulding to shape, have some degree of water resistances and impact resistance for everyday use of elongate items being inserted and retrieved and movement during transport.

Preferably, there are two elongate shaped housing spaces 54 parallel with each other located peripherally around outside the wall 76, 80 and the at least one anti-rotation member is located adjacent to a lower end of the space 94 of housing 54 which is also at a lower end of the elongate item 2.

Preferably, the at least one elongate shaped housing 54 has a roof 110 formed of a planar member connected to or formed with the front wall 86, and the roof 110 includes a elongate slit shaped opening 120 connected with the elongate slit shaped opening 120 in the front wall 86, wherein the elongate slit shaped opening 120 in the roof 110 is shaped to include a widened area 122 shaped to match the cross sectional area of an elongate item being shaped to removably hold the said at least one elongate item in place in the elongate shaped housing 54.

Preferably, the base of the push pull elongate member 154 includes an upside-down T section end member 156*h* movably end supported by a clip 155 on push plate 152 wherein the T section includes a tubular stem portion shaped and adapted to be captured by the end of the push pull elongate member 154.

Preferably, the trunnion mechanism includes leg end caps 156*c*, push rod end cap 156*d*, link arms 156*e*, pivot pins 156*f* and pivot sleeves 156*g*, operatively connected to together.

Preferably, the push rod end cap 156*d* is substantially T shaped having splayed pivoted end connections to the lower end of the link arms 156*e* and other end is tubular to capture a lower end of the push pull elongate member 154.

Preferably pivot clip 155 is a T shape having a stem and head wherein the head is held in position in the push plate 152 but is adapted to allow vertical pivoting in a horizontal plane of the head with respect to the clip 155 while transferring a vertical upward translationary movement to push rod 154 which pushes it.

Preferably, the push rod end cap 156*d* includes one end tubular shaped to capture one end of the push pull elongate member 154 therein and has one angled vertical pivot connection for the upper end of the link arm 156*e* and a second pivot connection to one side of the trunnion base 156.

Preferably push rod end cap 156*d* provides splayed angled vertical rotation.

Preferably link arm 156*e* provides spaced transfer of angled vertical rotation from the push rod 154 to each top end of each of the arms 162.

Preferably leg end caps 156*c* provides angled rotation transferred from each link arm 156*e* in combination with the angled vertical rotation about the trunnion base 156 in a similar angle of rotation but spaced apart from each other.

Preferably push rod end cap 156*d* provides splayed angled vertical rotation.

Preferably, the rear housing 151 is shaped to substantially house the support stand apparatus 150 in a folded configuration therein.

Preferably, the rear housing 151 has guide slots for each leg 162 locate near the bottom.

Preferably, the push rod end cap 156*d* is substantially slidably guided within a separate guide slot at the top of and in the rear housing 151.

Preferably, a towel recess 170 is provided beside the rear housing 151, for removable receipt of a magnetic towel.

Preferably, the rear housing 151 includes at least one corner indentation 198 for allowing finger access when removing or holding the portable carrier assembly 56 from the recess 68 of the carrier assembly.

Preferably, at least one biased latch member 178 is provided on one of the sides of the assembly 56 to removably hold the portable carrier assembly 56 in the carrier assembly 1 recess 68.

Preferably, the push plate 152 includes a front aperture (on opposite side to the pivoting side—underneath lower end of housing 54) which is shaped and configured to provide receipt of corresponding upstand on the carrier assembly 1 recess 68 to removably hold the assembly 56 therein.

Preferably the push plate 152 as side pivoted to underneath the bottom end of the portable carrier housing has a wedge-shaped gap 152*a* there between which is at its maximum extent when the arms/legs 162 are in the folded configuration as a so-called relaxed position or non-extended, in rear housing 151 and when the arms/legs are in the unfolded configuration or extended with gap 152*a* as its minimum extent pivoted from and outside of the rear housing.

Preferably, the push plate 152 has at least one downwardly pointing protuberance to provide some gripping or stability of the assembly 56 on a substrate 4.

Preferably, an accessories container or storage box 166 is provided above the rear housing 151 at the rear behind housing 54.

Preferably the anti-rotation member 96 are formed of a flexible but resilient material (e.g., rubber) to allow repeated flexing holding and return to original shape, the front wall 86 is formed of a flexible material to allow repeated flexing and return to original shape and the housing of the portable carrier is formed of a polymer composite material suitable to allow moulding to shape, have some degree of water resistances and impact resistance for everyday use of elongate items being inserted and retrieved and movement during transport.

In a third broad aspect the invention resides in an anti-rotation member 96, 96*a*, 96*b*, 96*c* which is a substantially channel shaped member having side walls forming a splayed substantially shaped U cross sectional shape including a base 136 when in use is removably attachable to side walls 92 and/or to rear wall 76, 80, 88 of housing 54, and splayed arms 138 extending from the base 136 and including a holding space or recess 137 there between the arms 138, wherein in each space 94 of housing 54 there is at least one anti-rotation member 96 to allow a part or portion of one elongate item (e.g., club) to be inserted there between at least a part of space 137 whereby the arms 138 which are formed and configured of a material to allow the flexing about the base 136 without deforming to accommodate a portion of the elongate item 2 to hold it therein and there between the arms 138, where upon removal of the elongate item 2 allows the arms 138 to return to their relaxed splayed configuration.

Preferably the walls 138 are formed of a length having at one end, angled cut off pair of corners.

Preferably when in use, within the space 94 of housing 54 of a carrier assembly, there includes two anti-rotation members 96, 96*a*, 96*b*, 96*c* spaced opposite each other on opposing spaced side walls 92 or rear wall 76, 80, 88, with the arms 136 outwardly protruding towards each other but spaced sufficiently from each other to allow a portion of the elongate item to be held there between an entrance part of the space 137 of the flexed arms of both anti-rotation members but not necessarily needing to be wholly captured in all of space 137 of both anti-rotation members 96, 96*a*, 96*b*.

Preferably the anti-rotation member 96 are formed of a flexible but resilient material (e.g., rubber) to allow repeated flexing, holding and return to original shape, and the front wall 86 of the housing 54 is formed of a flexible material to allow repeated flexing and return to original shape and the housing 54 of the carrier and portable carrier is formed of a polymer composite material suitable to allow moulding to shape, have some degree of water resistances and impact resistance for everyday use of elongate items being inserted and retrieved and movement during transport and yet allow the item 2 to be retained therein housing 54.

Preferably there is an anti-rotation member for use midway in the wall 92 between housings 54 which includes base 39 or 136 and central rib 136*a* between back-to-back splayed walls 138 whereby the base 136 and rib 136*a* form an H shape in cross section.

Preferably there is an anti-rotation member for use at one end of wall 92 at an end of housing 54 which includes base 39 or 136 and central rib 136*a* forming an H shaped in cross section wherein a portion of the H shaped forms a T shape outwardly protruding beyond base 136.

Preferably there is an anti-rotation member for use at one end of wall 92 at an end of housing 54 which includes base 39 or 136 and central rib 136*b* forming an H shaped in cross section wherein a portion of the H shaped forms a T shape outwardly protruding beyond base 136*c* and the T has a head portion which extends in length beyond the ends of the base 136 and splayed walls 138.

Preferably the arms 138 are of equal extent beyond the base 136, 136*a*.

Preferably the arms 138 are of unequal extent beyond the base 136*c*.

In a fourth broad aspect the invention resides in a method of inserting or removing an elongate item 2 e.g., golf club into or out of a carrier assembly 1 or portable carrier assembly 56, wherein a carrier assembly 1 or portable carrier assembly 56 which includes an elongate shaped body for holding or storing at least one elongate shaped item being in use oriented in an upright orientation wherein the elongate shaped body includes a wall support housing assembly 46 which includes side walls 76, 80 having a thickness between an inner surface 66 and outer surface 64 having an upper end and lower end which includes a floor assembly 48, and the housing side walls 76, 80 having a shape defining an internal side there between and connectively to an outside of the side walls 76, 80 includes at least one elongate shaped housing 54 in the form of an elongate shaped space 94 having a front wall 86, a floor 108 shaped and configured of a volume to be able to house when in use at least one elongate item 2 therein and the front wall 86 comprising a planar member including at least one elongate slit shaped opening 120 extending continuously from at least part of the front wall 86 and the space 94, configured to removably receive a portion of the elongate shaped item 2 to be able to hold the elongate item 2 therein, whereby the at least one elongate item 2 is horizontally and rotationally insertable or removable from the elongate shaped space 94 through the elongate slit shaped opening 120 which flexibly parts temporally to allow this insertion and to allow for the elongate item 2 to be removably held vertically therein is able to hold the elongate item 2 in place, wherein the method includes the following steps of:

a) Orientate a lower end 140 of an elongate item 2 at an angle to the horizontal in a vertical plane, to point in through at a lower portion of slit opening 120;
b) Then locate said lower end 140 of elongate item 2 to substantially abut the floor 108 or be close to the floor 108 of elongate shaped space 94 of housing 54;
c) Then vertically moving it about its pivot point at floor 108 or a position at or near to the floor 108 will allow the rest of the club to move upwardly through more of the lower portion of slit opening 120 above the lowest portion;
d) Then continue pivotal movement of the elongate item 2 about the floor 108 or near to, upwardly through slit opening 120 until a top portion near top end 140 of the elongate item 2, is located in widened opening 122, to thereby have an upper portion 144 of the elongate item to be upwardly protruding therefrom and a lower portion to then rest on floor 108.

Preferably the method as given for insertion, is reversed for causing the removal of the elongate item 2 (e.g., a golf club) from the elongate shaped housing 54.

Preferably the method as given above is adjusted for use with the anti-rotation members 96, 96*a*, 96*b*, 96*c* as removably located on at least one wall 92, 76, 80, 88 at least at a lower end of the housing (as this prevents rotation about the club axis and hence stop clubs from rattling against one another if the housings and hence the club heads are closely spaced) whereby the steps include:

a) Orientate a lower end 140 of an elongate item 2 at an angle to the horizontal in a vertical plane, to point in through at a lower portion of slit opening 120;
b) Then locate said lower end 140 of elongate item 2 to substantially abut the floor 108 or be close to the floor 108 of elongate shaped space 94 of housing 54;
c) Then pivot upwardly about floor 108 or near to the floor 108 whereby the anti-rotation member 96 if engaged will prevent rotation about the axis of the elongate item whereby a lower portion of the elongate item 2 is located into recess 137 of the anti-rotation member 96 by splaying the walls 138 further apart to positively locate a portion of the elongate item 2 therein,
d) Then continue pivoting upwardly of the elongate item 2 about the floor 108 or near to, through slit opening 120 and engagement with the other anti-rotation members 96 until a top portion near top end 140 of the elongate item 2, is located in widened opening 122, to thereby have an upper portion 144 of to be upwardly protruding therefrom and a lower portion removably and resiliently held in the space or recess 137 of the anti-rotation member 96 to then rest on floor 108.

In a fifth broad aspect the invention resides in a carrier assembly 1, 56 which is an elongate shaped body for holding or storing at least one elongate shaped item 2 being in use oriented in an upright orientation wherein the elongate shaped body includes a wall support housing assembly 46 which includes side walls 76, 80 having a thickness between an inner surface 66 and outer surface 64 having an upper end and lower end which includes a floor assembly 48, and the side walls 76, 80 having a shape defining an internal side storage cavity there between and connectively to an outside of the side walls 76, 80 includes at least one elongate shaped housing 54 in the form of an elongate shaped space 94 having a front wall 86, rear walls 80, 88, side walls 92, a floor 108 shaped and configured of a volume to be able to house when in use at least one elongate item 2 therein and the front wall 86 comprising a planar member including at least one elongate slit shaped opening 120 extending continuously from at least part of the front wall 86 and the space 94 configured to removably receive a portion of the elongate shaped item 2 to be able to hold the elongate item 2 therein, whereby the at least one elongate item 2 is horizontally and rotationally insertable or removable from the elongate shaped space 94 through the elongate slit shaped opening 120 which flexibly parts temporally to allow this insertion and to allow for the elongate item to be removably held vertically therein, wherein, the said internal side there between the housing 46, side walls 76, 80 is an internal storage space which includes an upper minor storage space and a lower major storage space wherein the upper minor storage space includes an upper planar space and a lower wedge shaped space and the lower major storage space includes at least one shelf accessed by at least one door.

Preferably, the upper planar space includes a planar space covered by a see through planar shaped first lid member 200, and having a floor 224 wherein the first lid member 200 and floor 224 are each hinged at a rear end of the carrier assembly to allow individual hinging or combined hinging and the upper planar space is formed as a space between the first lid member 200 and floor 224 having a depressed planar portion, and the lower wedge shaped space including a second lid member 204 which also functions as the floor of the upper planar space above, with the lower wedged space including a minor plinth 240 on one side and major plinth 242 on the other side where the minor plinth 240 includes recesses 238 shaped and configured to hold at least one tee 244 therein and the major plinth 242 is shaped and configured having at least one recess 246 to hold at least one golf ball therein.

Preferably, the wedge shaped space has housing walls 199 including side walls and rear walls and a floor 224 to form a housing, the side walls being contiguous with side walls 76, 80 of housing assembly 46, and the rear walls being angled with respect to rear walls of the housing angled forwards towards the front of the carrier assembly to a top and being contiguous from rear wall 78, first lid member 200 and second lid member 204 are angled upwardly from the front of the carrier assembly towards the rear of the carrier assembly to a ridge forming a handle 6 and aperture 7.

Preferably, each recess 238 for the at least one tee 244 includes a separate recess which is adapted to provide a friction fit to removably hold each tee 244 therein and the major plinth 242 includes spaced cylindrically shaped recesses 246 for stacked balls therein.

Preferably, the lower major space is accessible by at least one door 300 vertically oriented and hinged by side hinges 302 each door 300 having an L shaped cross section, forming an accessible central opening at the front of the carrier assembly, wherein there is an internal storage space in the shape of an elongate vertical rectangular space between the walls 76, 80 of the housing 46 having a floor housing 48, a roof 260 and door storage in an elongate vertical rectangular shaped space immediately behind and part of each door 300, wherein the space between the walls 76, 80 of the housing 46 include at least one horizontal oriented space bordered shelf 342 and the door storage has at least one shelf formed as a shallow pocket 336.

This invention may also broadly be said to consist in the parts, elements and features referred to or indicated in the specification of the application, individually or collectively, and any or all combinations of any two or more of the parts, elements or features, and where specific integers are mentioned herein which have known equivalents such equivalents are deemed to be incorporated herein as if individually set forth.

BRIEF DESCRIPTION

The invention will now be described, by way of example only, by reference to the accompanying drawings:

FIG. 1 is a perspective view of the carrier assembly from a right side in accordance with a first preferred embodiment of the invention.

FIG. 2 is a front view of the golf carrier assembly.

FIG. 3 is a rear view of the golf carrier assembly.

FIG. 4 is a close-up view of the top of the rear of the golf carrier assembly FIG. 5 is a right-side view.

FIG. 5*a* is a close up front of elongate shaped housings 54.

FIG. 5*b* is a schematic close up cross section of housings 54.

FIG. 6 is a right side vertical cross section.

FIG. 7 is a left side view of the golf carrier assembly 1.

FIG. 7*a* is a perspective view of the rear and left of the carrier assembly 1

FIG. 7*b* is a bottom plan view of the base of the carrier assembly 1.

FIG. 7*c* is a top plan view of the top of the carrier assembly 1 with lid closed FIG. 8 is a close-up perspective view from the right of the top part of the carrier FIG. 9 is an upper front close up partial view with part of the lid assembly up FIG. 10 is an upper right side close up view of inside of the upper major compartment FIG. 11 is a partial close-up view from left, of upper major compartment with the lid assembly up FIG. 12 is a close up front and top view of an upper major compartment with the lid assembly up.

FIG. 13 is a left side view of the top with the lid assembly up showing right side of upper major compartment FIG. 14 is a perspective view of the side of the carrier assembly with an outer face removed to see how the elongate items e.g., golf clubs, are housing therein FIG. 15 is a top plan cross sectional view of the carrier assembly.

FIG. 15A is a top plan cross sectional view of the carrier assembly with three anti-rotation members per housing FIG. 15B is a top plan cross sectional view of the carrier assembly with no anti-rotation members housing.

FIG. 15C is a top plan cross sectional view of the carrier assembly with one anti-rotation member located on one side wall of each housing.

FIG. 15D is a top plan cross sectional view of the carrier assembly with one anti-rotation members located in each housing located on rear wall of the housing.

Anti-Rotation Member—Mid Member 96

FIG. 16 is an upper perspective view of one double sided anti-rotation member.

FIG. 17 is a front perspective view of the anti-rotation member.

FIG. 18 is a top plan view of the anti-rotation member.

FIG. 19 is a front perspective view of several anti-rotation members (single and double) in place inside the carrier assembly with an elongate item e.g., golf club, grip in place FIG. 20 is a top plan view of several anti-rotation members (single and double) in place inside the carrier assembly FIG. 21 is a is a front perspective view of several anti-rotation members (single and double) in place inside the carrier assembly without an elongate item e.g., golf club grip 141 in place Anti-Rotation Member—First End Member 96*a*

FIG. 22 is an upper perspective view of one anti-rotation member

FIG. 23 is a side view of the anti-rotation member of FIG. 22.

FIG. 24 is an end view of the anti-rotation member of FIG. 22.

FIG. 25 is a perspective view of the single and double anti-rotation members as for attachment to an end wall FIG. 26 is a front view if single and double anti-rotation members.

Anti-Rotation Member—First End Member 96*b*

FIG. 26*a* is an upper perspective view of one anti-rotation member.

FIG. 26*b* is a side view of the anti-rotation member of FIG. 22

FIG. 26*c* is an end view of the anti-rotation member of FIG. 22.

FIG. 26*d* is a side view of a lower end showing the anti-rotation members in the middle and rear end FIG. 27 is a is a front perspective view of the carrier assembly with the front doors open to show some of the storage FIG. 28 is a is a close-up perspective view of the door hinge FIG. 29 is an upper perspective view as a cross section across the lower major storage compartment with doors open FIG. 30 is a front perspective view of the carrier assembly and portable carrier assembly as disassembled Portable Carrier Assembly FIG. 31 is a front and side perspective view of the portable carrier assembly FIG. 32 is an upper perspective view of the portable carrier assembly with legs unfolded/splayed.

FIG. 33 is a side perspective view of the portable carrier assembly with legs unfolded/splayed.

FIG. 33*a* is a side perspective view of the portable carrier assembly with legs unfolded/splayed—with elongate items i.e., golf clubs, being inserted into the housing FIG. 34 is a side rear perspective view of the portable carrier assembly with legs splayed FIG. 35 is a side rear view of side perspective view of the portable carrier assembly with legs folded into rear housing FIG. 36 is a side view of the portable carrier assembly with legs folded.

FIG. 37 is another rear side perspective view of the portable carrier assembly with legs unfolded FIG. 38 is a rear side perspective close up view of the push plate connected to the rear housing—legs folded FIG. 39 is a rear side perspective close up view of the push plate connected to the rear housing—legs unfolded FIG. 40 is a front close up perspective view of the legs and push pull rod joint to the trunnion—legs folded FIG. 41 is a front close up perspective view of the legs and push pull rod joint to the trunnion—legs unfolded.

FIG. 42 part side cross section of push plate connected to the rear housing—legs folded FIG. 43 part side cross section of push plate connected to the rear housing—legs unfolded FIG. 44 is a part rear perspective view of the portable carrier assembly in a folded configuration showing the magnetic towel and its housing FIG. 45 is a front perspective view of the legs, push pull rod and trunnion mechanism—unassembled exploded view FIG. 46 is a side perspective view of the legs, push pull rod and trunnion mechanism—unassembled exploded view FIG. 47 is a side perspective upper view of the legs, push pull rod and trunnion mechanism and accessories housing box-exploded view FIG. 48 are close up front, inside and outside view of the top of elongate shaped item housing 54 as made up of three wall components FIG. 49 is a side perspective views of a lower part of FIG. 51 showing the bottom of the rear housing and the push plate FIG. 50 are close up front, inside and outside views of the bottom of the three components of the elongate shaped item housing 54

FIG. 51 is a side perspective view as made up of three wall components perspective view of the support stand apparatus—unassembled exploded views FIG. 52 is a close up front, inside and outside views of three elongate shaped wall components making up housing 54 of portable carrier assembly 56

FIG. 52*a* is a close up perspective view of the trunnion connection to push rod and link arm FIG. 52*b* is a horizontal cross section of the portable carrier assembly at its base showing the three wall components of the housing 54, anti-rotation members and rear housing 151

Removing or Installing Elongate Items e.g., Golf Clubs

FIG. 53 is a front side perspective view of the carrier assembly showing how elongate items can be removed or inserted in the elongate shaped item housing FIG. 54 is a perspective side view of the lower end of the carrier assembly and elongate item part way through removal or insertion FIG. 55 is a perspective cross sectional side view of the lower end of the carrier assembly and elongate item part way through removal or insertion FIG. 56 is side perspective view of the carrier assembly with elongate items in all housings 54, showing how elongate items can be removed or inserted in the elongate shaped item housing FIG. 57 is side perspective view of a lower part of the carrier assembly, showing how an elongate item can be removed or inserted in a lower end of the elongate shaped item housing FIG. 58 is a close up cross sectional view of a lower part of the views of 53-57 showing how the front wall defects during removal or insertion of a grip of a elongate item e.g., golf club FIG. 59 is a close up perspective view of an upper portion of the carrier assembly showing where a removable cup holder is attachable on the rear of the carrier assembly FIG. 60 is a close up perspective view of an upper portion of the carrier assembly showing how a removable cup holder is attachable on the rear of the carrier assembly Insertion of Elongate Item e.g., Golf Club FIG. 61 is a schematic cross sectional side view of the elongate item being first inserted into the bottom portion of the housing 54 and then being upwardly rotated.

FIG. 62 is a schematic cross sectional side view of the elongate item being downwardly inserted into the housing, and then rotating through further upward rotation.

FIG. 63 is a schematic cross sectional side view of the elongate item being inserted into the housing, further upward rotation with elongate item ending up as substantially up right.

FIG. 64 is a side view of the carrier assembly adapted for use with elongate items such as tennis rackets have side slots in the housing wall 92 of each housing.

FIG. 65 is a side perspective view of the carrier assembly but with the housing removed to show the outer surface of the carrier.

FIG. 66 is a side perspective view of the carrier assembly with the housings removed to show the location of a club against the outer surface of the carrier.

DEFINITIONS

We prefer to use the term "Carrier Assembly" rather than golf club bag as the carrier assembly has a rigid case (so it is not a flexible bag) and the clubs are held on the exterior of the case. Carrier Assembly for elongate shaped items is also applicable to the storage and carrying of various sporting implements, e.g. lacrosse sticks, baseball and softball bats, racquets such as tennis racquets, etc.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process. The terms "including and having" or "having and including", as used herein, are defined as comprising (i.e., open language).

For purposes of the description hereinafter, terms "upper", "up", "lower", "down", "right", "left", "vertical", "horizontal", "top", "bottom", "lateral", "longitudinal", "side", "front", "rear" and derivatives thereof shall relate to the invention as it is oriented in the drawing figures. However, it is to be understood that the invention may assume various alternative variations, except where expressly specified to the contrary.

DESCRIPTION OF DRAWINGS

The following description will describe the invention in relation to preferred embodiments of the invention, namely a carrier assembly 1 for elongate shaped items 2, implements or equipment having an elongate item or as part of another object, such as for example golf clubs or tennis rackets and methods. The invention is in no way limited to these preferred embodiments as they are purely to exemplify the invention only and that possible variations and modifications would be readily apparent without departing from the scope of the invention.

Figure 15:
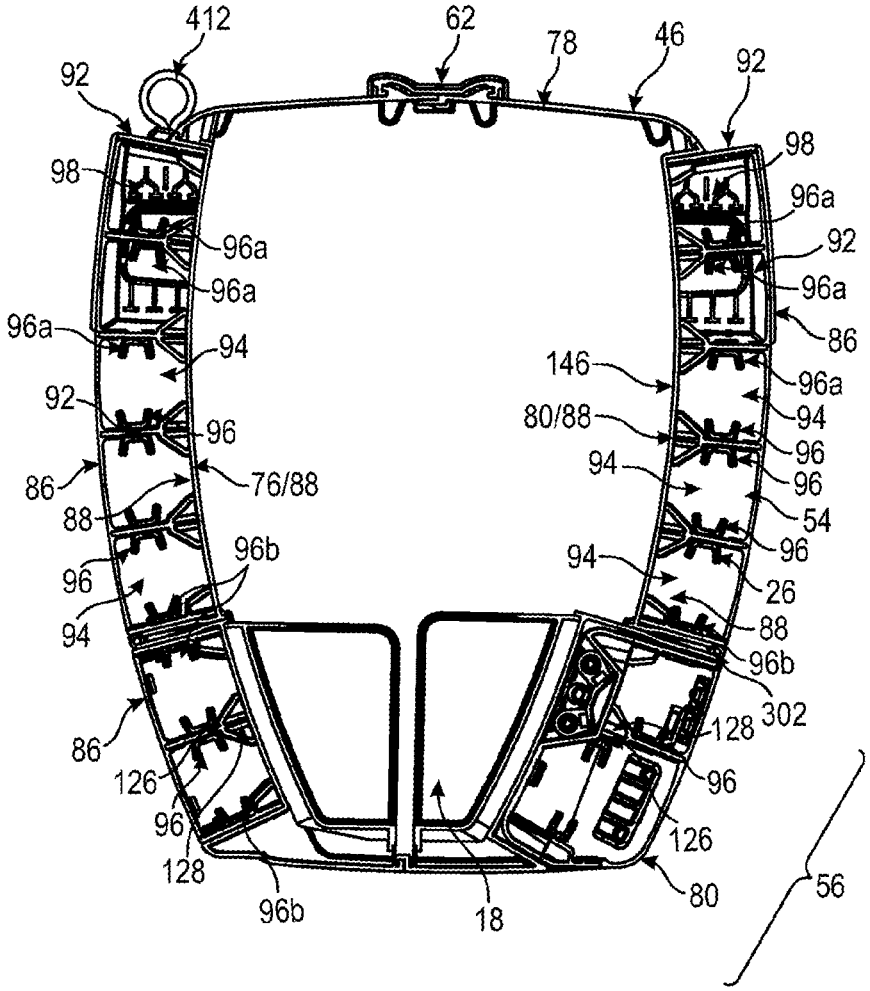
Figure 15A:
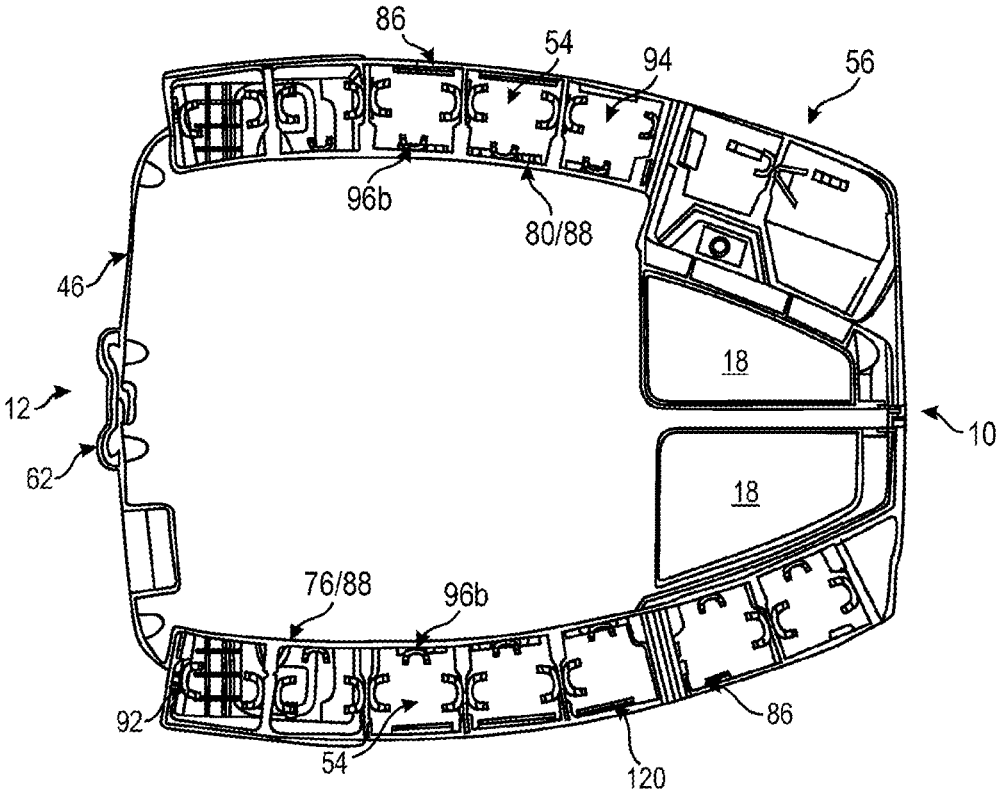
Figure 15B:
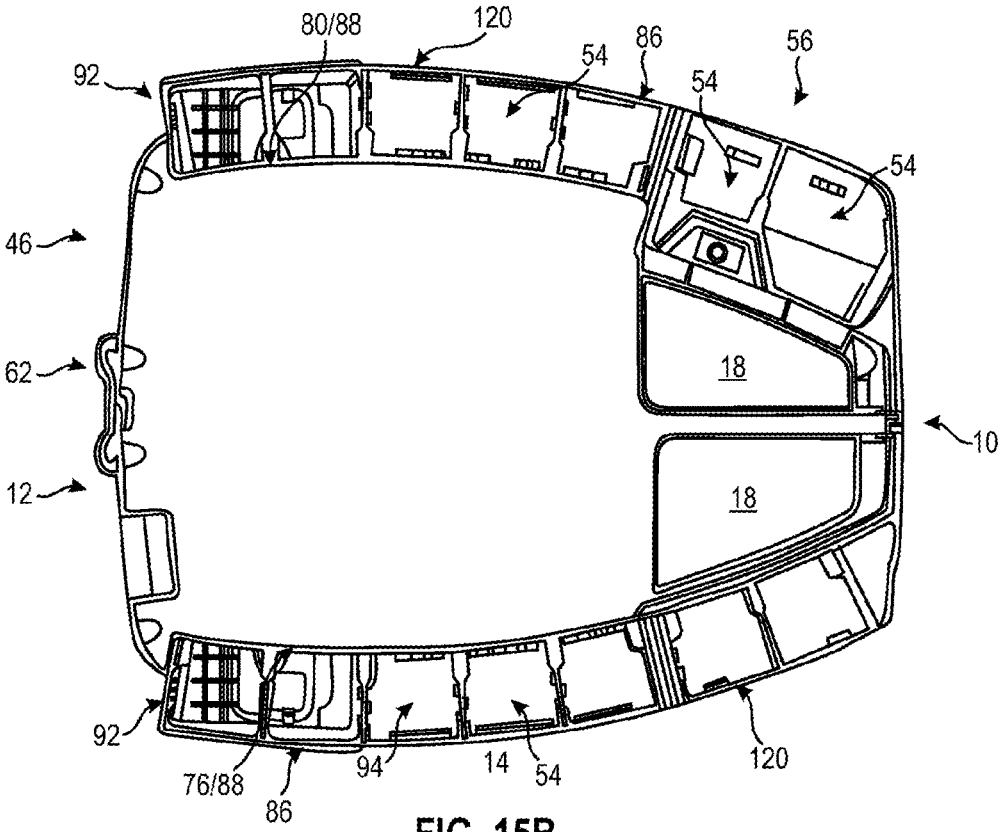
Figure 15C:
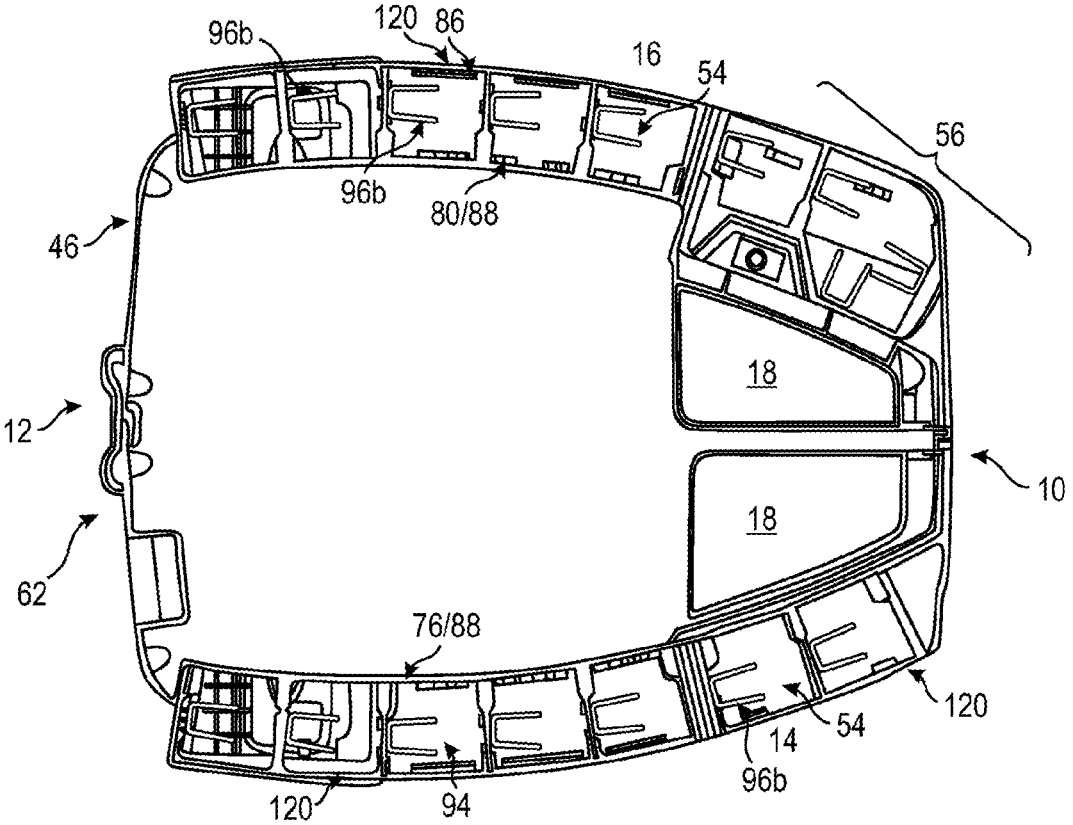
Figure 15D:
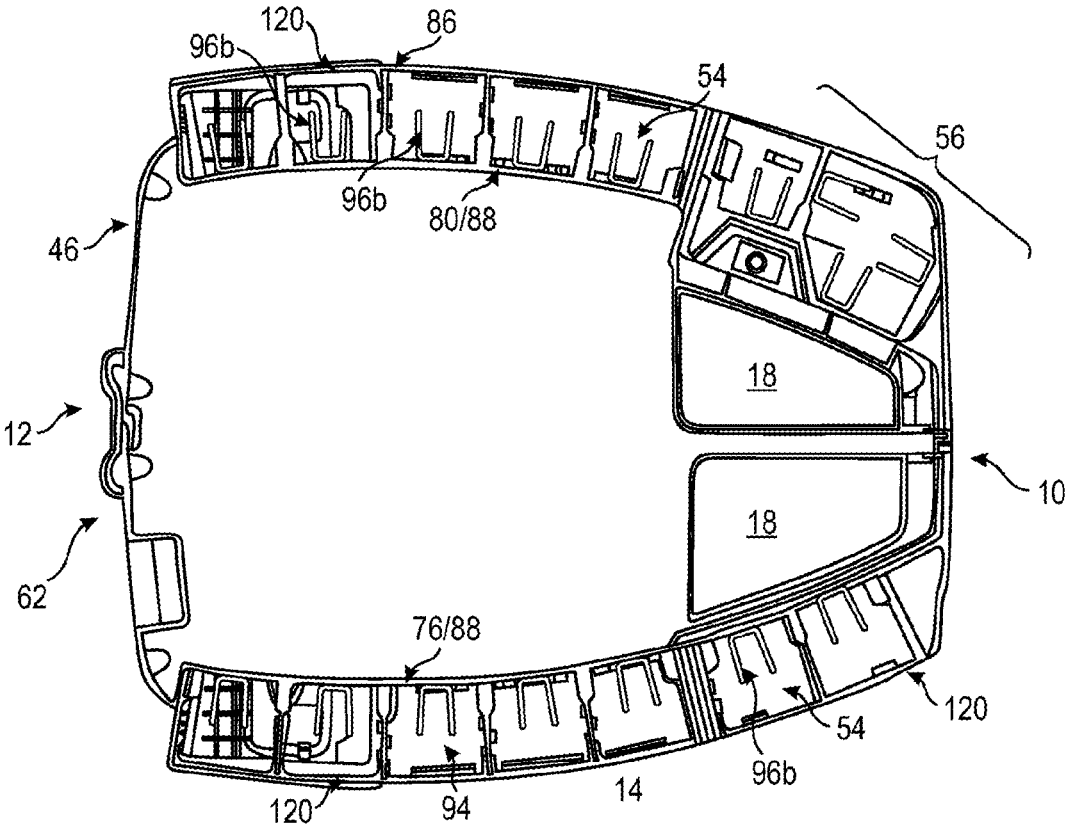

Overall, the shape of the carrier assembly 1 is elongate and substantially trapezoidal (the long sides are slightly curved rather than straight as best seen in FIG. 15). By having when in use a width much less than the height and a depth being wider than a width, this allows for 7 housings on the outside of each slightly curved side (and part of each door) so that up to 14 clubs can be carried on the exterior of the carrier assembly (allowing the interior space to be used for towels and other accessories). Alternatively, the carrier can be substantially rectangular in cross section with sufficiently long sides to accommodate up to 7 clubs per side.

The golf carrier assembly 1 includes a carrier assembly handle 6 for gripping the carrier assembly, to allow movement thereof e.g., lifting, pushing and pulling. The elongate shaped body of golf carrier assembly 1, includes in use a front face 10 facing a player, a rear face 12, a left side 14, a right side 16, a base 18 and a top 20. The carrier assembly handle 6 is formed as a curved elongate member adjacent to a handle aperture 7, being located at a rear upper end of top 20.

At least one strap supporting member 8 is slidably, removably and adjustably attached to the rear of the carrier assembly 1 and is designed to be optionally using in combination with the handle 6.

The distance between the base 18 and top 20 define a height 26 of the golf carrier assembly and the distance between the front side wall 10 and rear side wall 12 defines a depth 30, and the distance between the left side wall 14 and right side wall 16 defines a width 32.

The height 26 is significantly greater than the width 32 and separately to the depth 30. Height 26 is selected to be similar in height or length 34 of an elongate shaped item 2 e.g., typical golf club 2. The depth 30 is similar in dimension to the width 32 but can be somewhat greater to form an almost rectangular or trapezoid cross sectional shape.

The orientation of the height 26 thereby defining a vertical plane 40 and at right angles to that plane, there is a horizontal plane 42.

The elongate shaped body of the golf carrier assembly 1, 56 includes the following interconnected and operatively connected components of: a wall support housing member assembly 46, a floor assembly 48, lid assembly 50, at least one door assembly 52, at least one elongate shaped housing 54 located peripherally of the housing 46 shaped and configured of a volume to house at least one elongate item 2, as part of a portable carrier assembly 56 and/or in the form of a fixed part of the carrier assembly 1. In this example, the housings 54 are provided back-to-back. In the case of the portable carrier assembly 56 though two housings 54 are shown, it envisaged any number of housing 54 can be provided. Other optional accessories can include wheels, a trundler apparatus and a carrier storage system 60.

The wall support housing assembly 46 as seen in FIGS. 15-26, 29 includes an elongate planar shaped body shape in an approximate U shaped cross section and at least one rear support member or back spine member 62 located on outside of a base part of the U shaped cross section.

The wall support housing assembly 46 is a substantially enclosed structure of predominantly a U shaped base cross section as seen from the top, fabricated and formed from shaped planar members forming walls with a thickness bordered by an outer surface 64 an inner surface 66 thereby configured and supporting having an internal storage cavity for receipt and support of at least part of the carrier storage system 60 therein and wherein the outer surface 64 provides a surface and/or a recess 68 for the location of or is part of at least one elongate shaped housing 54 for removably housing and locating at least one removable elongate item 2 e.g., golf club therein.

Housings

Figure 65:
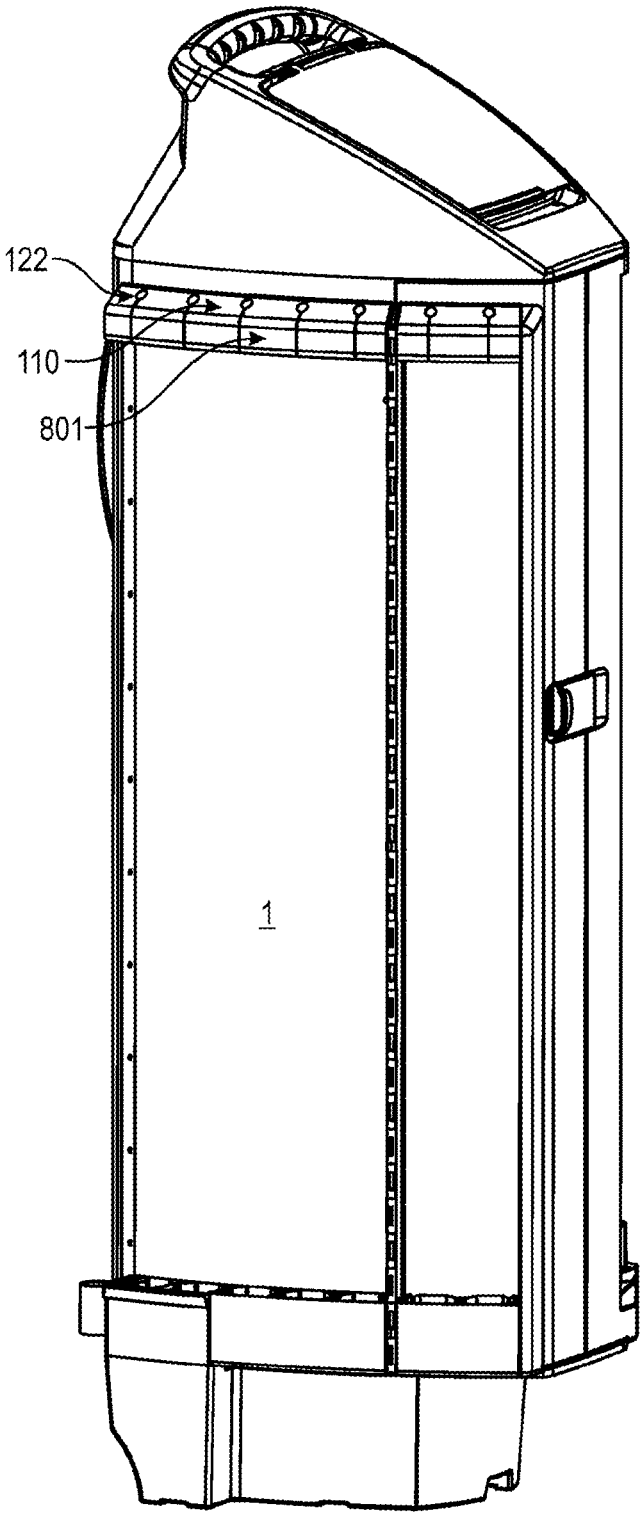

Elongate shaped housing 54 includes an elongate shaped space 94 shaped and configured of a volume to be able to house when in use at least one elongate item 2 therein and is:

- Shaped as part of a separable portable carrier assembly 56 which is designed to be able to be separately attachable or removable from an external recess 68 of outer surface 64 of the wall housing assembly 46 and/or:
- Shaped as a fixed part of the outer surface 64 of the side walls 76, 80 of the wall housing assembly 46 and/or:
- Used in conjunction with separate clip holders 801 (FIG. 65).

The U shape cross section of the housing assembly 46 has a front opening 71 bordered by side edge pillars 71*a*.

The carrier storage system 60 (see FIGS. 6, 8-13, 27-29), is formed into an upper minor compartment system 72 accessed only by the lid assembly 50 and a lower major compartment system 74 accessed only by the door assembly 52. 'Minor' and 'major' represent the relative proportions selected for the size of each compartment 72, 74.

The U-shaped cross section includes a left side wall 76, rear wall 78 and right-side wall 80. As seen in FIG. 15, 15A, 15B, the left and right-side walls 76, 80 include an outer face shaped and adapted to receive and affix at least one elongate shaped item housing 54 e.g., golf club housing thereon and there against. Rear support member or spine 62 is located on the outside surface 64 of the rear wall 78. Rear wall 78 may have at least one trundler bracket recess for the attaching or detaching of the trundler apparatus thereto (though we have found that this is no longer necessary).

The left and right-side portions 76, 80 are shaped to provide at least one outwardly facing recess 68 shaped, sized and configured to removably or non-removably fixedly receive at least one elongate shaped housing 54 for receipt of at least one elongate item 2 (e.g., golf club) therein.

As seen in FIGS. 15, 29, 65, 81-84, 88, 89, the rear support member 62 is an elongate shape member fabricated of a material or combination of materials sufficient to provide strength to the wall housing assembly 46 or carrier assembly 1 and for example can made of lightweight aluminium and extends substantially from the top of the rear wall 78 to the bottom. The U-shape of the housing assembly 46 can be made from two haves to make the U shape, having an edge join internally with the rear support member 62 being joined or connected externally of the wall housing assembly 46 covering the join between the two halves.

Rear support member 62 has a cross section of a planar based member with a central elongate base portion for fixing to the rear wall 78 of wall housing 46 and rounded outwardly protruding edges/curled lip which is shaped and configured top allow removable fixing of accessories such as for example a trundler or wheel assemblies.

At least one strap supporting member 8 is slidably, removably and adjustably attached to at least one rear support member 62 to provide for holding there around or in providing a pair of spaced slotted apertures for sliding receipt of part of a carry strap there through to allow when in use a user to hold by and/arm/shoulder by itself or in combination with holding the handle 6 to lift or move the carrier assembly 1. Strap supporting member 8 can include an elongate shaped body having upper and lower ends including a planar base 63*a* and end slotted (two parallel elongate different sized horizontal slots 63*b*) horizontally oriented apertures protruding outwardly therefrom. The sides of the planar member are shaped to provide side edges 63*c* with clipping lip 63*d* to allow the strap supporting member 8 to be removably hand clicked and clipped around the outer side edges of the rear support member 62 to grab or clamp to the post 62. The planar body also includes a vertical aperture 63*e* of T shaped forming side posts 63*f* with one post providing mounting means as landings 63*g* protruding sideways within the aperture 63*e* for clipping to a strap. Side posts 63*f* can be formed as outwardly curved elongate members. One could also call the strap supporting member 8, a bracket like member.

As shown in the figures (e.g., FIGS. 1-5, 7, -9, 11-26, 29, 30-33, 53-60) each elongate shaped item housing 54 includes an elongate planar substantially space 94 shaped to allow at least one elongate item 2 to be removably housed and located therein. In this example, the elongate shaped housing 54 is shaped as an elongate planar substantially rectangular cuboid or prism shaped member (e.g., long and thin) forming an enclosed elongate planar space located outwardly of outer surface 64 of left & right outer side walls 76, 80 of the wall support housing member 46.

The elongate planar rectangular space 94 is formed including a front outer planar wall 86 separated from a rear inner planar wall 88. The inner planar wall 88 can formed as a separate wall to left & right outer side walls 76, 80 of wall support housing member 46, or it can be formed as the same wall—i.e., can be dual purpose.

The enclosed elongate rectangular planar space 94 is subdivided by elongate end side walls 92 extending top to bottom and is subdivided laterally into at least one club habitat or elongate shaped elongate shaped housing 54, whereby each elongate shaped housing 54 is shaped and configured to house at least one elongate item 2 such as for example a golf club 2 therein with one elongate item/golf club head 144 protruding upwardly there from, in a line of single housed parallel oriented clubs.

Each elongate shaped space 94 as well as being shaped to hold at least one elongate member 2 therein, it must also be of a shape and sized to be able to include at least one, removable mounted anti-rotation member 96 as seen in FIGS. 14-26 as located on side wall 92 or any other suitable wall e.g., 76, 80, 88 wherever required to removably hold at least a portion of an elongate item 2 or elongate shaped member which can be or not, be a part of another object or item e.g., golf club, tennis rack etc. At least one anti-rotation member 96 can be removably located, mounted or affixed wherever necessary including in this example close to or abutting the bottom/base or floor 108 of the enclosed space 94 of each housing 54. Anti-rotation members 96 can be mounted in any spacing vertical and/or horizontal or angle in any position or abutting, of any of the walls 92, 76, 80 and 88 as required or as necessary.

In yet other examples there can be adjacent anti-rotation members 96, single or double facing anti-rotation members 96, or several spaced or not upwardly from each other on a or each side wall 92.

In the latest preferred option, the anti-rotation members 96 can be located in suitable clip holders 801 (see FIGS. 65 and 66) having the roof portion 110 and the circular apertures 122, the base of he clip holders being open to allow the clip holder to function as the top of each housing.

Figure 14:
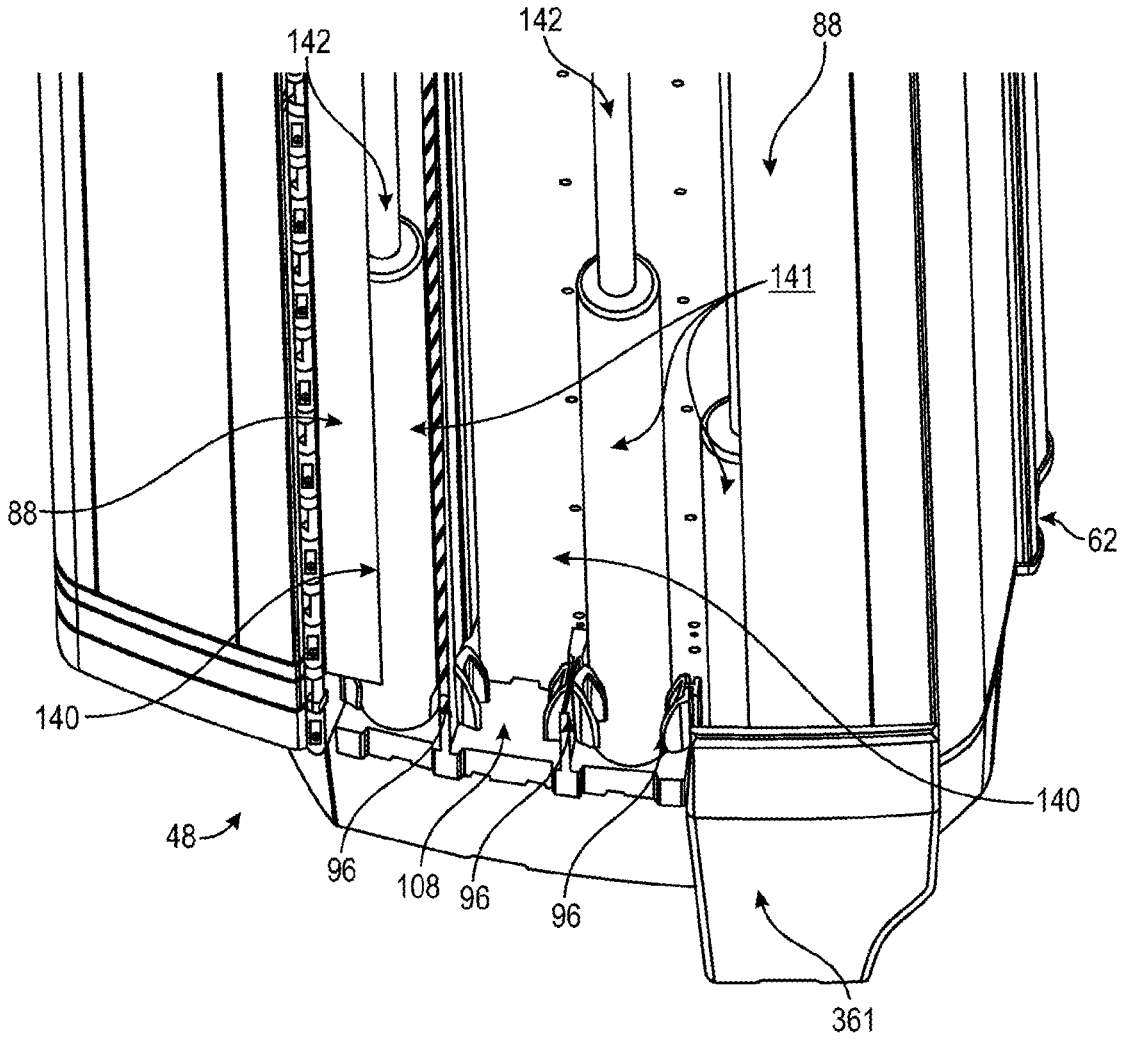
Figure 27:
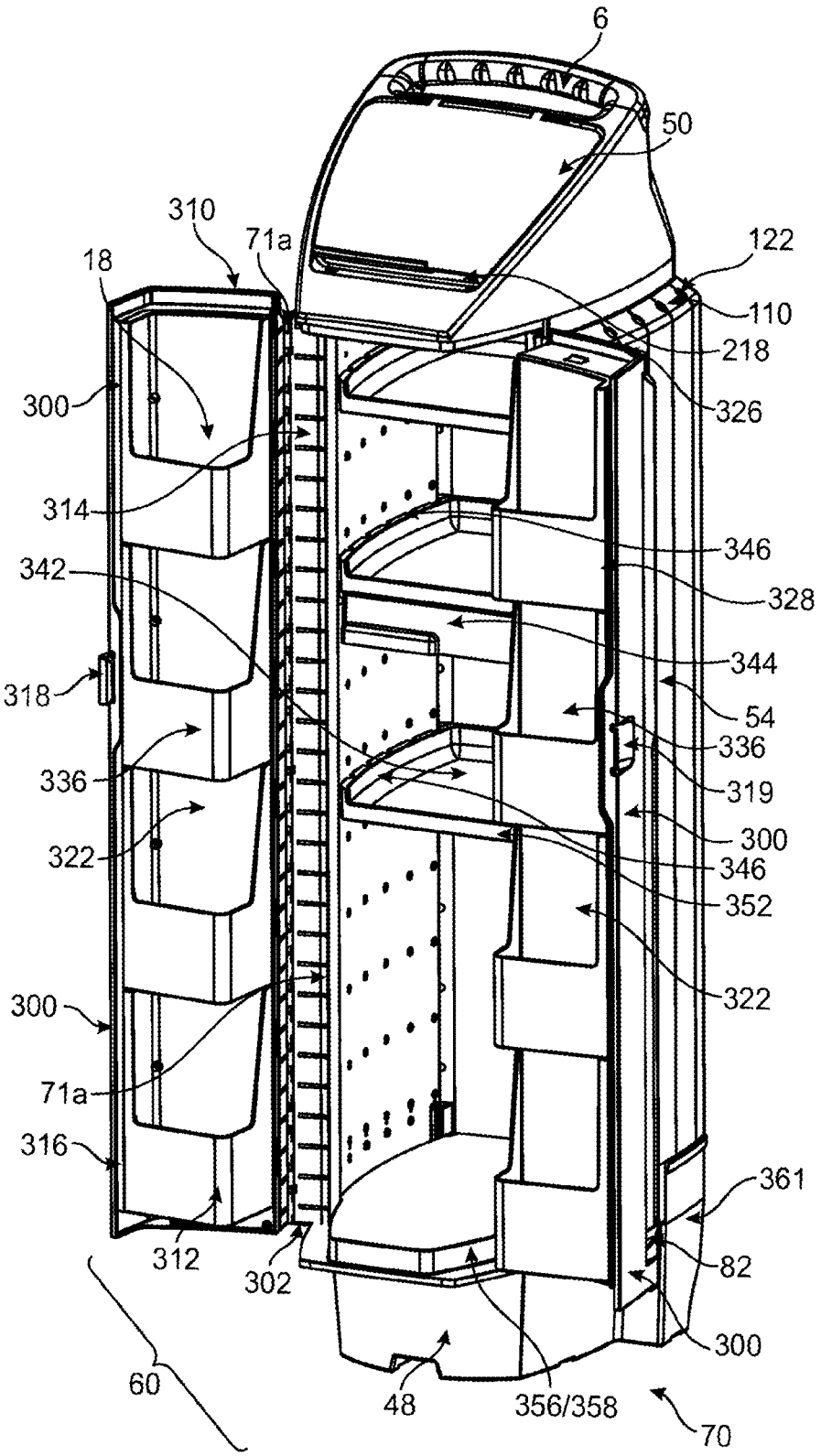

In this example, as seen FIGS. 14 and 27, there are seven elongate shaped housings 54 or seven elongate shaped spaces 94 on at least one side of the left right side portions 76, 80 of the wall support housing member 46, each having at least one anti-rotation member 96, to separately house fourteen elongate items 2 e.g., golf clubs, located at or near to the floor 108 of the elongate shaped housing 54.

The depth or height of the rear two golf elongate item housing 54 can formed of a greater dimensions to house longer elongate items 2 or clubs which means the elongate shaped item elongate shaped item housing 54 extends into the floor assembly 48 housing and end in a recessed end floor lattice floor panel 98 (e.g., provides a base and useful for drainage of moisture from stored elongate items 2 (e.g., club) or acts as floor vent) and so anti-rotation members 96 can optionally be required here.

By way of example the housing for golf clubs are 716 mm high (shorter than the shortest club) and on average 40 mm deep and 40 mm wide, though some need to be wider or narrower than others depending upon the club size (and its handle diameter). Club and putter lengths vary but are typically between 890 mm and 1145 mm in length.

The elongate planar space 94 is formed as a rectangular polygon shaped space whereby rear wall 88, front wall 86 and side end walls 92 are connected to a floor 108 and a roof 110. There is a height 112 between the floor 108 and roof 110, a width 114 between the side end walls 92 and a depth 116 between the rear 88 and front 86 panels. These dimensions can vary depending upon the nature of the elongate items, though it is preferable that the height is just short of the length of each item so that only a portion of the item (i.e. a golf club) protrudes form the top so that it can be easily identified and grabbed to remove it from the housing. The trapezoidal carrier has a rear face of about 280 mm in width, a front face of about 200 mm in width and sloping sides of about 320 mm from rear to front (including part of the L-shaped door when closed) as this allows sufficient for seven housings (two of which are mounted on part of the door).

The end side walls 92 and the rear inner planar wall 88/left & right outer side walls 76, 80 with the floor 108 and roof 110 are formed in the shape of an end oriented elongate rectangular tubular member having an outer edge, with the front outer planar wall 86 being separately attached to that outer edge and continuously including the roof 110. The end side walls 92, rear inner planar side wall 88, 76, 80, and floor 108 are formed of plastics while the front wall 86 and roof 110 of the carrier assembly 1 or portable carrier 56, is formed of either one piece and/or of multiple strips of flexible deformable material e.g., injection moulded polyurethane like a rubber material.

Any material for front wall 86 and roof 110 that is functionally able to allow bending, flexing or a parting to allow entry or removal of an object e.g., elongate item, is possible such as for example rubber or a composite plastics and/or rubber material. After entry or removal of the item 2, the material of front wall 86 needs to be able to return to its original relaxed but closed position i.e., for the slit 120 in the front wall 86 and roof 110. This material is preferably soft enough to allow easy insertion and removal of the clubs but still stiff enough to comfortably hold each club in place and provide weather protection for the handle of a club. Note that most clubs have handles of similar width but putters generally have larger diameter handles so some variation in housing size or slit width may be needed to accommodate different clubs or putters.

Furthermore, the material of the front wall 86 and roof 110 with opening 122 still be of a material that also allows the enclosed item 2 to be retained within the space of housing 54 to not fall out very easily or at all. This material of front wall and roof 110 should also have some degree of water resistance and be able to close the slit 120 to also not allow too much entry of moisture there through to any enclosed areas e.g., 54 or pockets and shelves, will have drainage slots or holes.

In use, the rectangular polygon shaped space is oriented with its floor 108 located on the base of the recess 68 and/or on top of the floor assembly 48 to be captured within the recess 68 but also to provide an outwardly protruding portion therefrom i.e., the roof 110 and front wall panel 86 are protruding therefrom to allow the golf club head(s) to upwardly protruding there from. As shown in FIGS. 1-5, 7-9, 11-15, 29, 53-60, the roof 110 and front wall panels 86 are formed of a flexible resilient material of a certain thickness and have at least one elongate continuous elongate slit shaped opening 120 extending vertically from but not in the floor 108 extending up to the front wall panel 86 to and including through the roof 110. The elongate slit shaped opening 120 in the roof 110 also widens suddenly into a widened area e.g., circular aperture 122.

The elongate slit shaped opening 120 includes a cut extending completely through the thickness of the front wall panel 86 and roof 110, forming cut sides 124 on each side of the cut whereby a closed configuration is defined as where the cut sides 124 almost meet and an open configuration is where a portion of the sides are spaced from each other.

As seen in FIG. 15, the arrangement of the rear and front walls 88, 86 and side end walls 92 subdividing the elongate shaped spaces 94 in a line, can include in this example of interfitting, a tongue and groove interlocking inter-fitting relationship whereby in this example the side end wall 92 includes an elongate strip like member having longitudinal edges comprising a tongue edge 126 and in one option can be formed as an opposing complementary slotted edge 128 which each edge inter-fit with a complementary slotted portion within the rectangular polygon shaped space, and opposite a protruding portion. Alternatively, as seen in the figures side end walls 92*c* can be formed as a part of rear wall 88/76/80.

Anti-rotation members 96 as seen in FIGS. 15-26 comprise a channel shaped member (with trimmed angled top corners) having a truncated V shaped cross section or U-shaped cross section of any suitable length, thereby having base 136 and splayed arms 138 extending from each end thereof and holding space or recess 137 between the arms 138 and adjacent anti-rotation member 96. In use base 136 is attached or connected to at least one side of the side end wall 92 to cause the arms 138 to protrude or splay more outwardly within the elongate shaped space 94 for each elongate item 2 e.g., club. In this example, there can be anti-rotation members 96 positioned at or near the base and optionally midway of the height.

These anti rotation members 96 can hold one end 140 of the elongate item/club i.e., the club grip/handle 141 in recess 137 and the other end (head 144) in circular slot 122 to reduce or prevent rattling, keep them still to enable easier identification for selection. The bases 136 have the arms 138 as prongs made of a flexible resilient material (e.g., rubber) such that the arms can resiliently spread to accommodate the elongate item/club grips 141 there in or there between in recess 137, to then hold the elongate item secure in the same orientation the elongate item 2 was originally inserted e.g., facing a certain direction like outwardly. Once the elongate item 2 e.g., club is removed from the anti-rotation members 96 the arms spring back to their original at rest shape. There can also be different sized members 96 to suit different elongate items 2. As seen in FIGS. 14-26 anti-rotation members can be formed as single members with T base 136*a* (FIGS. 22-24) or be double backed as in FIGS. 14-26, having a bridge 136*b*. The base of any anti-rotation member 96 can be attached to side wall 92 and/or even to the rear/side wall 76, 80, 88, by sliding on, clipping on and/or by suitable fasteners e.g., screws, bolts or rivet with or with adhesive. Anti-rotation members 96 which can be double faced members 96, which can be slid down the wall 92 for insertion/removal or replacement therein-see FIG. 15, 15A, 15B. Access for adding, removing or replacing anti-rotation members 96 can be done by accessing space 94 of the housing 54 via a removable bottom plate/floor 108 and unscrewing and sliding them off/on and reattaching.

Figure 52:
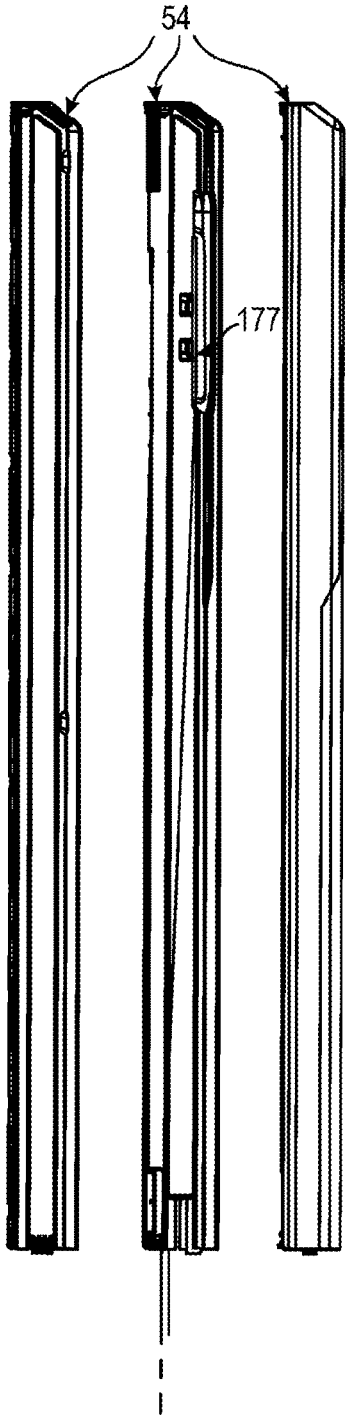
Figure 52A:
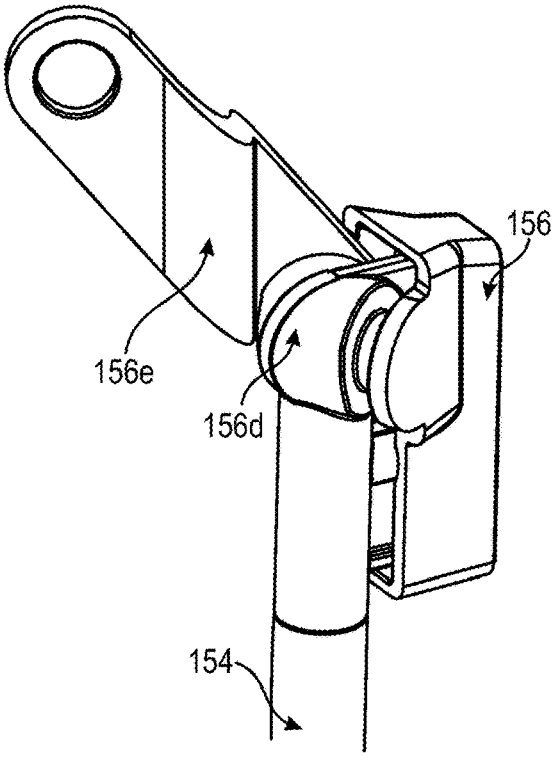
Figure 52B:
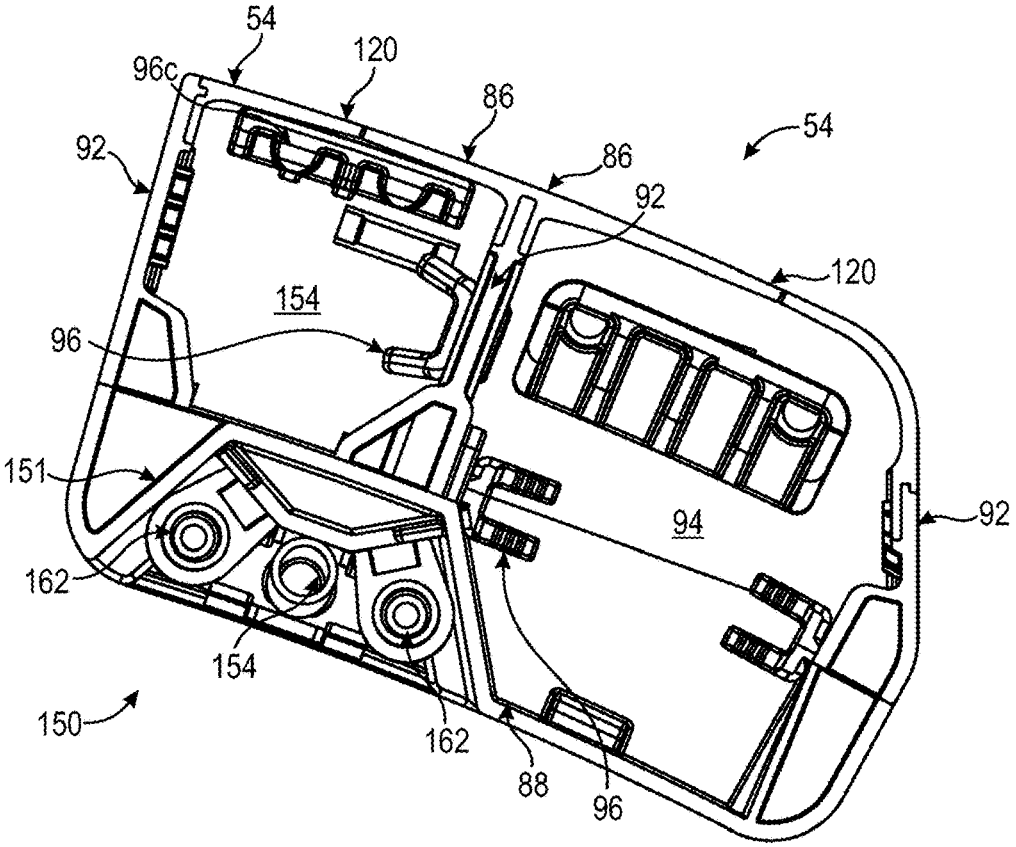
Figure 53:
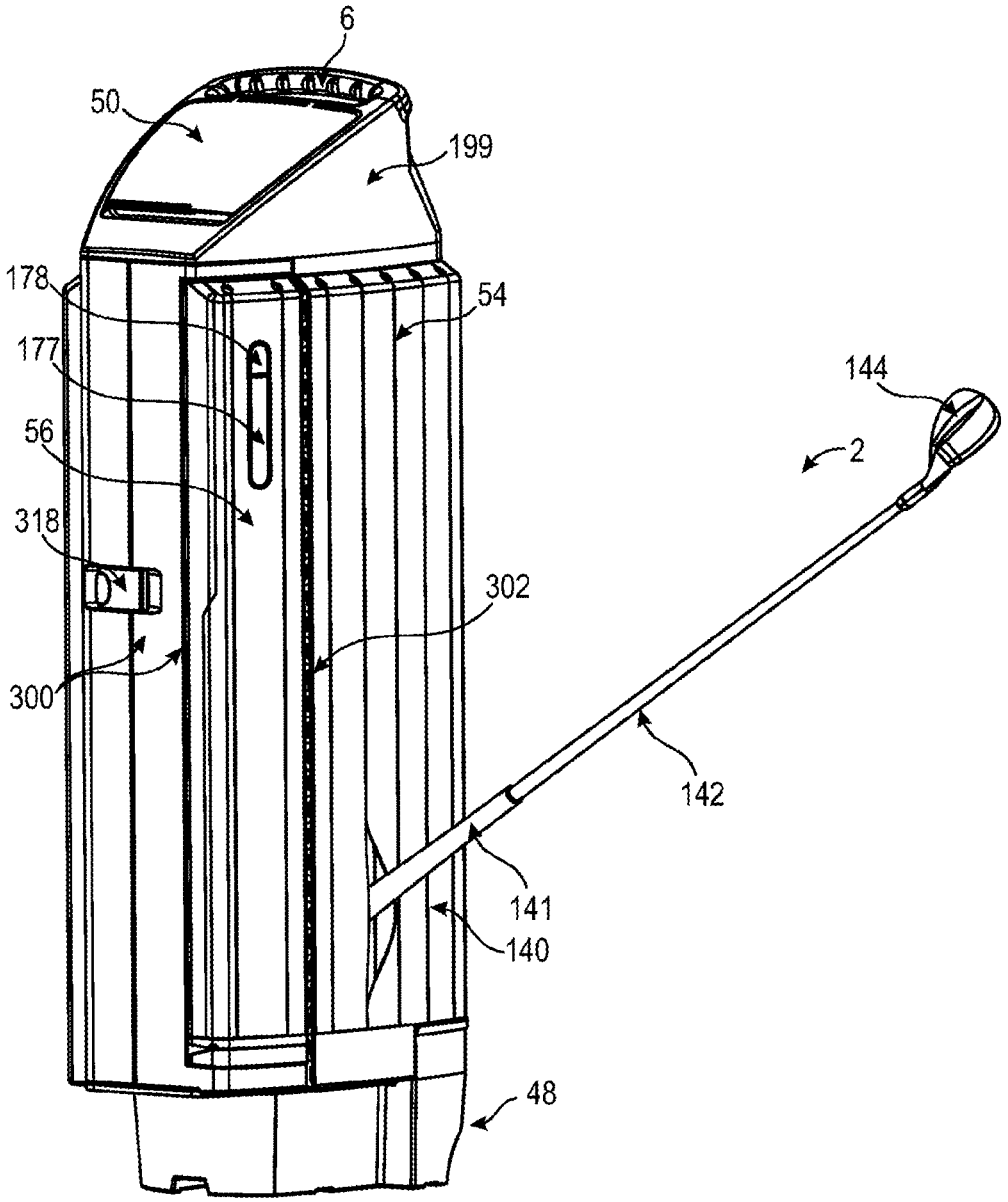
Figure 54:
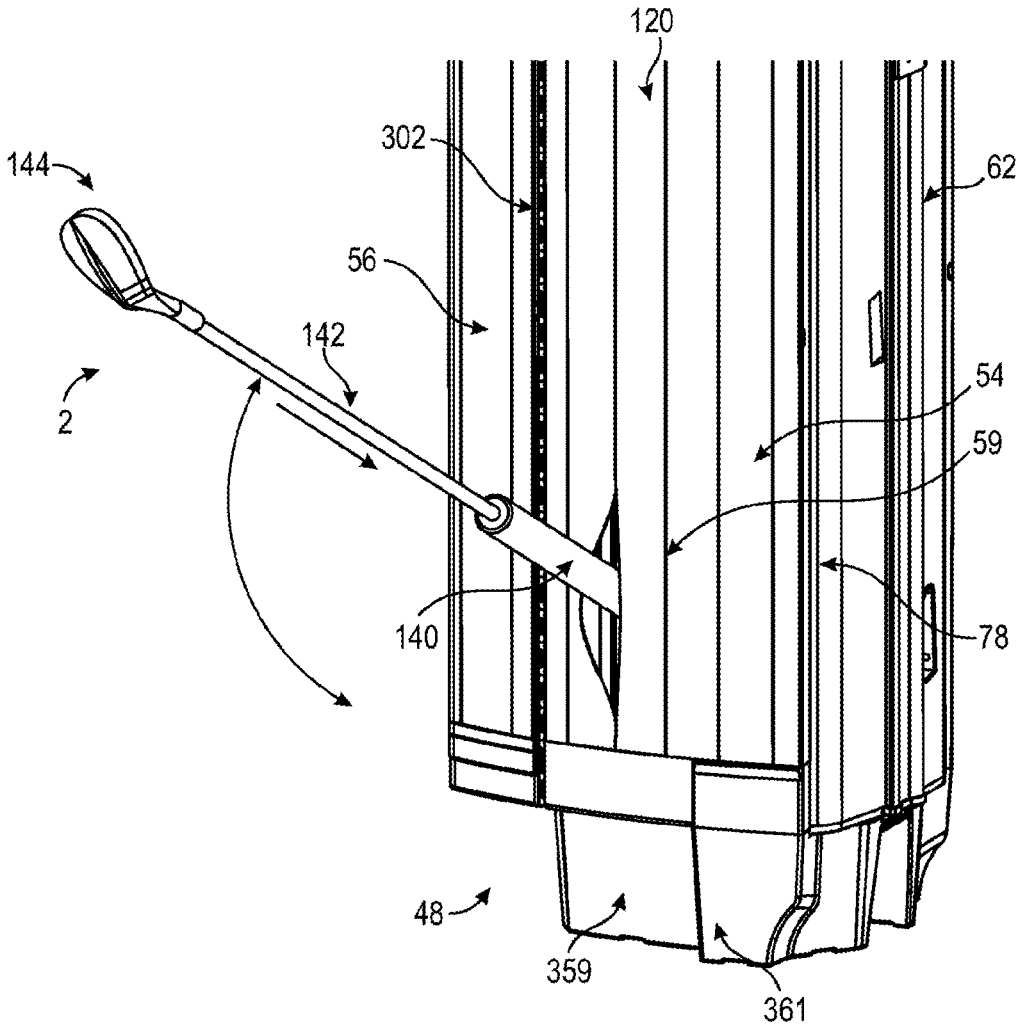
Figure 55:
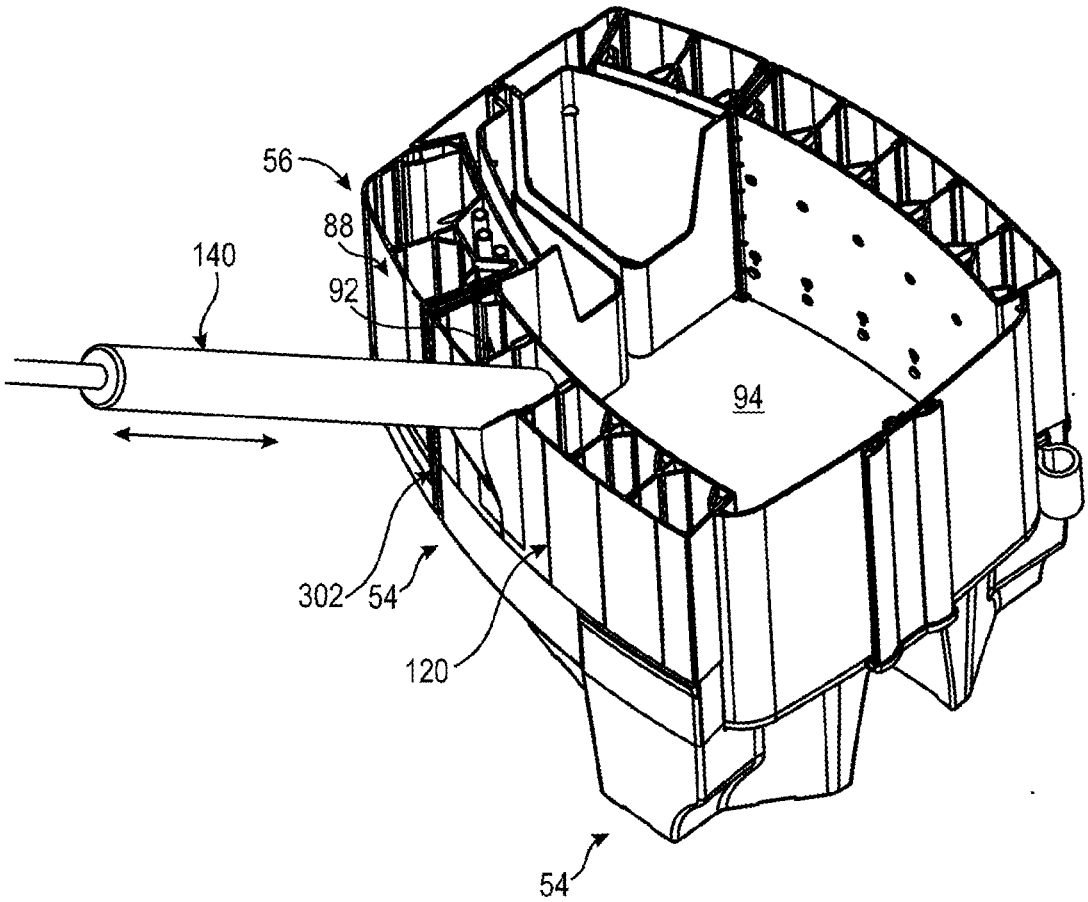
Figure 56:
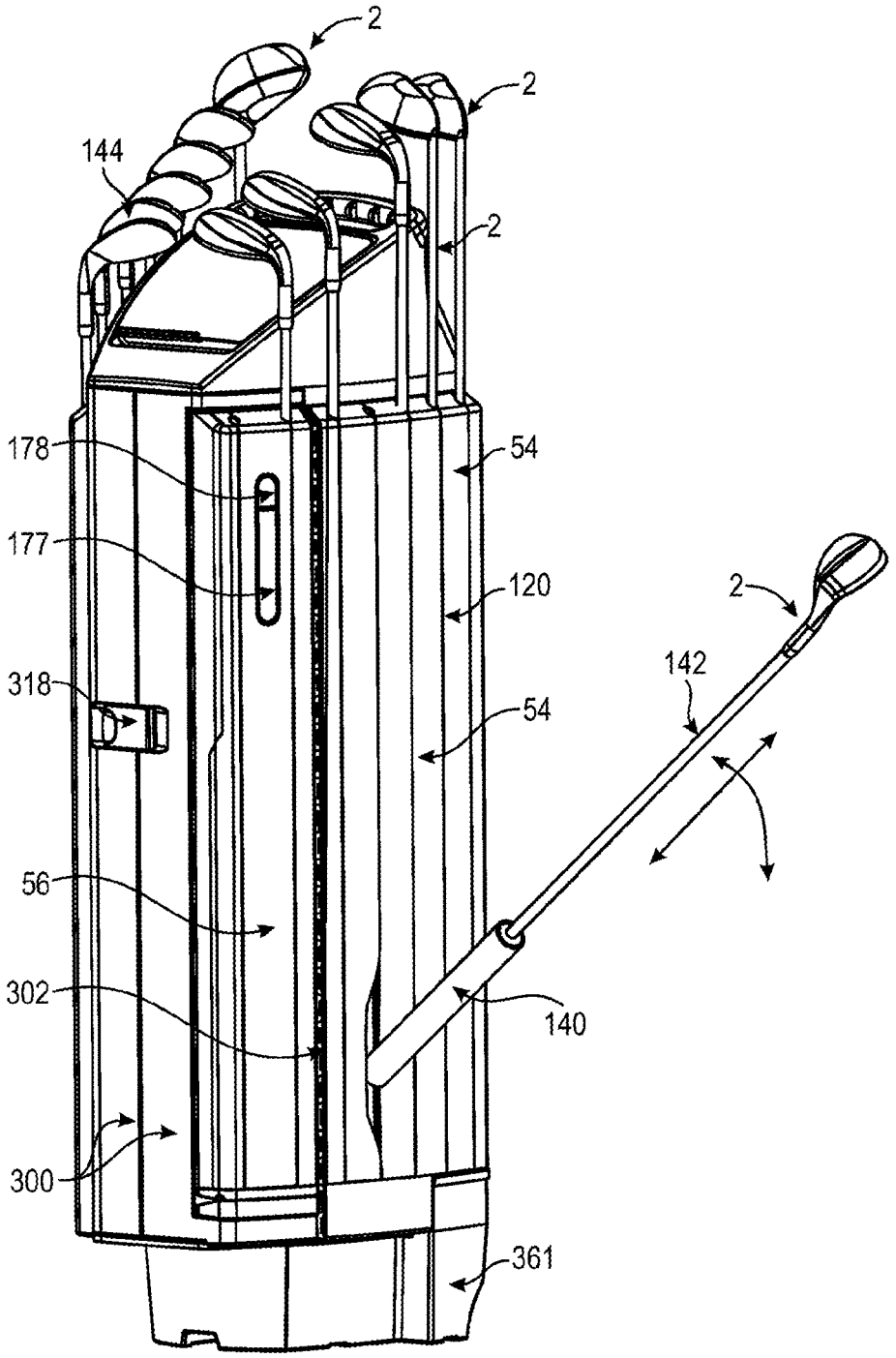
Figure 57:
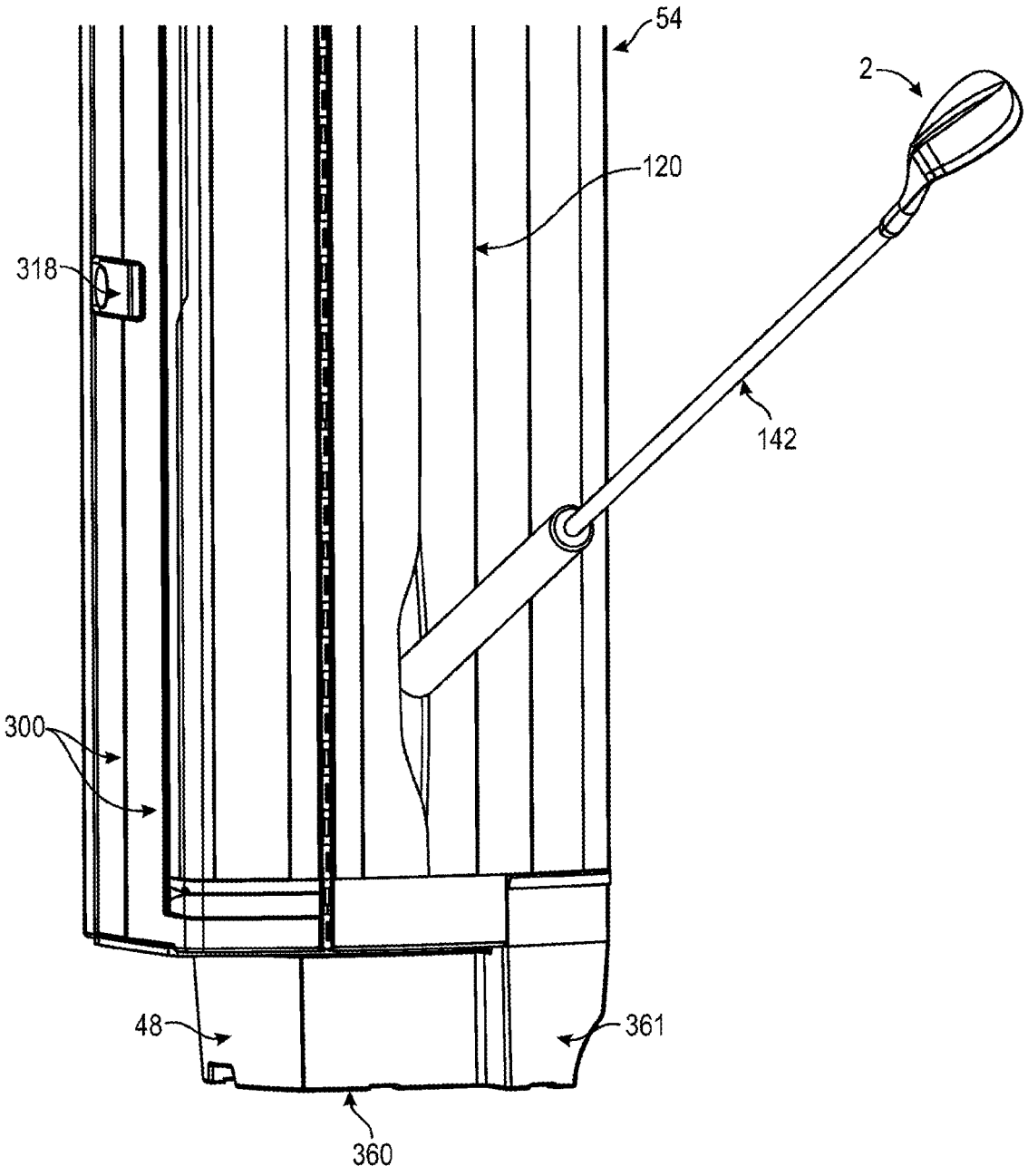
Figure 58:
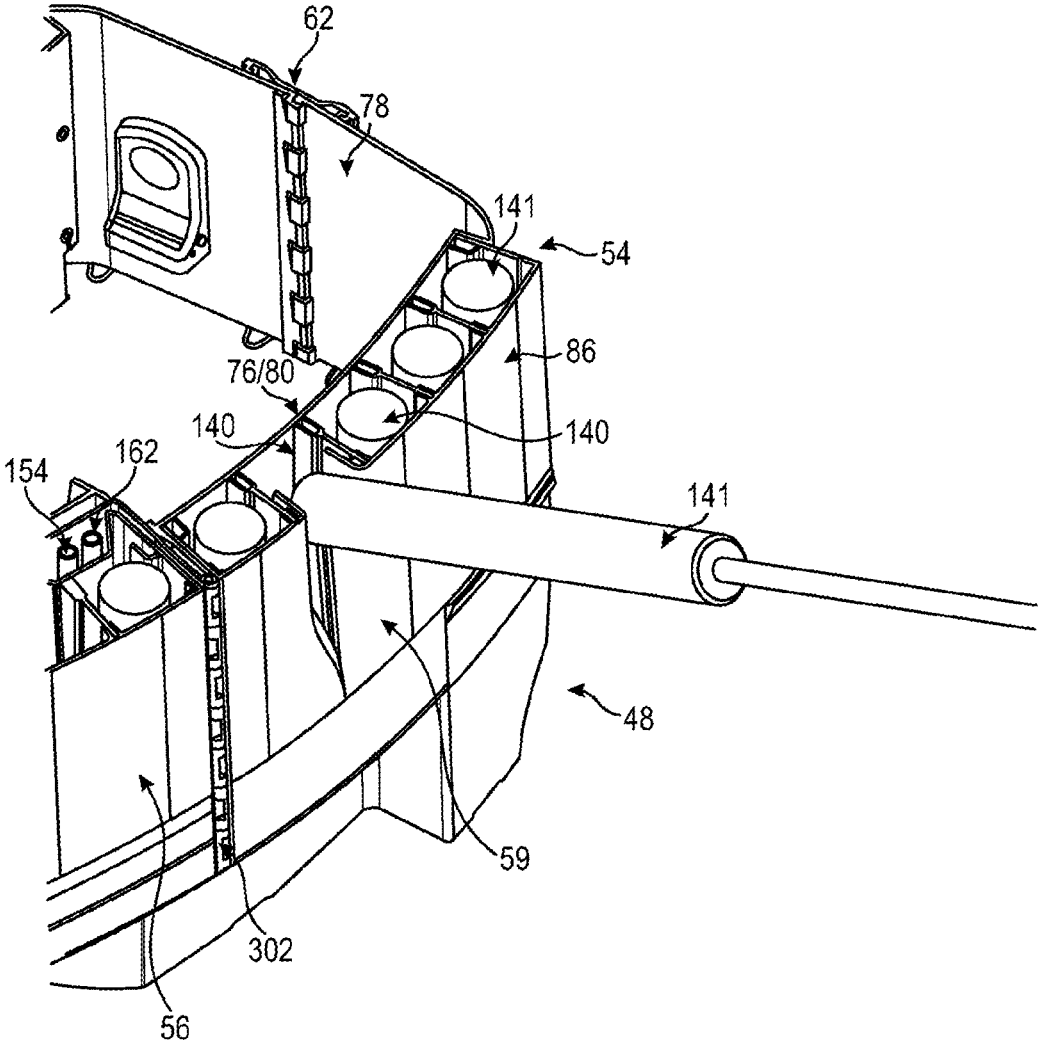
Figure 59:
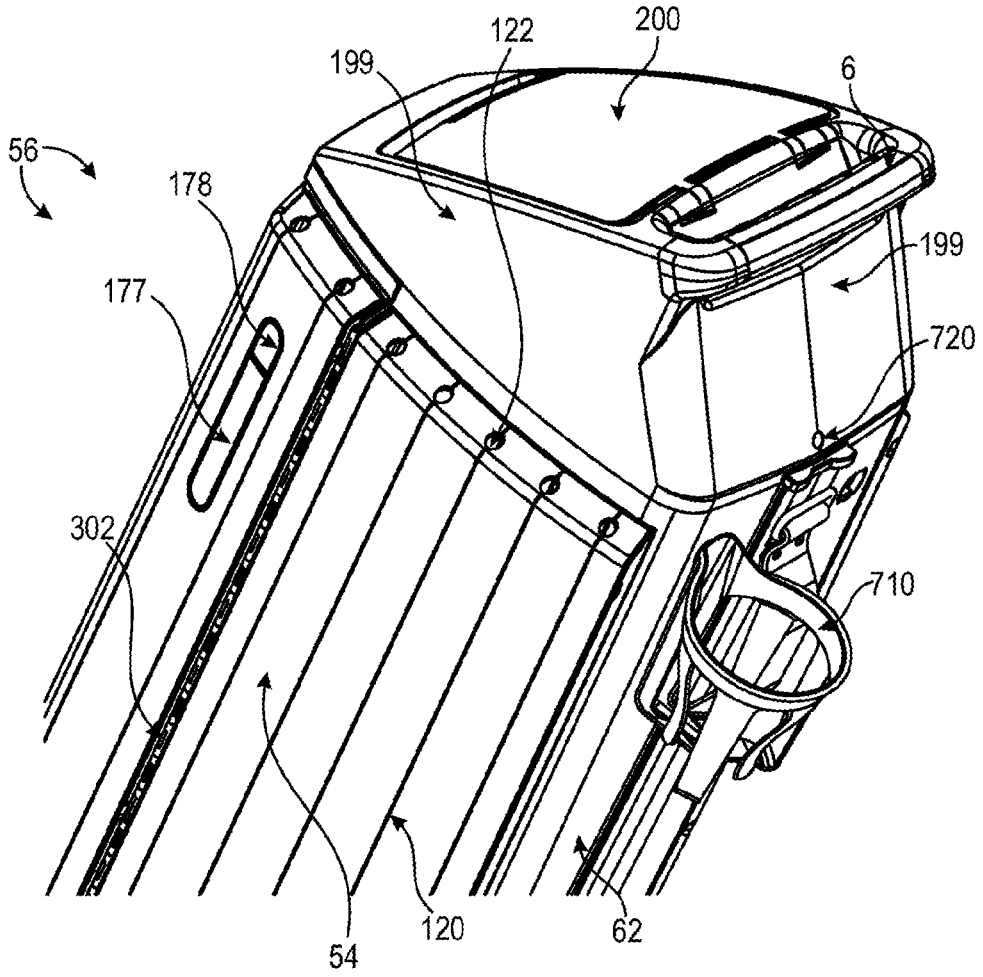

In each space 94 of housing 54 there are at least one anti-rotation member 96, 96*b*, 96*c* (e.g., FIG. 15-26, 52*b*) and in other housings 54 (e.g., FIG. 15-26, 52*b*) at least two anti-rotation members 96 adjacent each other at a certain distance to allow a part or portion of one elongate item 2 (e.g., club) to be inserted there between whereby the arms 138 are formed and configured of a material to allow the flexing without deforming to accommodate the elongate item 2 (e.g., club) to hold it therein and there between, where upon removal of the elongate item allows the arms 138 to return to their relaxed splayed configuration. The portion of the elongate item to be held in the entrance space between the arms 138 but not necessarily needing to be completely captured within all of the space 137. When a lower end of the elongate item 2 is being removably held by the at least one anti-rotation member 96, the upper end of the item 2 is also removably and loosely held within the opening 122 at the top of the slit 122. As seen in FIG. 52*b* one of the anti-rotation members can be item 96 and the other anti-rotation member is similar but its arms 138 are splayed at a different angle e.g., wider with one arm 138 being longer than the other. Furthermore, there can be another anti rotation member which just consists of an angled L shaped member with its arm being angled outwardly into space 94 and its base being longer than the other bases of the other anti-rotation members. One can also see one suggested example of how the walls 92, 88, 86 can be arranged and connected with slotted joining and end strengthening apertures e.g., in walls 92.

As shown in FIGS. 15-26*d*—there is an anti-rotation member for use mid-way in the wall 92 between housings 54 which includes base 39 or 136 and central rib 136*a* between back-to-back splayed walls 138 whereby the base 136 and rib 136*a* form an H shape in cross section. There is also an anti-rotation member for use at one end of wall 92 at an end of housing 54 which includes base 39 or 136 and central rib 136*a* forming an H shaped in cross section wherein a portion of the H shaped forms a T shape outwardly protruding beyond base 136. Furthermore there is an anti-rotation member 96 for use at one end of wall 92 at an end of housing 54 which includes base 39 or 136 and central rib 136*b* forming an H shaped in cross section wherein a portion of the H shaped forms a T shape outwardly protruding beyond base 136*c* and the T has a head portion which extends in length beyond the ends of the base 136 and splayed walls 138. The arms 138 as seen in FIGS. 16-26 are of equal extent beyond the base 136, 136*a* whereby as seen in FIGS. 15, 52*b* the arms 138 are of unequal extent beyond the base 136*c*.

Figure 28:
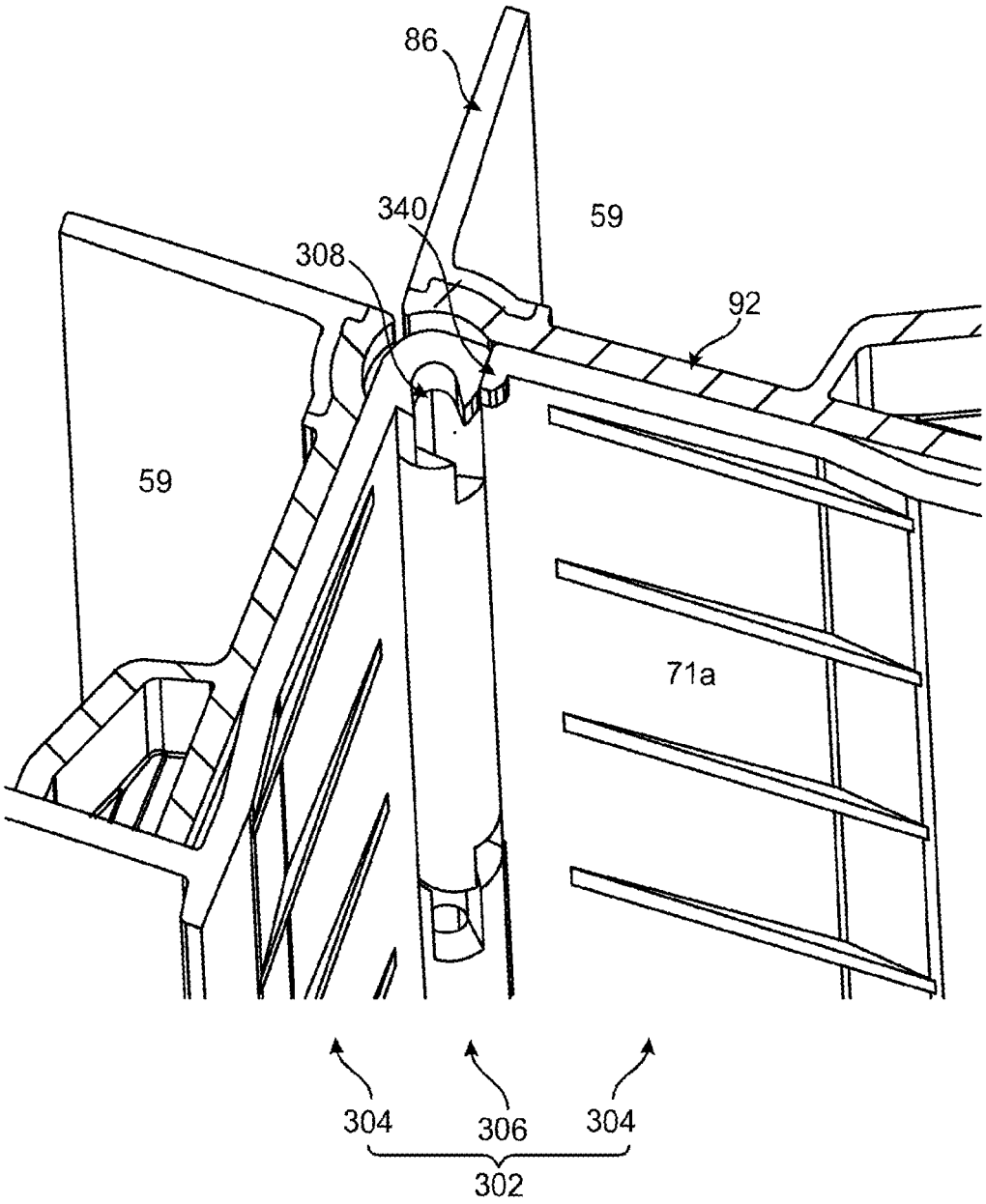
Figure 29:
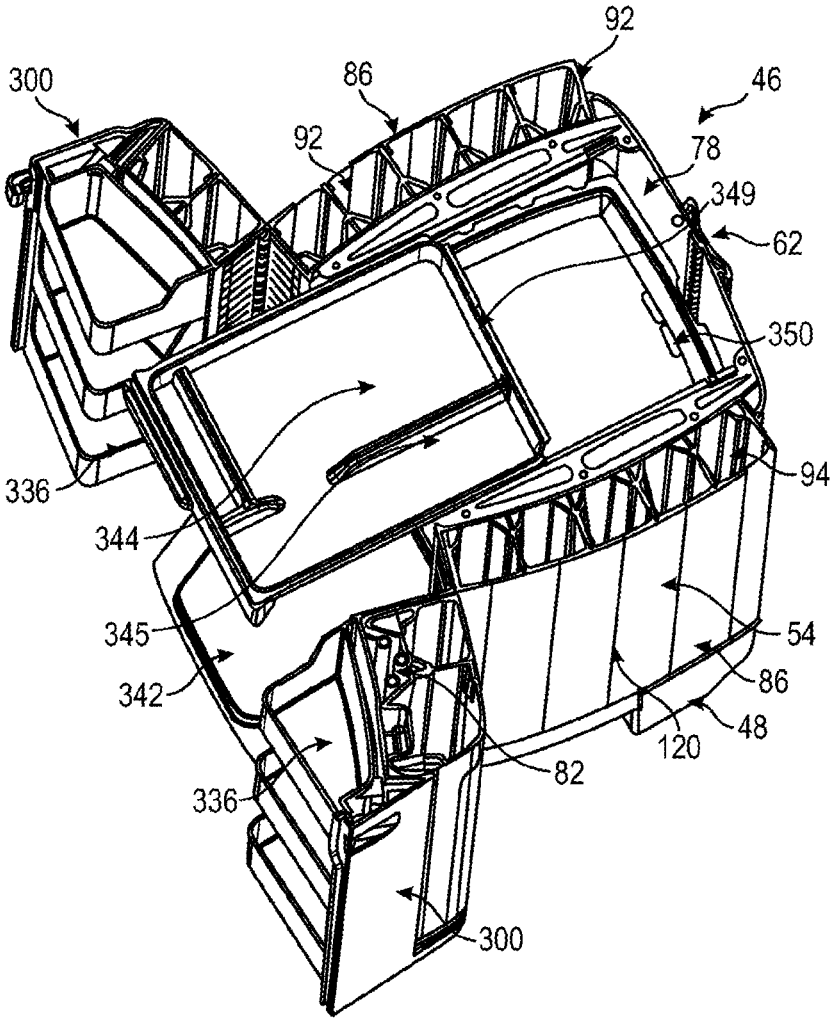
Figure 30:
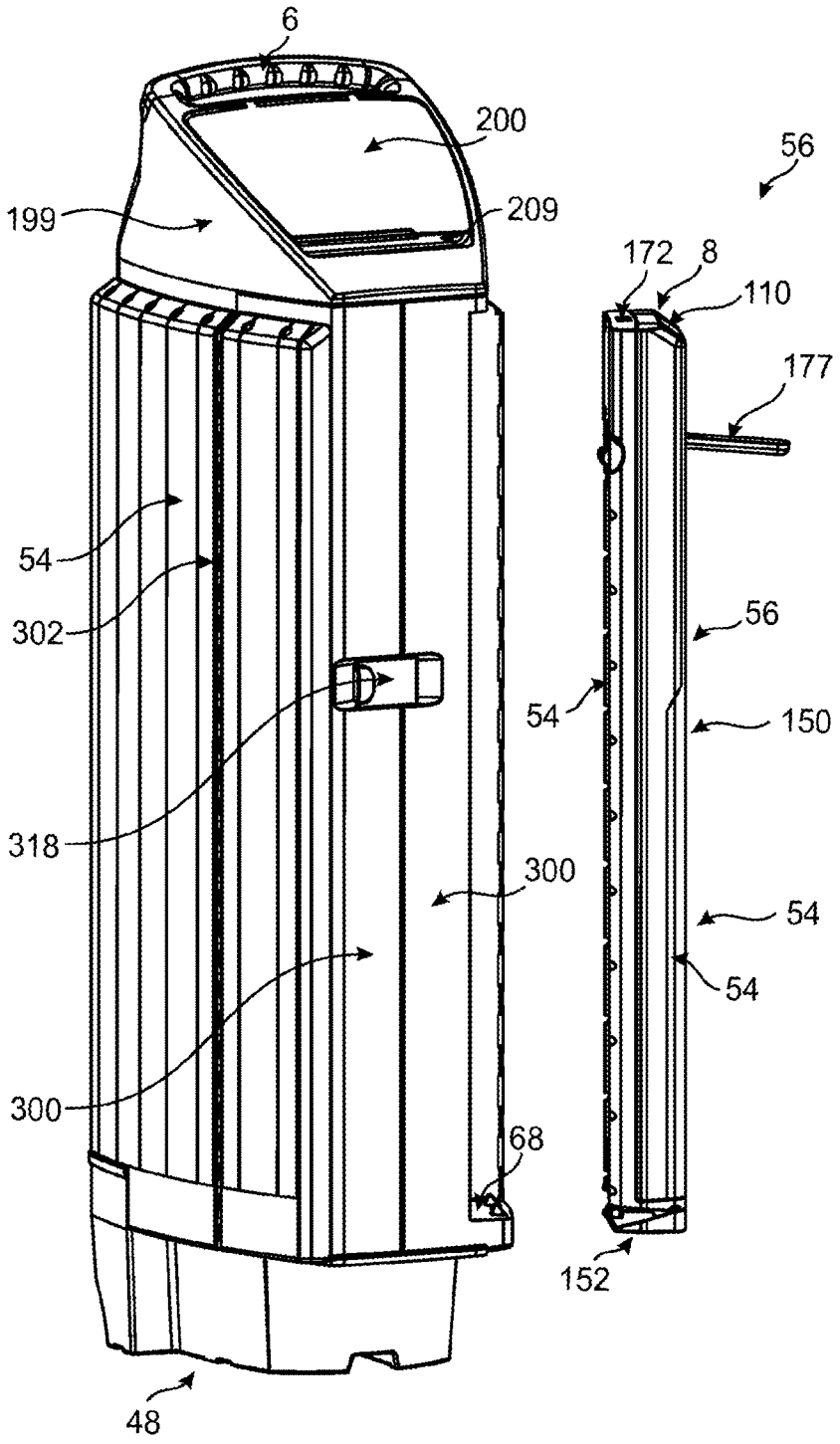
Figure 31:
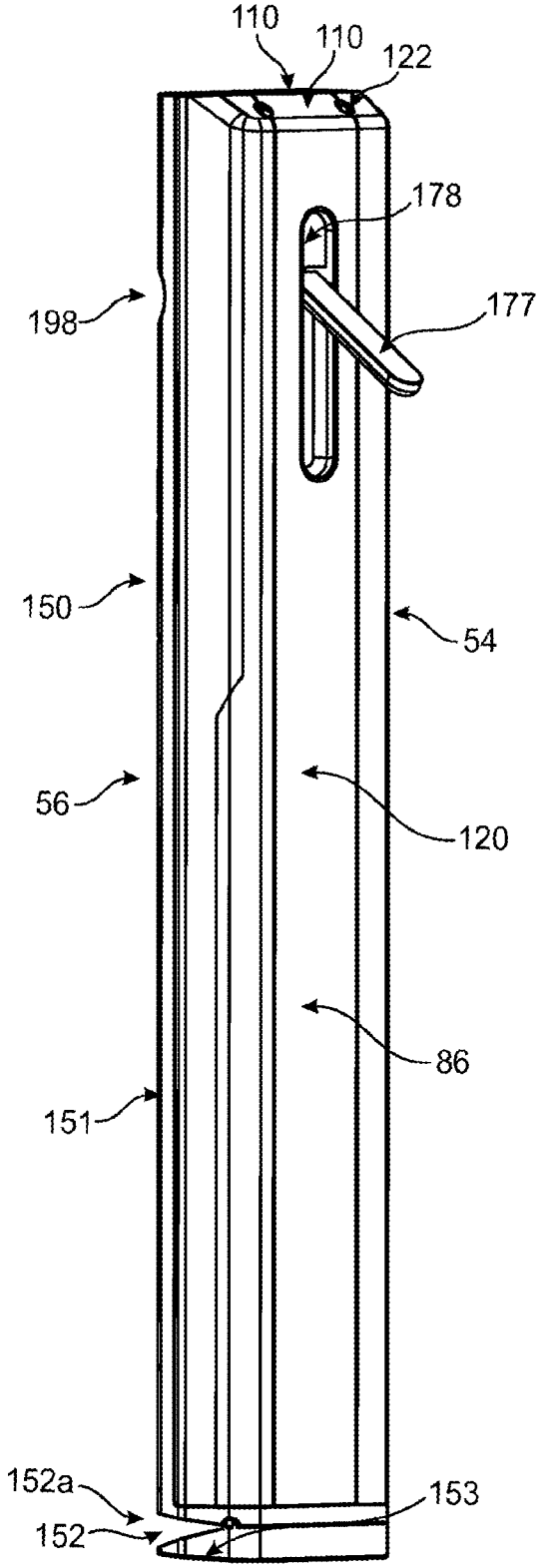
Figure 32:
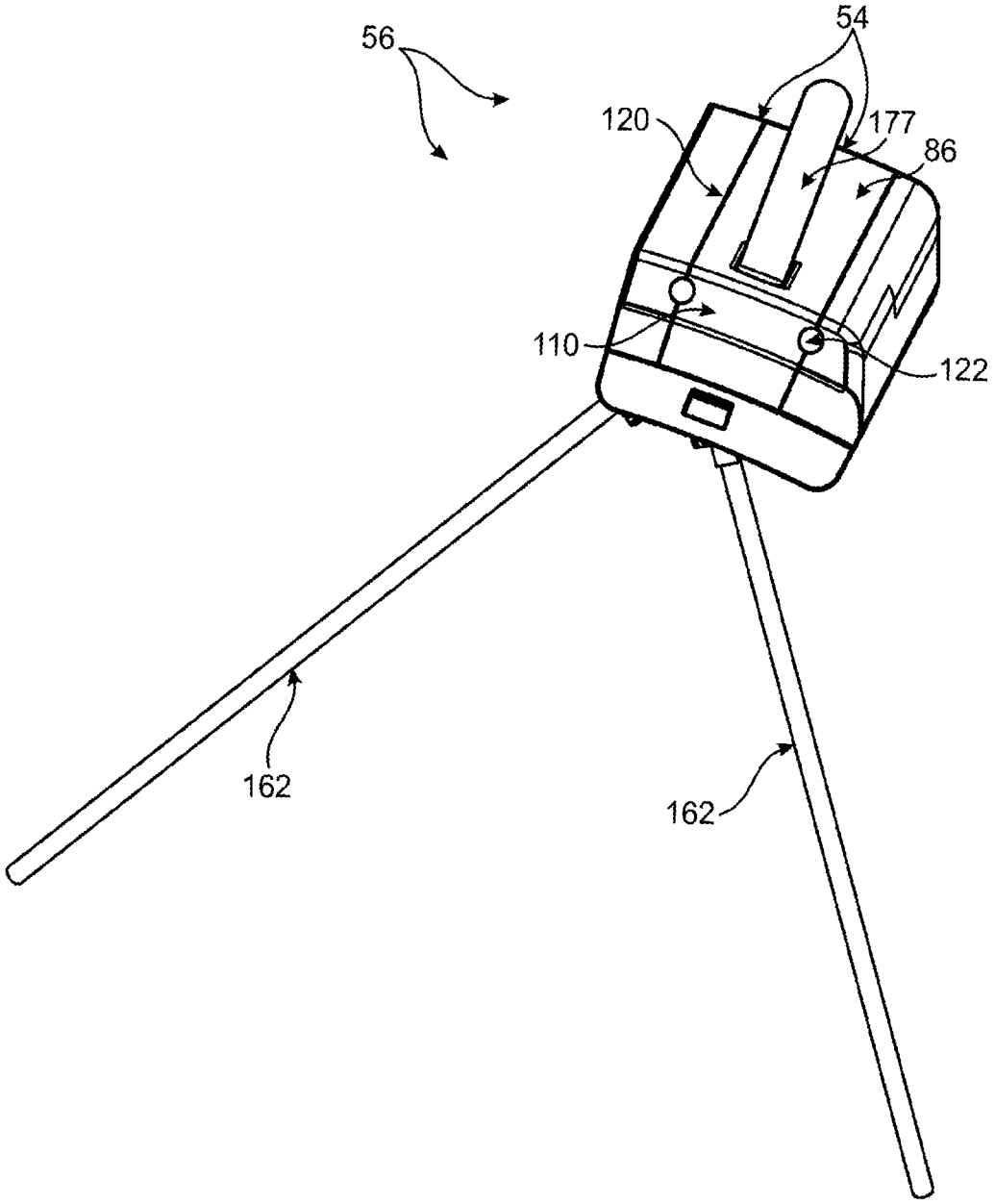
Figure 33:
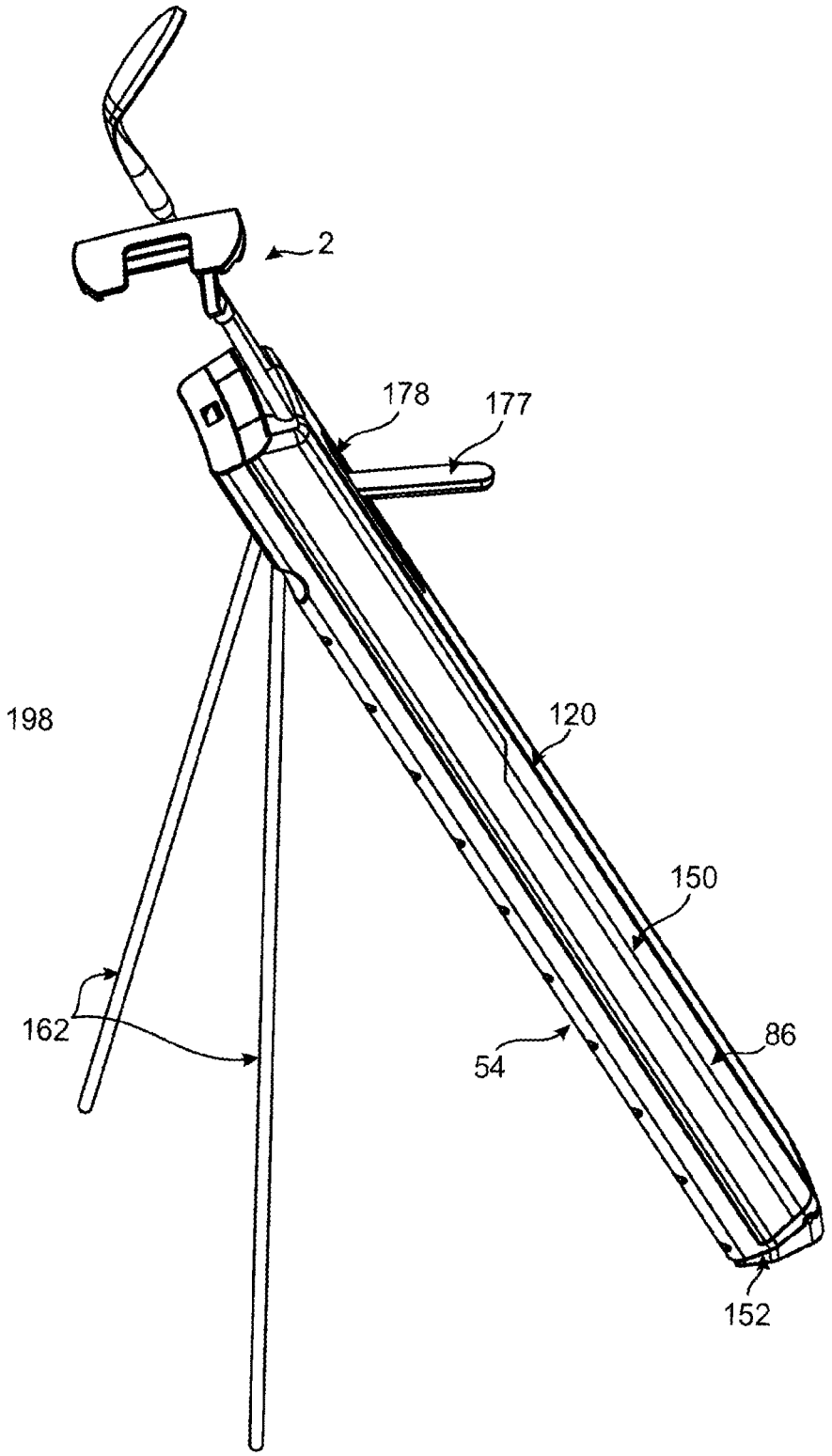
Figure 33A:
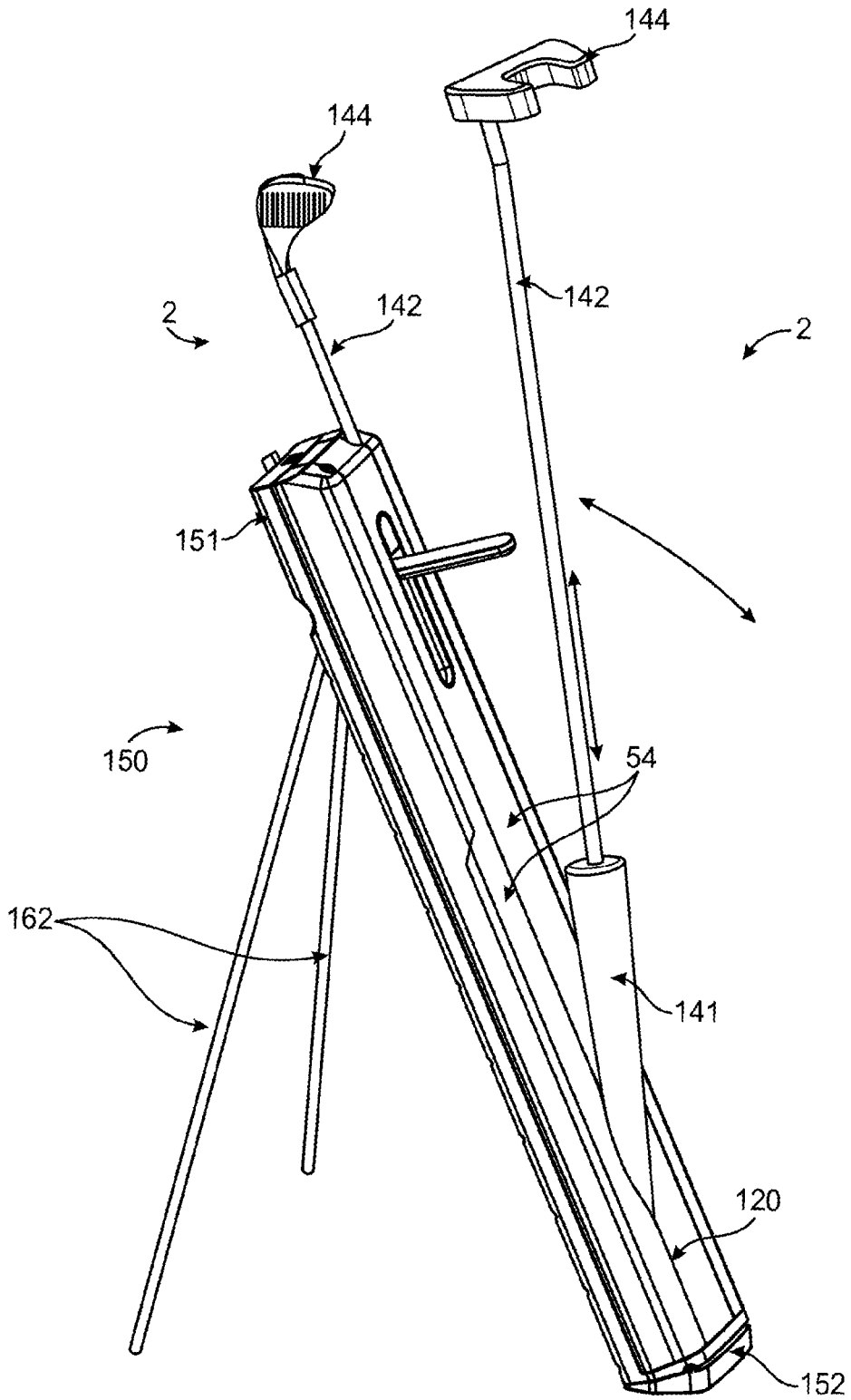
Figure 34:
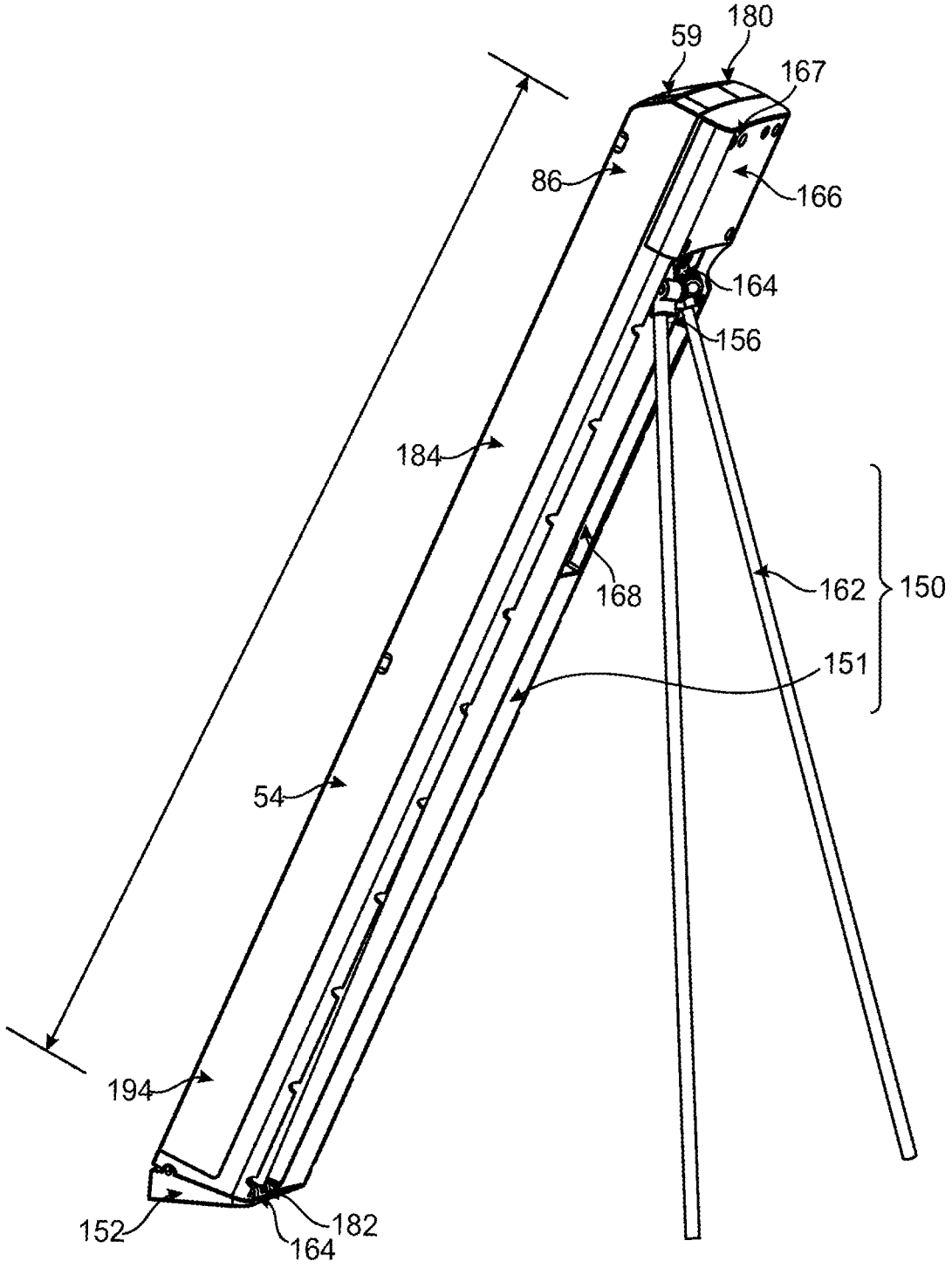
Figure 35:
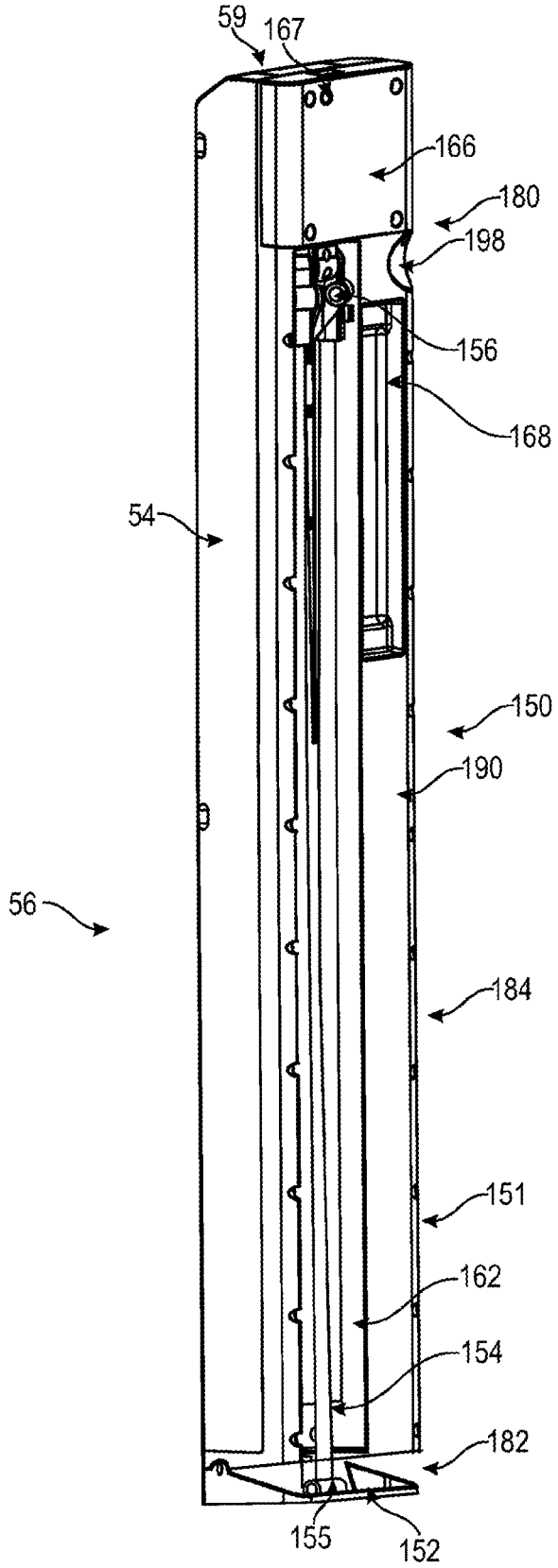
Figure 36:
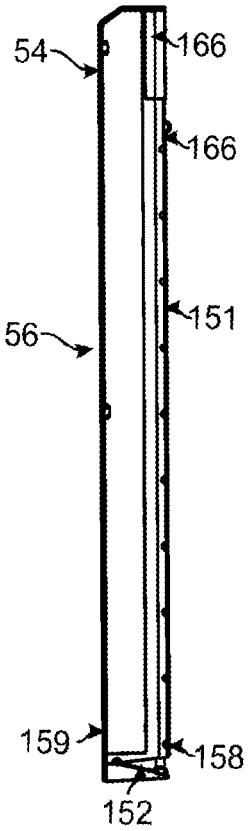
Figure 37:
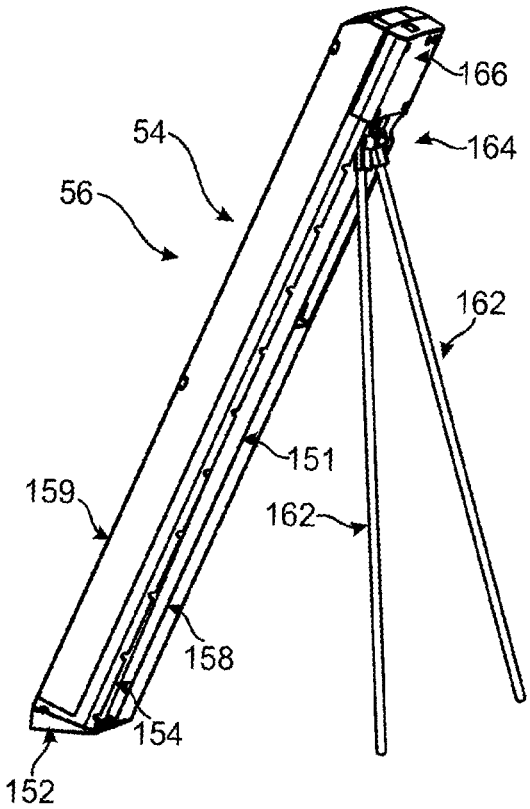

In use, each elongate item 2 (e.g., golf club 2) is shaped as an elongate slender member having ends 140, having a grip 141, a shaft 142 and a club head 144 whereby when playing golf, the club head 144 is said to be the bottom end and the grip 141 can said to be the top end whereas when storing the elongate item 2 it oriented upside down i.e., with the grip 141 located at a lower end and the head 144 at the top. As shown in FIGS. 27-29 for insertion, each elongate item 2 (e.g., golf club 2) is oriented upside down with the grip 141 pointing downwardly and then is slid horizontally and downwardly into through a bottom/lower portion of the elongate slit shaped opening 120 into within the base of the club 2 and partially into one lower anti-rotation member 96 and then vertically rotated about the bottom 108, upwardly about its base through the rest of an upper portion of elongate slit shaped opening 120, to then optionally into (i.e. in some of the space 137 between the splayed arms 138 of adjacent anti-rotation members—insertion cause the splayed arms 138 to splay further to accommodate and removably hold or grip the club there between) another anti-rotation member 96 and then upward rotation is continued to end up in a substantially vertical orientation with club head 144 upwardly protruding through the widened aperture 122 of roof 110.

Each anti-rotation member 96 are shaped or configured and mounted to enable item, 2 to easily by hand be pushed and rotated into the gap or space 137 between arms 138 (by resilient and flexibly splaying the arms further apart) to be held there between (by tension and not clipping) the arms 138 minimally at the entrance of the space 137 without needing to be fully enclosed but in some situations the item 2 may be fully inserted in the space 137 between arms to possibly abut the base 136.

Figure 66:
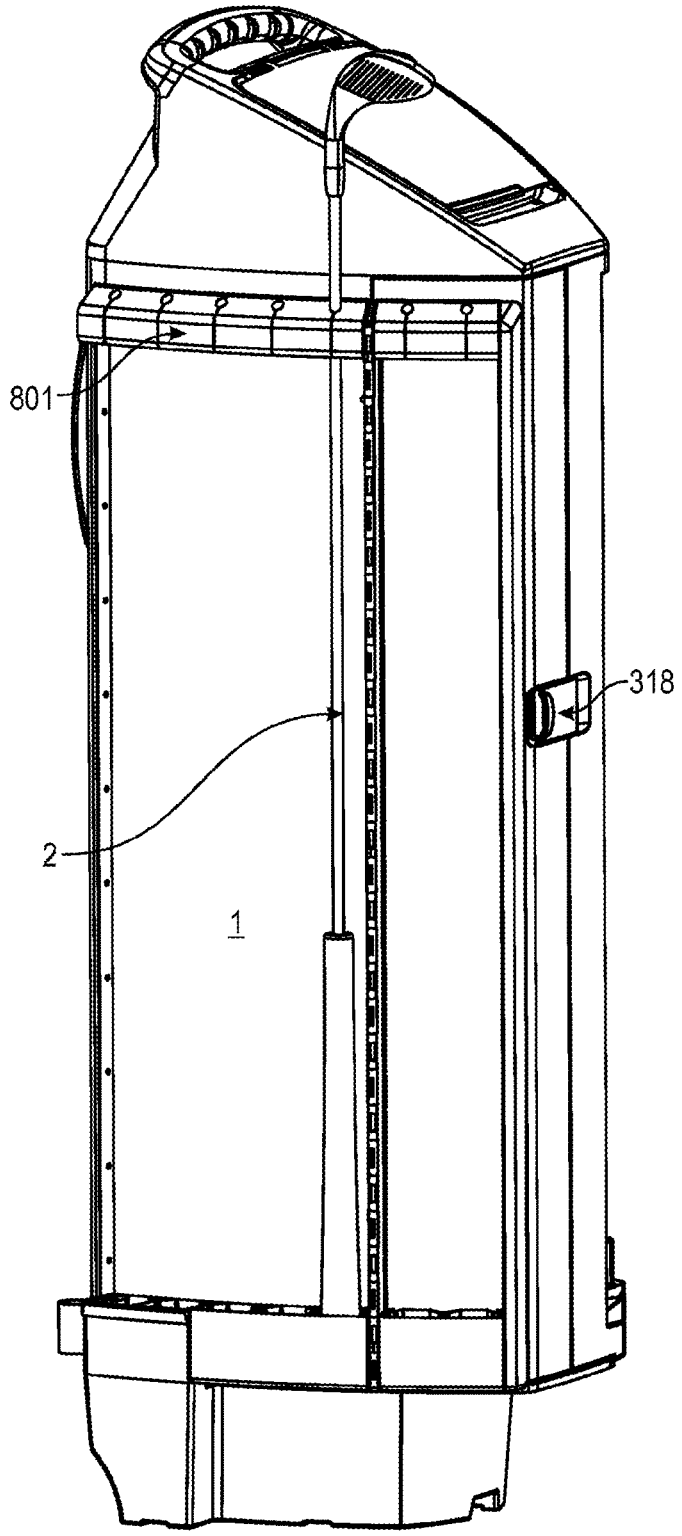

Turning now to FIGS. 65 and 66, these views show the carrier 1 with the side housing removed. In some cases, the housings 54 can be repaired or replaced as they can be detachably mounted on an exterior (side) wall of the carrier 1.

FIG. 66 illustrates the location of a golf club 2 to show how it is held parallel to the side wall of the carrier 1 (with the housing removed for illustrative purposes only). Normally the only portion f the club visible from the outside would be the head which protrudes above the roof 110.

Figure 24:
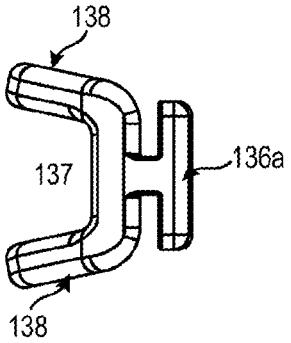
Figure 25:
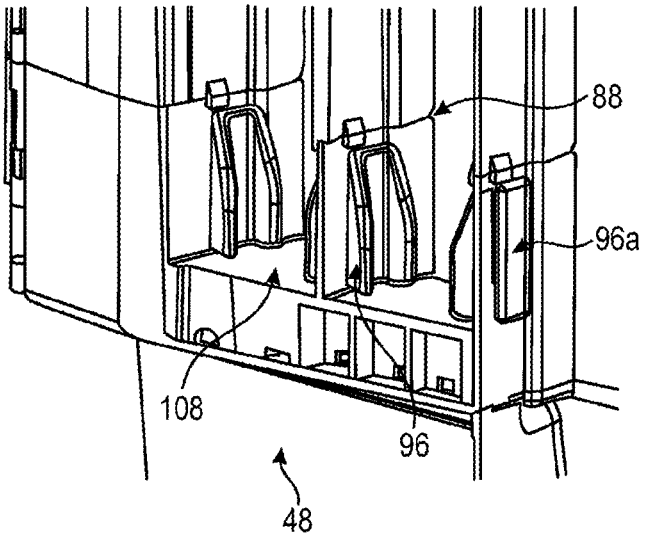
Figure 26:
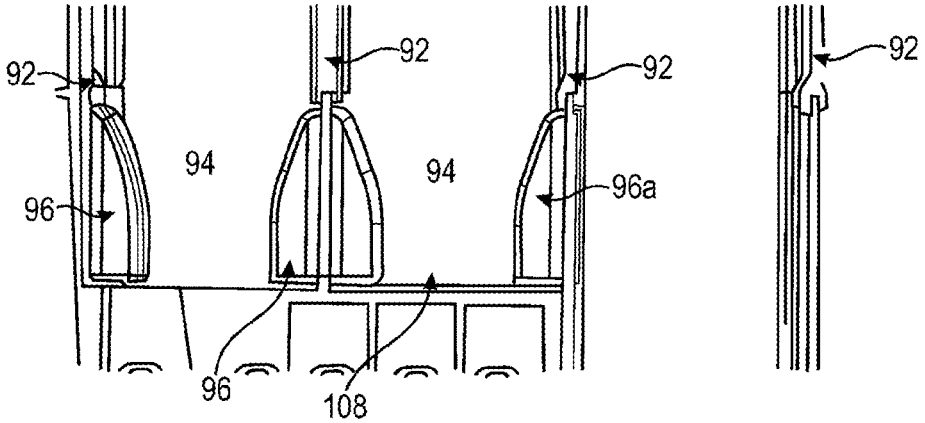
Figure 26A:
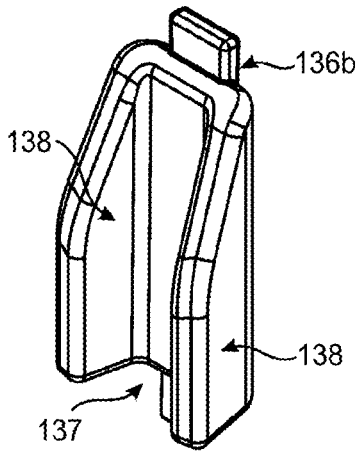
Figure 26B:
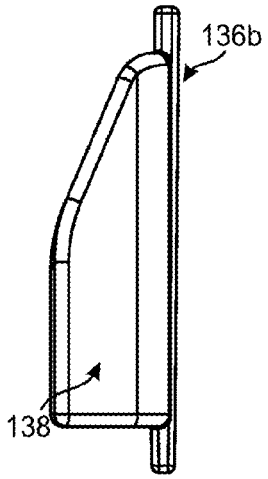
Figure 26C:
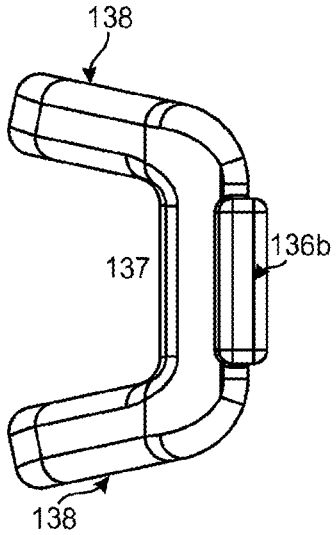
Figure 26D:
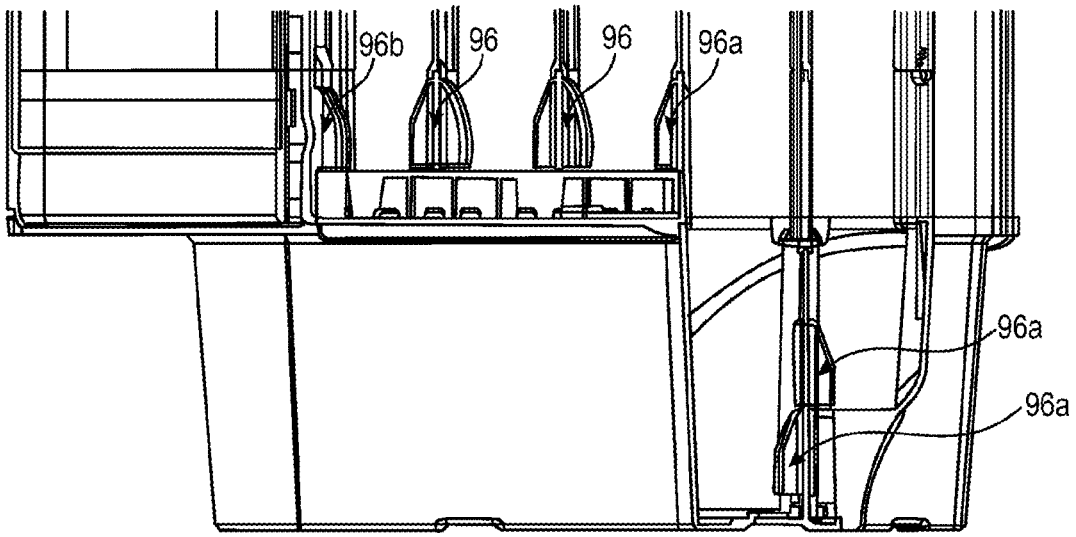

For removing one elongate item 2 (e.g., golf club 2) as seen in FIGS. 24-26 it is the same steps but in reverse order i.e., first downwardly rotate the elongate item 2 (e.g., golf club 2) about the base of the elongate shaped space 94 out of widened aperture 122 through elongate slit shaped opening 120, then continue downward rotation of the elongate item 2 (e.g., golf club 2) through elongate slit shaped opening 120 about base to disengage from anti-rotation member 96, continue rotation until hitting end of elongate slit shaped opening 120, and then slide club grip 141 out of lower anti-rotation member 96 and then out of the bag.

In summary there is disclosed as shown in FIGS. 53-58 and 61-63, a method for inserting (or removing) each elongate item 2 (e.g., golf club 2) into one elongate shaped space 94 of one elongate shaped housing 54 to hold it therein, which include at least the following steps of without the anti-rotation member 96, 96*a*, 96*b*, 96*c*:

wherein the method includes the following steps of:

e) Orientate a lower end 140 of an elongate item 2 at an angle to the horizontal in a vertical plane, to point in through at a lower portion of slit opening 120;

f) Then locate said lower end 140 of elongate item 2 to substantially abut the floor 108 or be close to the floor 108 of elongate shaped space 94 of housing 54;

g) Then vertically moving it about its pivot point at floor 108 or a position at or near to the floor 108 will allow the rest of the club to move upwardly through more of the lower portion of slit opening 120 above the lowest portion;

h) Then continue pivotal movement of the elongate item 2 about the floor 108 or near to, upwardly through slit opening 120 until a top portion near top end 140 of the elongate item 2, is located in widened opening 122, to thereby have an upper portion 144 of the elongate item to be upwardly protruding therefrom and a lower portion to then rest on floor 108.

Preferably the method as given for insertion, is reversed for causing the removal of the elongate item 2 (e.g., a golf club) from the elongate shaped housing 54.

Preferably the method as given above is adjusted for use with the anti-rotation members 96, 96*a*, 96*b*, 96*c* as removably located on at least one wall 92, 76, 80, 88 at least at a lower end of the housing (as this prevents rotation about the club axis and hence stop clubs from rattling against one another if the housings and hence the club heads are closely spaced) whereby the steps include:

e) Orientate a lower end 140 of an elongate item 2 at an angle to the horizontal in a vertical plane, to point in through at a lower portion of slit opening 120;

f) Then locate said lower end 140 of elongate item 2 to substantially abut the floor 108 or be close to the floor 108 of elongate shaped space 94 of housing 54;

g) Then pivot upwardly about floor 108 or near to the floor 108 whereby the anti-rotation member 96 if engaged will prevent rotation about the axis of the elongate item whereby a lower portion of the elongate item 2 is located into recess 137 of the anti-rotation member 96 by splaying the walls 138 further apart to positively locate a portion of the elongate item 2 therein, h) Then continue pivoting upwardly of the elongate item 2 about the floor 108 or near to, through slit opening 120 and engagement with the other anti-rotation members 96 until a top portion near top end 140 of the elongate item 2, is located in widened opening 122, to thereby have a upper portion 144 of to be upwardly protruding therefrom and a lower portion removably and resiliently held in the space or recess 137 of the anti-rotation member 96 to then rest on floor 108.

Removing the elongate item 2 (e.g., golf club) is the same steps but in reverse. The action of first inserting the item 2 may include simultaneous actions of pivoting at or near the floor 108 while being partially inserting in an anti-rotation member 96.

During this horizontal translation and rotation of the elongate item 2 (e.g., golf club 2) through the elongate slit shaped opening 120, the material of the front and roof is of a material type that allows the sides 124 of the elongate slit shaped opening 120 to start off as the closed configuration (i.e., almost meet) and then flexibly/resiliently/hingedly deflect about a part of the shaft 142, to part or deflect to open inwardly or outwardly in an open configuration to then later automatically return to at least close to their former closed configuration whereby when the elongate item 2 (e.g., golf club 2) is stowed within the elongate shaped space 94, the anti-rotation members 96 resiliently hold the elongate item 2 to keep each elongate item 2 within one elongate shaped space 94.

As shown in FIGS. 14, 15, 29, 53-60 elongate shaped item housing 54 is formed and configured as a non-removable portion as elongate shaped space 94 of the golf carrier assembly 1 i.e., as fixedly connected or fastened peripherally arranged around the outside of the wall support housing member assembly 46. In an addition to this fixed peripheral connection, there is the same elongate shaped item housing 54 in the form of elongate shaped space 94 as part of the portable carrier assembly 56 which is removably affixed peripherally in housing 46 outer recess 68.

Each elongate item or implement (e.g., golf club 2) can be arranged into the club habitats or elongate shaped spaces 94 of the present invention, in any order such as for example from smallest to largest. The club grips 141 are therefore protected from moisture and impact damage, and each elongate shaped spaces 94 may also have optional drainage vents at their base (they were included in the prototype but have since been removed).

Portable carrier assembly 56 includes a separate portable carrier housing which includes at least one elongate shaped item housing 54 on one side i.e., a front side combined with a support stand apparatus 150 located at its opposite side i.e., rear side, which is shaped for removable latchable storage in external recess 68 of the housing assembly 46. In the case of the portable carrier assembly 56 though two housings 54 are shown, it envisaged any number of housing 54 can be provided as required to be portable which can mean any number of housings 54 that are able to be moved or lifted forming the portability function e.g., two housings 54, three or four housings 54 but is not limited to that number.

In this example, this portable carrier assembly 56 is designed to allow a player to carry a light weight, free standing portable elongate item 2 (e.g., club) carrier assembly without the need to carry all the elongate items e.g., golf clubs—for example, this portable carrier assembly 56 can carry the putter and wedge, and some accessories like ball marker, pitch repairer and a towel.

When using terms like 'front' and 'rear' for the portable carrier assembly 56, the 'front' in this case is defined as referring to the outward face of the portable carrier assembly 56 facing a user and a 'rear' is meant to refer to behind the portable carrier assembly 56 i.e., where the support stand apparatus 150 is housed against the side walls 76, 80 of the wall housing 46 of the carrier assembly. This orientation is different to that for the carrier assembly its self as a whole where the front is defined as facing a user or where the doors 300 are located with other relative terms like rear, height, width and sides being oriented accordingly.

The overall shape of the body of portable carrier assembly 56 is similar to that of the elongate shaped item housing 54 but is thicker in dimension to accommodate and include the support stand apparatus 150. The elongate shaped item housing 54 of this portable carrier assembly 56 includes at least one or two elongate shaped spaces 94 for removable storage for two elongate item 2 (e.g., golf clubs 2) therein (e.g., putter and wedge). Therefore, the overall shape is rectangular cuboid or prism shape having an overall elongate shape being of a similar length to the length of a golf club shaft 142 with its grip 141.

The elongate shaped item housing 54 like the rest of the elongate shaped item housing 54 as previously disclosed in this specification includes an enclosed accessible structure with an elongate shaped space 94 therein having its own roof 110 with the same widened area or opening 122 connected to its own elongate slit shaped openings 120, which such elongate slit shaped openings 120 from the roof are each connected to its own front wall panel 86 with access internally via any part of elongate slit shaped opening 120 in the roof and front wall panel 86. At least one anti-rotation member 96 is provided by being affixed to the inside of each elongate shaped housing 54 having its arms outwardly protruding from the inner walls of the elongate shaped spaces. For example, the anti-rotation members 96 can be located anywhere in the walls of the housing 54 as required to hold at least a portion of an elongate item 2 such as for example at a lower bottom end of each elongate shaped housing 54 and space 94 commensurate with the position of the grip 141 of the elongate shaped item 2 e.g., a golf club. As shown in FIG. 52*b* the shape of the anti-rotation members 96 are not the same shape as the anti-rotation members 96 of the other housing 54 of the carrier assembly in that the walls or arms 138 are splayed more and are longer to accommodate different shaped grip 141 of the elongate item.

The connection of the elongate slit shaped openings 120 in the front wall 86 to the elongate slit shaped openings 120 in the roof 110 allow for sliding receipt of one elongate shaped item 2 e.g., a golf club, there through into elongate shaped housing 94 which are then caused to upwardly protruded therefrom to allow the elongate item 2 golf club head(s) 144 to upwardly protruding there from the widened opening 122 in roof 110.

Support stand apparatus 150 also includes a rear housing 151 being substantially channel shaped for operatively connected together by suitable fastening & rotating means 151*a* and containing a push/push plate 152, push pull elongate member 154 e.g., rod/wire, trunnion 156 and leg members 162. The push plate 152 is a planar shaped member located at a lower in use end of the housing 46.

The rear housing 151 which is channel shaped includes a top end 180 separated from bottom end 182 and sides 184, a rear face and rear edge 190. Also, there is a height 192 dimension between ends 180, 182, a depth/thickness 194 dimension between faces and a width 196 dimension between sides.

Approximately two thirds of the depth 194 is taken up with the elongate shaped item housing 54. In use when portable carrier assembly 56 is attached to the wall support housing member 46, a rear side of apparatus 150 has the support stand apparatus 150 attached thereto. The golf stand apparatus 150 which includes a channel shaped housing 151 contains two leg members 162 end pivoted 164 attached to an upper end of the housing. The leg members 162 are of a dimension and configuration to be able to be rotatable or unfolded out of the housing 151 to form a splayed configuration (see FIGS. 17, 18 and 20) to be able to support the portable carrier assembly 56 and also allow stowing of the legs 162 in a parallel configuration (but not necessarily in one layer) within the channel shaped housing 151—see FIGS. 16 and 19.

Figure 19:
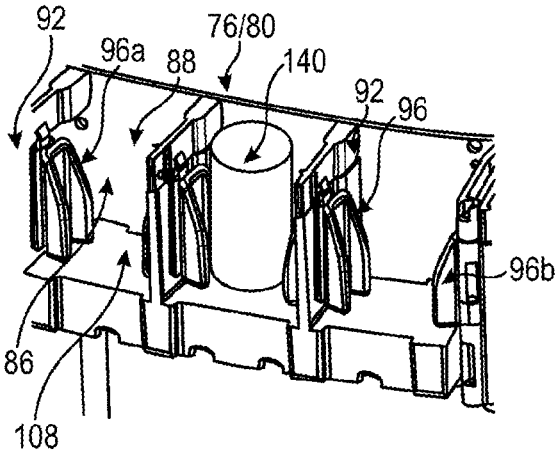
Figure 20:
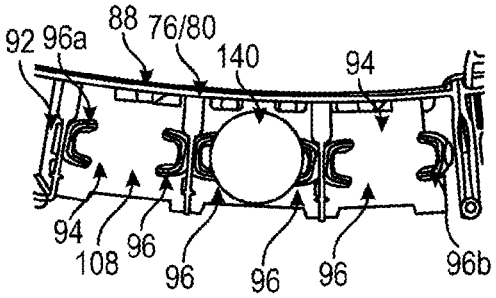
Figure 21:
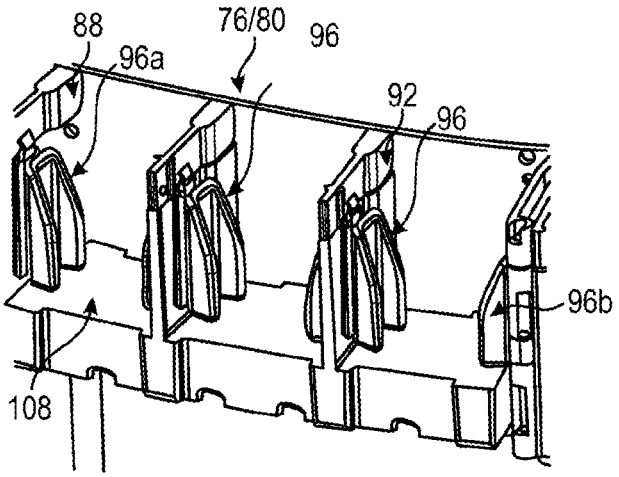

In a rear face 158 (facing the recess 68 of carrier assembly 1, with front face) at a top end of the portable carrier assembly 56 as shown in FIGS. 19, 20 show a storage box 166 suitable for any accessories e.g., for wedge, ball marker, pitch repairer etc. A pleated magnetic towel 168 is magnetised to allow easy attachment to the golf carrier assembly which has a metal catch thereon in a towel recess 170 as located in rear housing 151.

Portable carrier assembly 56 includes holding system to allow removable attaching of the portable carrier assembly 56 to the side of the carrier 1 e.g., the rear of at least one of the doors 300 in an outer recess 68 of the carrier housing 49. The latch holding system includes a portable carrier actuator lever handle 178 located in a handle recess 177 in the side of portable carrier assembly 56 operatively connected to a latch 174 on the side of portable carrier assembly 56 whereby lifting the handle 178 causes the portable carrier 56 to disengage from latch 174 from the carrier housing 49. There is also a latch 175 located on a bottom of the recess 68 of the carrier housing, and a handle recess 177 on the front of portable carrier assembly 56. The latch 175 on the bottom of the recess 68 is removably received in a latch recess underneath the push plate 152. Lifting handle 178 in effect causes carrier 56 to pop out from the top of recess 68 to tilt outwardly to allow one to lift the carrier 56 up out of latch engagement at the bottom. To put carrier 56 back into recess 68, position bottom of push plate 152 over latches 175 at base of recess 68 and then tilt back in at the top of carrier 56 using lever handle 178 or simply push back in to click into place with latch 174 at the top.

Figure 17:
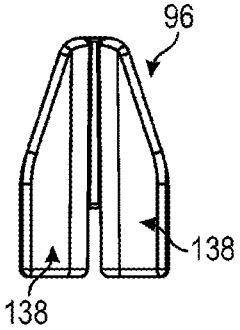
Figure 18:
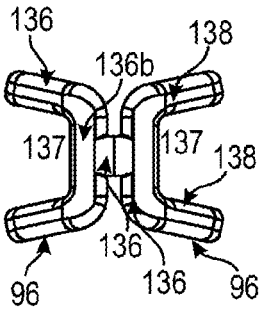

The handle recess 177 as seen in FIG. 17, 18 is also located on front face 158, which includes an elongate shaped recess protruding somewhat within one of the elongate shaped spaces 94. The bottom end 182 also includes the push plate 152 which comprises a rear edge (optionally biased) and pivotally connected plate able to be pushed or drops by pivoting about or near the front edge to support the portable carrier assembly 56 on the substrate 4 with respect to the leg members 162 by the leg members 162 via trunnion 156 and push pate 152.

Figure 16:
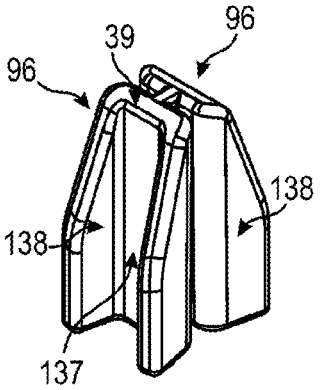

Push plate 152 is located at the in use bottom/lower or one end of the housing 151, which is a planar shaped rectangular member being pivotally attached along one of its length edges of the front of its housing 151 forming a movable wedge shaped gap 152*a* there between, and in use having a lower planar surface having a bottom recess 160 mostly at a front edge, for capturing upward tab members 161 as seen in FIG. 16 in the floor of recess 68 which assists in locating the bottom of the portable carrier assembly 56 when in the recess 68 of the rear of one of the doors 300 whereby the top of the portable carrier assembly 56 or its rear housing 151, is removably latched in place by interaction of push button 178 in one door 300 with movable latch 174 in the top side edge of the rear housing 151. Also located on the bottom surface there is provided a gripping means 153 in the form of roughening e.g., at least one protruding formation of any suitable shape, pattern or spacing there on, which is designed to provide some grip for the portable carrier assembly 56 when being operated and then located on any substrate e.g., ground. Push plate 152 also has an in use upper planar surface facing upwardly towards the legs 162 and push pull elongate member 154, which includes push rod holding clip 155 to hold and locate a lower end of push pull elongate member 154.

The push plate 152 is pivotally by pivot 161 pushed down (gap 152*a* is formed) when in place in recess 62 of the golf carrier assembly 1 (legs folded in housing with pivot gap at widest extent) and then as the portable carrier assembly 56 is removed from recess 68 so pivots upwardly away from tab members 161 to allow removal of the portable carrier assembly 56 from the golf carrier assembly. When then resting on a substrate, the push plate 152 is pushed down by pivoting about pivot 161 to reduce or remove gap 152*a*, thereby upwardly pushing the push pull elongate member 154 to then cause the releasing of the leg members 162 to be splayed and support the portable carrier assembly 56 in a rearwardly leaning vertical orientation, about three points i.e., the ends of the leg members 162 and a lower end of the portable carrier assembly 56 body.

Between the habitats (elongate shaped spaces 94) on part of an inner corner of the housing of the portable carrier assembly 56, there is at least one corner indentation 198 which creates a curved abutting surface that when simultaneously holding handle recess 177, enables users/players fingers to better grab/hold the portable carrier assembly 56.

Figure 41:
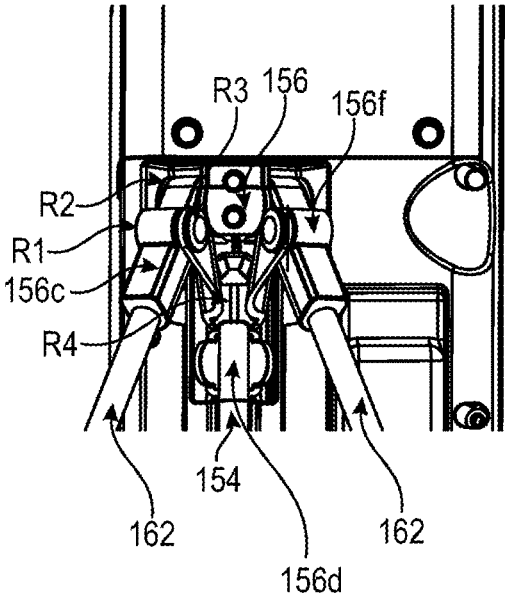
Figure 42:
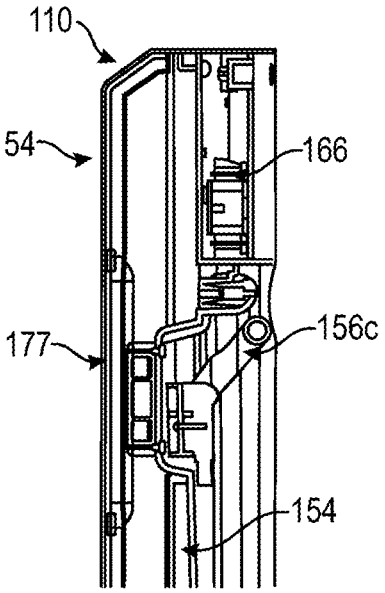
Figure 43:
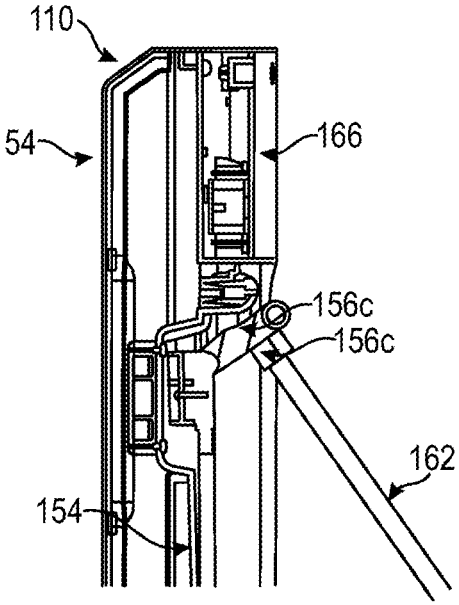
Figure 44:
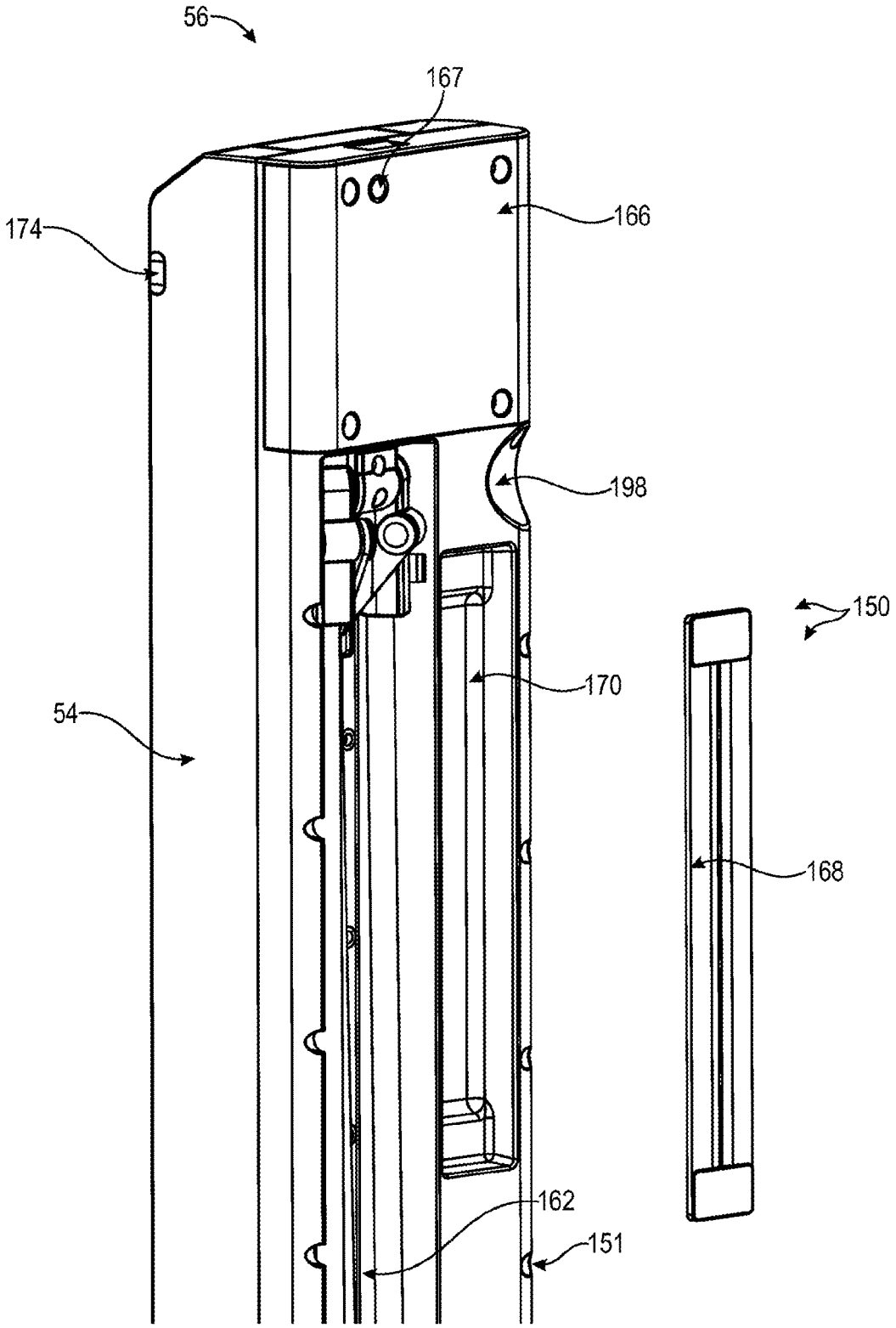
Figure 45:
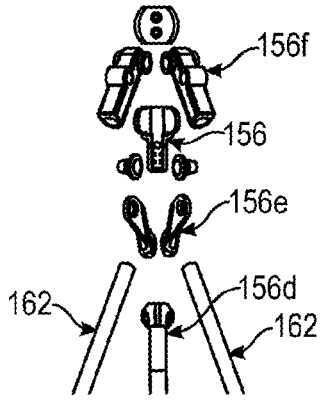
Figure 46:
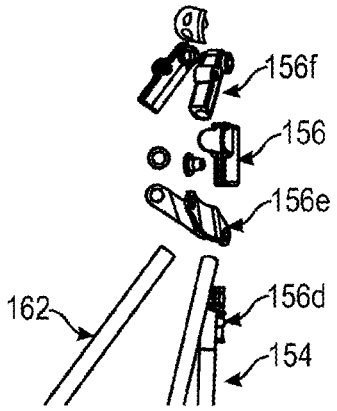
Figure 47:
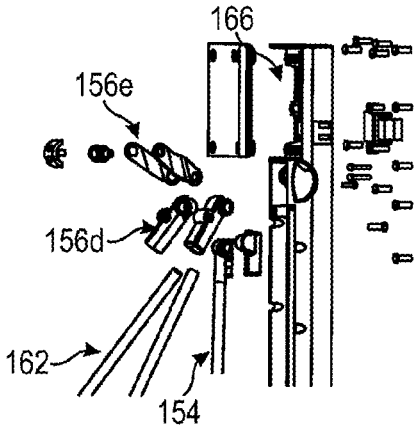
Figure 48:
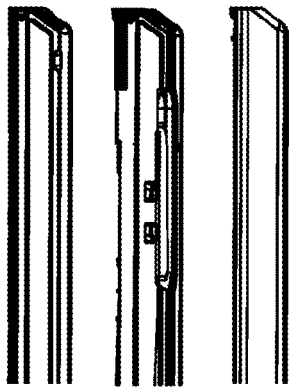
Figure 49:
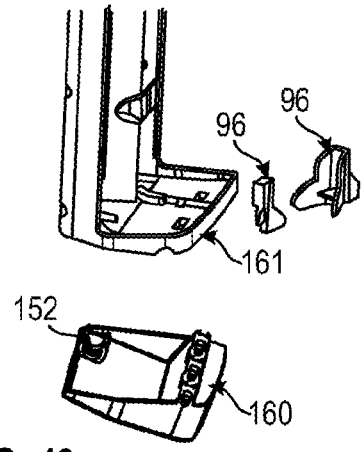
Figure 50:
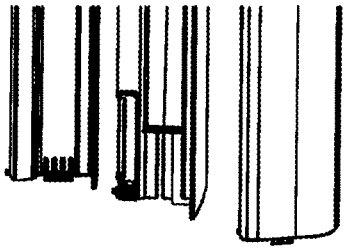
Figure 51:
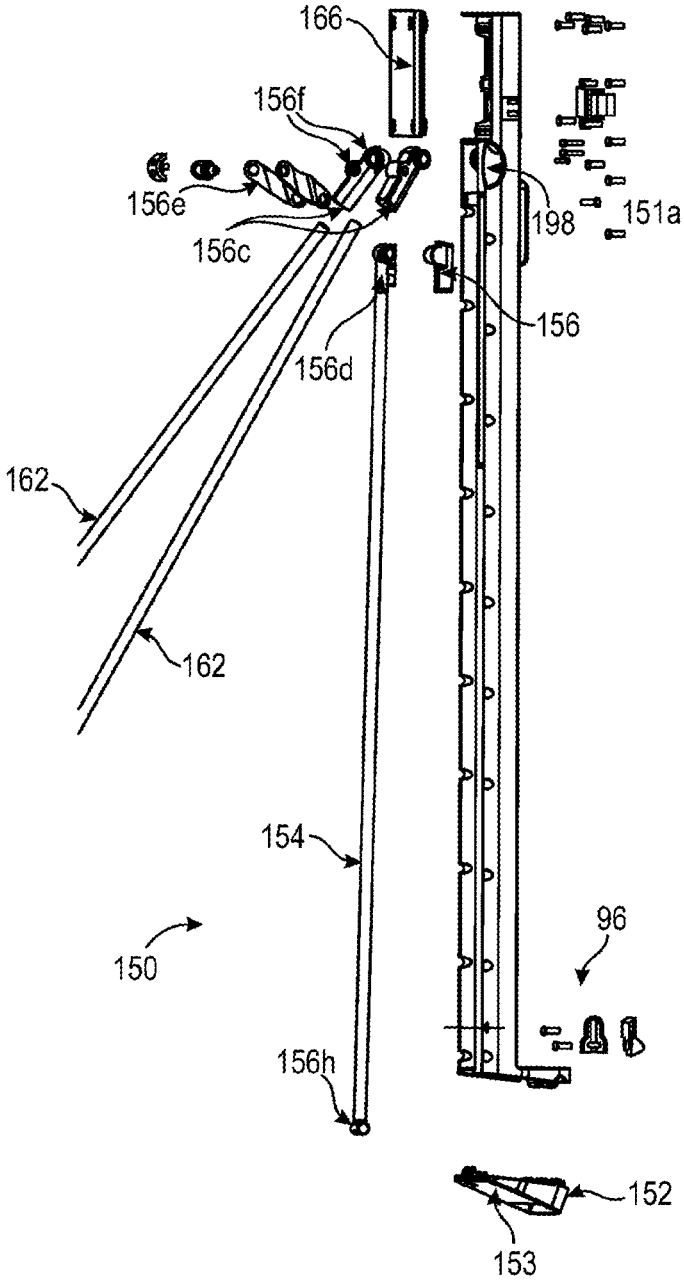

The portable carrier assembly 56 operatively bundles together and rotatably connects the components of push/foot plate 152, push pull elongate member 154 e.g., rod/wire and trunnion 156 and trunnion mechanism that when taken out of the carrier assembly 1 and the push plate 152 is depressed by tilting the portable carrier assembly 56 which actuates the extension or unfolded configuration of the (e.g., aluminium) legs 162 to allow the portable carrier assembly 56 to be free standing in a lean-to configuration. When the push plate 152 is un-tilted or allowed spring back down or flop back out (creates the gap 152*a* to the underside of the portable carrier housing) to cause the legs or arms to fold back as in a folded configuration into the rear housing 151. The rotation connection between the components of the portable carrier assembly 56 as seen more closely in FIG. 41 shows the rotational connections which are angled with respect to a vertical (assuming the length of the carrier 56 provides a so called vertical axis) which include free pivoting rotation there about a pin and socket combination-though other combinations of rotation are also possible. There are four axis of rotation on each side of the trunnion i.e., R1, R2, R3, R4 as shown in FIG. 41.

The trunnion 156 is operatively connected to the push pull elongate member 154 and legs 162 by a trunnion mechanism. The trunnion 156 is shaped as a three limbed member comprising a central base 156*a* with angled arms 156*b*. The trunnion mechanism includes leg end caps 156*c*, push rod end cap 156*d*, link arms 156*e*, (pivot pins 156*f* and pivot sleeves 156*g* for the link arms), operatively connected to together.

The base of the push pull elongate member 154 includes a shape as a T section end member 156*h*. The T section 156*h* (used in an upside down configuration) has a round rod shaped head end formed and connected to a round base end whereby the base stem (tubular shaped) end is slotted within (captured by) a lower end of the push pull elongate member 154 and the rounded head end is rotatably housed within a complementary shaped female slot of clip 155.

Push rod end cap 156*d* (e.g., white plastic) being a splayed T shape comprises a head portion, arm portions and body or stem portion. Body portion is attached to upper end of push pull elongate member 154 which with the head portion is slottedly guided at least partially within a house tracking slot groove. The arm portions are angled in a splayed like formation having circumferentially grooved ends. The stem portion being tubular captures an upper end of the push pull elongate member 154.

Each link arm 156*e* includes a planar elongate member having a stepped shape with parallel fixing ring ends. One ring end of link arm 156*e* is rotatably affixed to one circumferentially grooved end and the other ring end is rotatably affixed to leg end cap 156*c* by pivot pin 156*f*.

Leg end cap 156*c* is a tubular shaped member having a closed end with a first tubular inner passageway sized to slidably receive an upper end of one leg 162. The first tubular shaped member also has a second tubular member oriented at right angles to the first tubular member & leg 62 and being connected and fixed on top of but mid-way of the first tubular member. Another pivot pin rotatably interconnects through second tubular member to connect the link arm to the push rod end cap 156*d* of push pull elongate member 154. The close end of first tub member includes a transverse slot which is oriented similar to second tub member but not quite as it is oriented at an angle to the transverse to match the angle of the splayed angled arms 156*b* of the trunnion, to rotatably receive therein each angled arm 156*b*. Central base 156*a* of the trunnion is affixed to the housing 151.

The legs 162 are operatively connected by trunnion 156 (as fixed by its base to rear housing 151) to push pull elongate member 154 and push plate 152, whereby movement of the push plate 152 longitudinally pushes the push pull elongate member 154 to transmit its movement from the push plate or push plate 152 linearly through the push pull elongate member 154 from its base in the clip 155 which such linear motion also includes rotational motion of the base of the push rod (i.e., T shaped member 1456*h*) within the clip 155, to the legs 162.

The pressure from operating the push plate 152 (closes the gap) is initiated linearly (e.g., vertically) from the push pull elongate member 154 and then translated through the pivot pins and link arms 156*e* into circular motion via pressure from the trunnion 156 to rotatably activate the legs 162 to splay them apart, by rotating about the trunnion 156. And vice versa whereby tilting the portable carrier assembly 56 when putting back into the golf carrier assembly 1 or just to fold the legs 162, causes the push plate to pivotally rotate about the housing to enlarge the gap to take the push rod down to in turn rotate the legs 162 back into a folded near parallel but spaced configuration.

The push plate 152 as side pivoted to underneath the bottom end of the portable carrier housing has wedge shaped gap 152*a* there between which is at its maximum extent when the arms/legs 162 are in the folded configuration as a so-called relaxed position or non-extended, in rear housing 151 and when the arms/legs are in the unfolded configuration or extended with gap 152*a* as its minimum extent pivoted from and outside of the rear housing.

When folded the trunnion mechanism, legs 162 and push pull elongate member 154 are substantially housed in housing 151 of the portable carrier assembly 56. Part of the mechanism i.e., the trunnion mechanism 162 will outwardly protrude beyond the thickness of the portable carrier assembly 56 but this protrusion can be accommodated in a trunnion recess 157 as provided in the rear wall at the appropriate position of the outer recess 68 of one of rear of the doors 300.

The legs 162 can also have guide slots as located within the housing 151 closer to the bottom, which are used when folding the legs back into the housing 151. The legs are shorter in length to the length of the push pull elongate member 154 or are recessed back from the push plate, thereby causing the portable carrier assembly 56 to lean as required.

The push rod end cap 156*d* is substantially slidably guided within a separate guide slot in the rear housing and a further slot is provided for receipt of a magnetic towel.

Push plate 152 in size in area is sized to match the area of the end of the portable carrier assembly 56 with gap 152*a* when at its largest extent faces rearwardly of the portable carrier assembly 56. Elongate shaped housings 54 and their space 94 of the carrier assembly 1 and or portable carrier assembly 56 can be of different dimensions internally because of the extent of the housing 151 in the rear for longer elongate shaped items e.g., clubs 2.

Rotating the push plate 152 pushes the rod 154, which pushes and rotates one end of the link arms 156*e* which by its other end is fixed in position to rotate only about the trunnion 156 to cause the legs 162 to pivotally rotate there about the fixed position trunnion 156.

The push rod end cap 156*d* is substantially T shaped having splayed pivoted end connections to the lower end of the link arms 156*e* and other end is tubular to capture a lower end of the push pull elongate member 154. The pivot clip 155 is a T shape having a stem and head wherein the head is held in position in the push plate 152 but is adapted to allow vertical pivoting in a horizontal plane of the head with respect to the clip 155 while transferring a vertical upward translationary movement to push rod 154 which pushes it.

The push rod end cap 156*d* includes one end tubular shaped to capture one end of the push pull elongate member 154 therein and has one angled vertical pivot connection for the upper end of the link arm 156*e* and a second pivot connection to one side of the trunnion base 156. The push rod end cap 156*d* provides splayed angled vertical rotation. The link arm 156*e* provides spaced transfer of angled vertical rotation from the push rod 154 to each top end of each of the arms 162.

The leg end caps 156*c* provides angled rotation transferred from each link arm 156*e* in combination with the angled vertical rotation about the trunnion base 156 in a similar angle of rotation but spaced apart from each other. The push rod end cap 156*d* provides splayed angled vertical rotation. The rear housing 151 is shaped to substantially house the support stand apparatus 150 in a folded configuration therein.

Carrier Storage System 60—see FIGS. 6,8-13, 15-27,29.

The carrier storage system includes internal storage cavity system which includes upper minor compartment system 72 and lower major compartment system 74, is made up many different forms of storage for a multitude of uses.

The upper minor compartment system 72 as seen in FIGS. 6-13, includes a separate housing to wall housing 46, which comprises housing walls 199 and floors which including a lid accessed storage system which includes a first lid 200 (e.g., clear plastics member to see the score card directly held underneath) pivotally upper edge attached (hinged at hinge 220) to a first upper compartment 202 and a second lid 204 pivotally attached to an underneath, over second upper compartment 206 but attached to the same pivot 220. Upper lid 200 is includes a lower end tab portion 209 extending beyond second lid 204 over a front horizontal finger access recess to enable selective lifting of the first lid 200 versus the second lid 204. The orientation of lids 200, 204 are both parallel with each other and are angled between the horizontal plane and vertical plane e.g., 30 degrees from the horizontal, to angle facing a front or user and rising away from the user.

Figure 12:
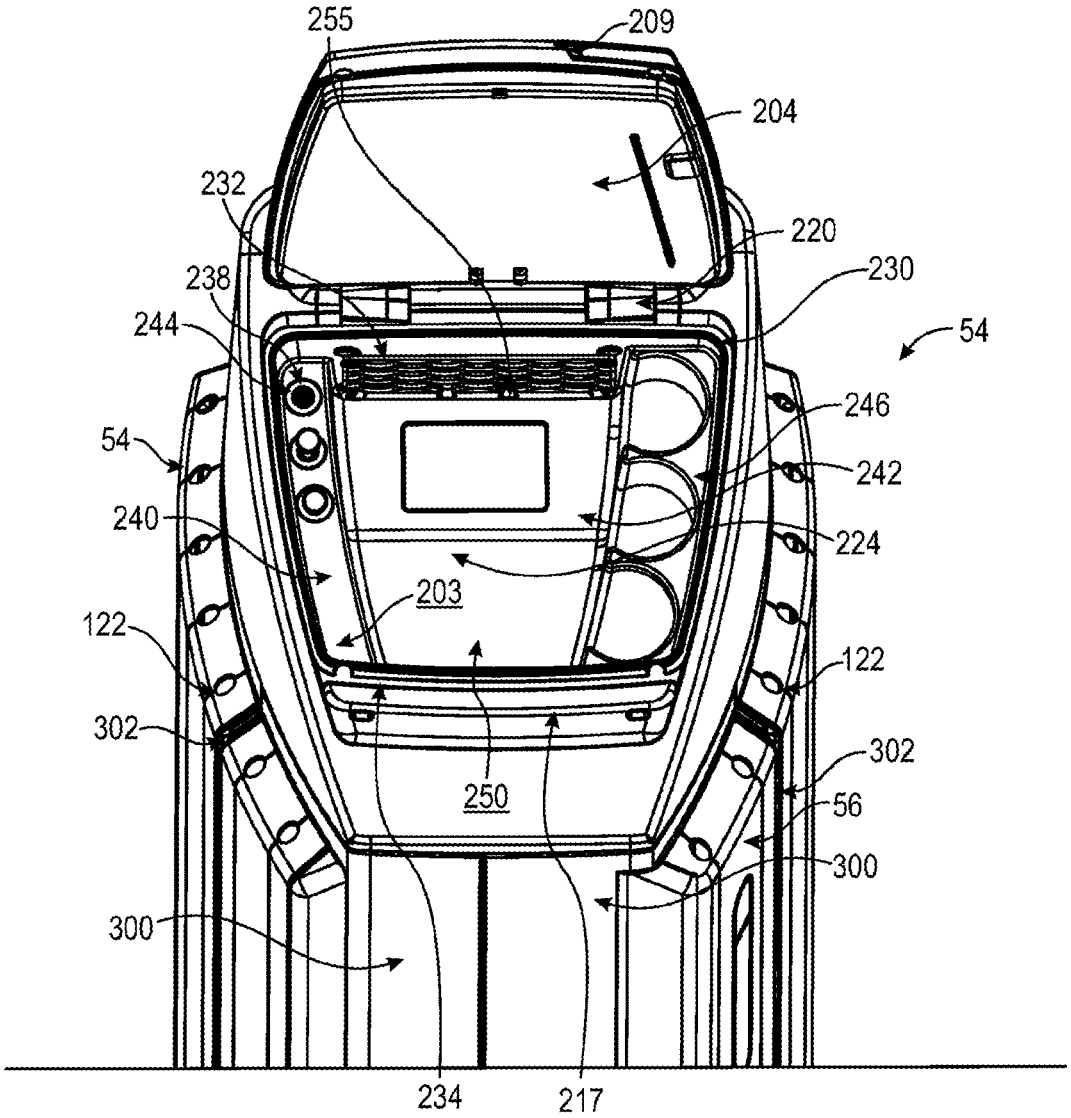
Figure 13:
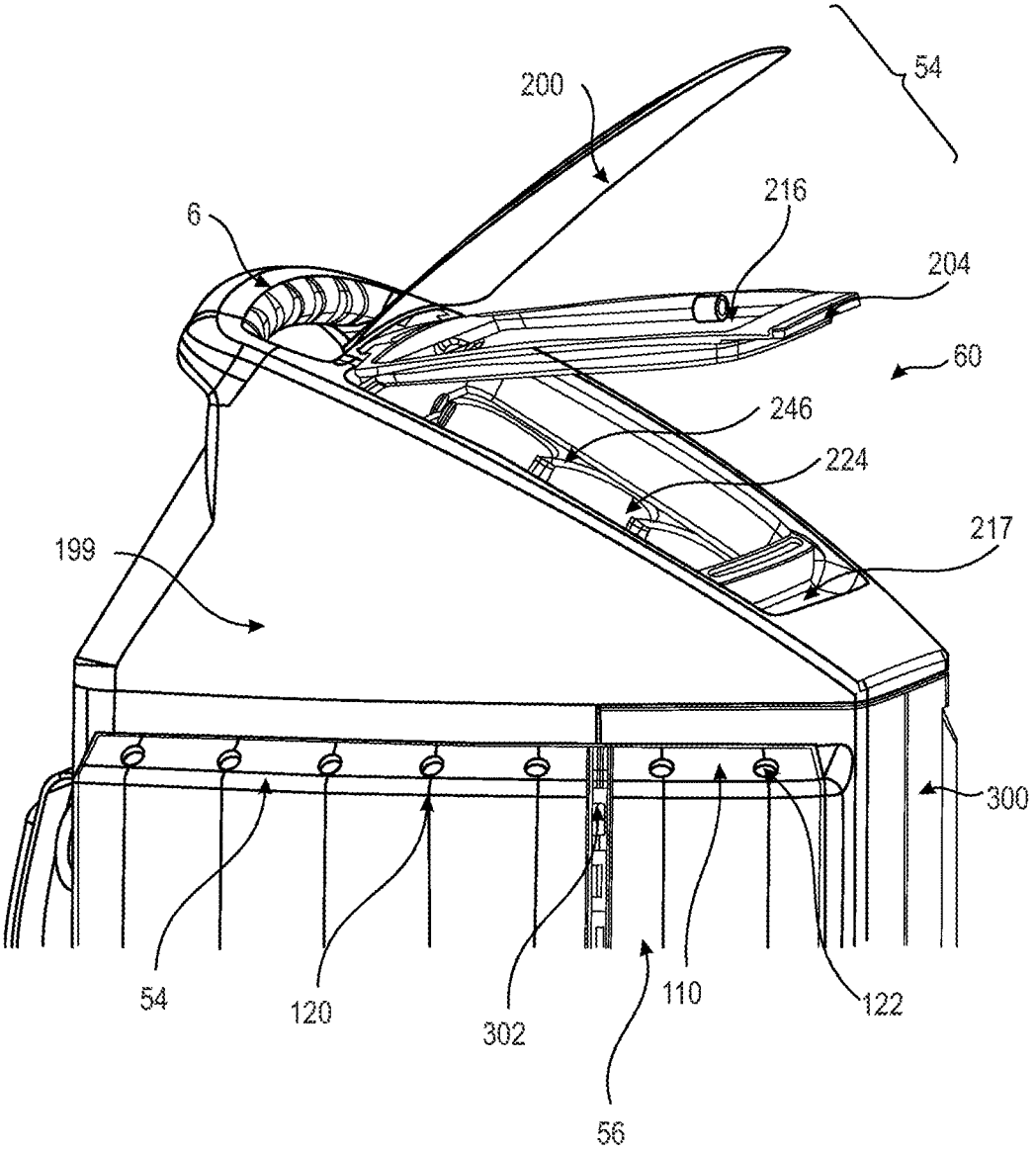

The housing walls 199 of the upper minor compartment 72 are in line with the left and right side walls 76, 80 and rear wall 78 of wall support housing member 46, thereby causing the elongate item or golf club housing member 54 to protrude outwardly therefrom to enable the heads of each elongate item 2 e.g., golf club, to upwardly protrude there form the carrier assembly 1—for example see FIGS. 12 and 27. Please note a rear portion of the walls 199 is an inclined or angled wall, though not as forwardly inclined (towards the front or user) as the lids 200, 204.

The overall shape of the carrier assembly including the upper minor compartment system 72 and lower major compartment system 74, means that the handle 6 does not protrude beyond the rear wall and is angled or sloped in the same angled plane as the angle of the upper lid 200.

As can be seen in the figures, the upper minor compartment system 72 is overall shaped as a wedge shaped storage volume space having a sloping upper outer surface from rear face 12 to the front face 10.

The first upper compartment 202 (see FIGS. 6, 8, 9) is located above the second upper compartment 206 and is formed as a planar shaped thin space 208 for the storage of planar items e.g., score cards having a base member 210 and side walls 212. The base member 210 has a score card clip 214 attached thereon and a writing implement storage groove 216 located on one side of the base member 210. Base member 210 also includes an end lip 218 located at a front end which is useful for prevent planar items falling off on base member 210 and for allowing easy holding with fingers. This end lip 218 also has a drainage slot formed as a break in the wall of the end lip 218. Below end lip 218 and located on the outside there is an open front slot 217 running from side to side—also can be used for loosely holding any elongate shaped accessories e.g., writing implements etc therein.

Figure 6:
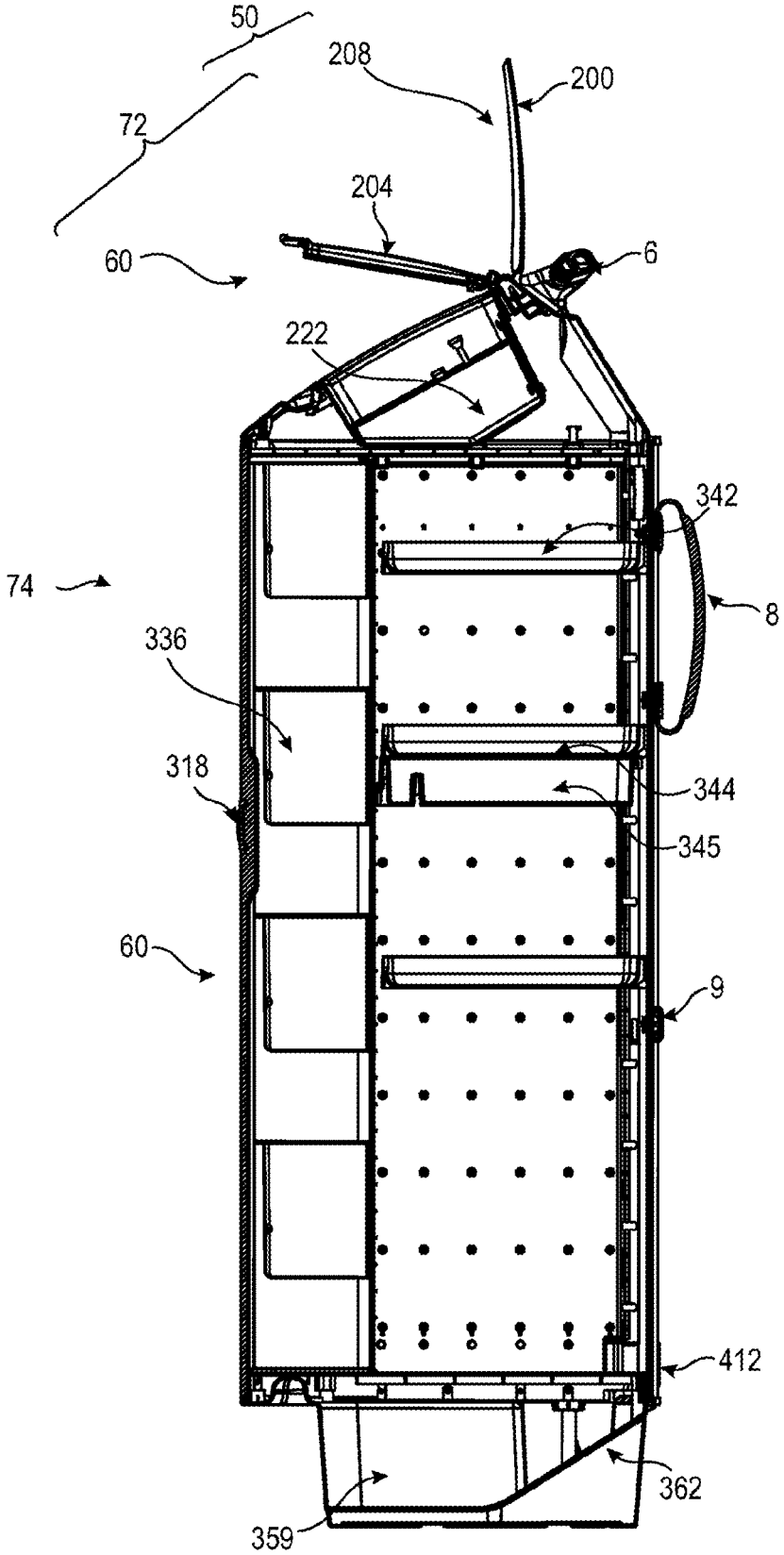
Figure 7:
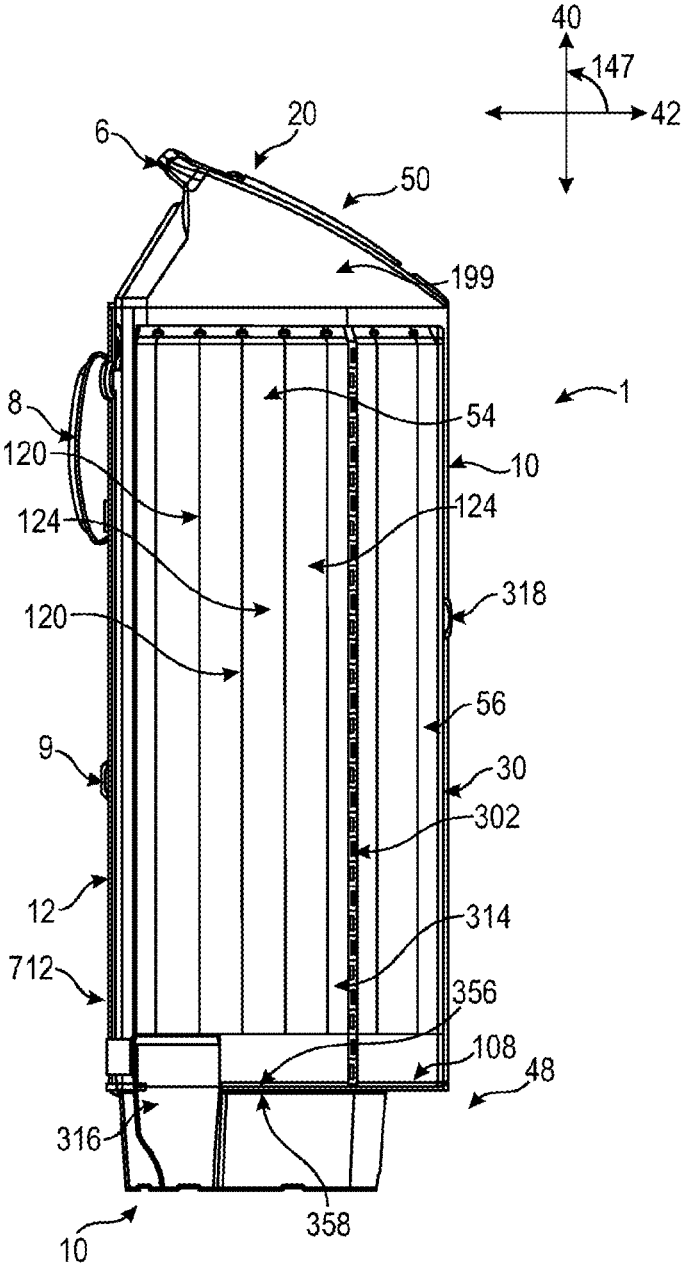
Figure 7A:
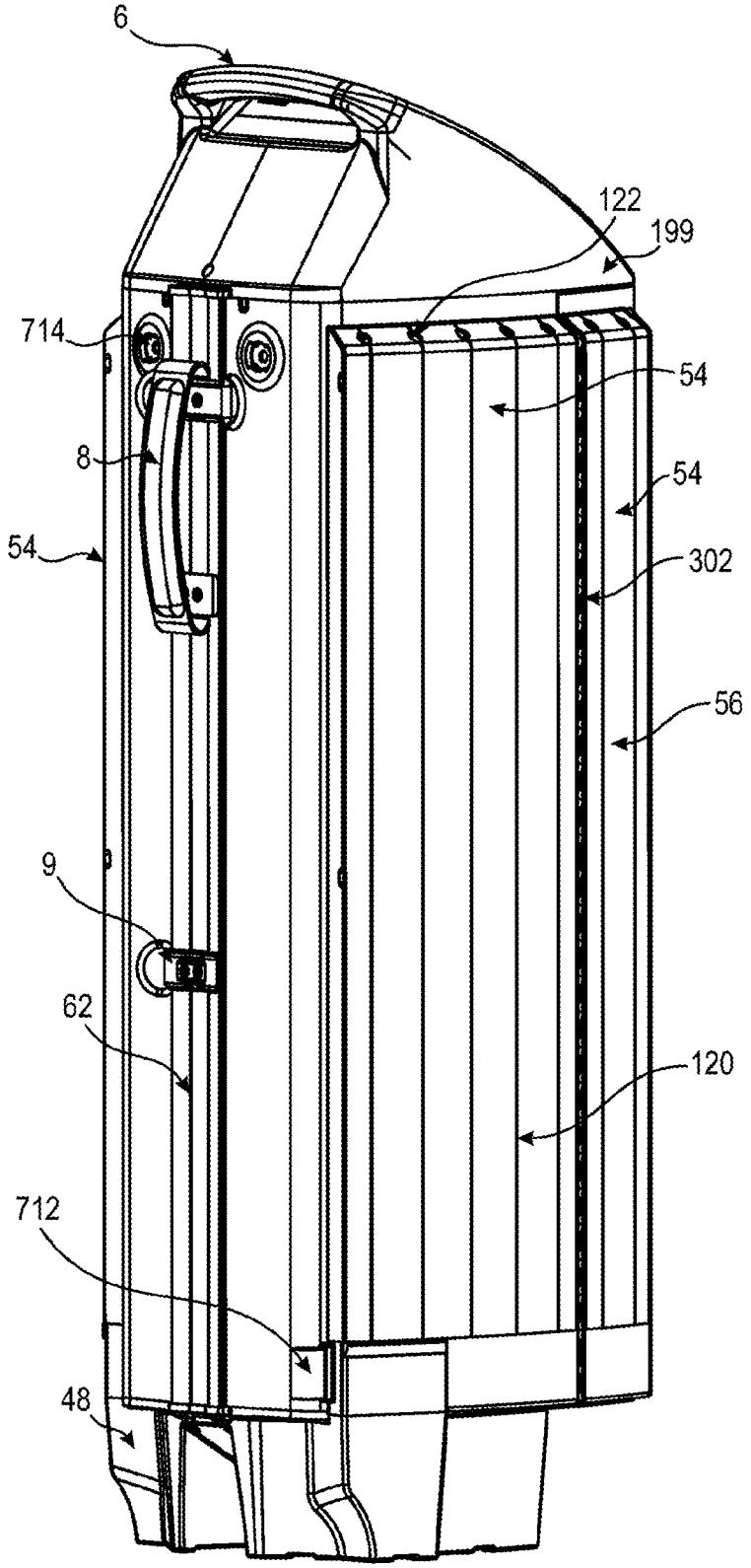
Figure 7B:
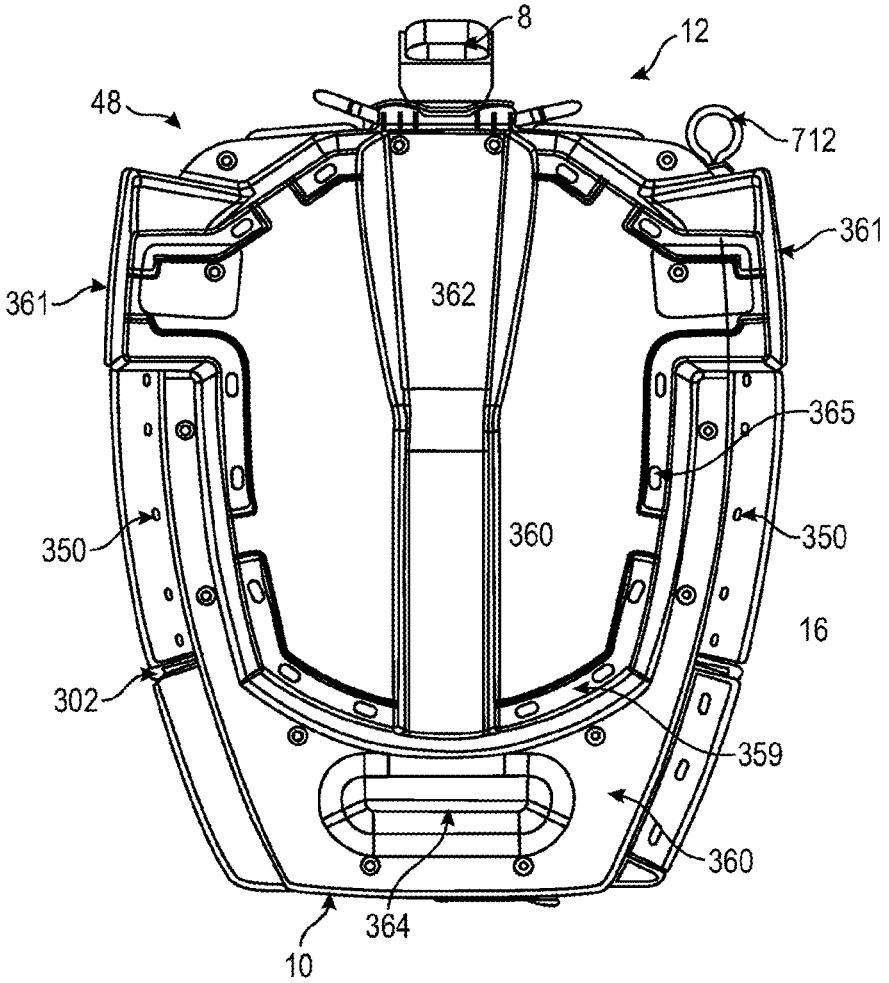
Figure 7C:
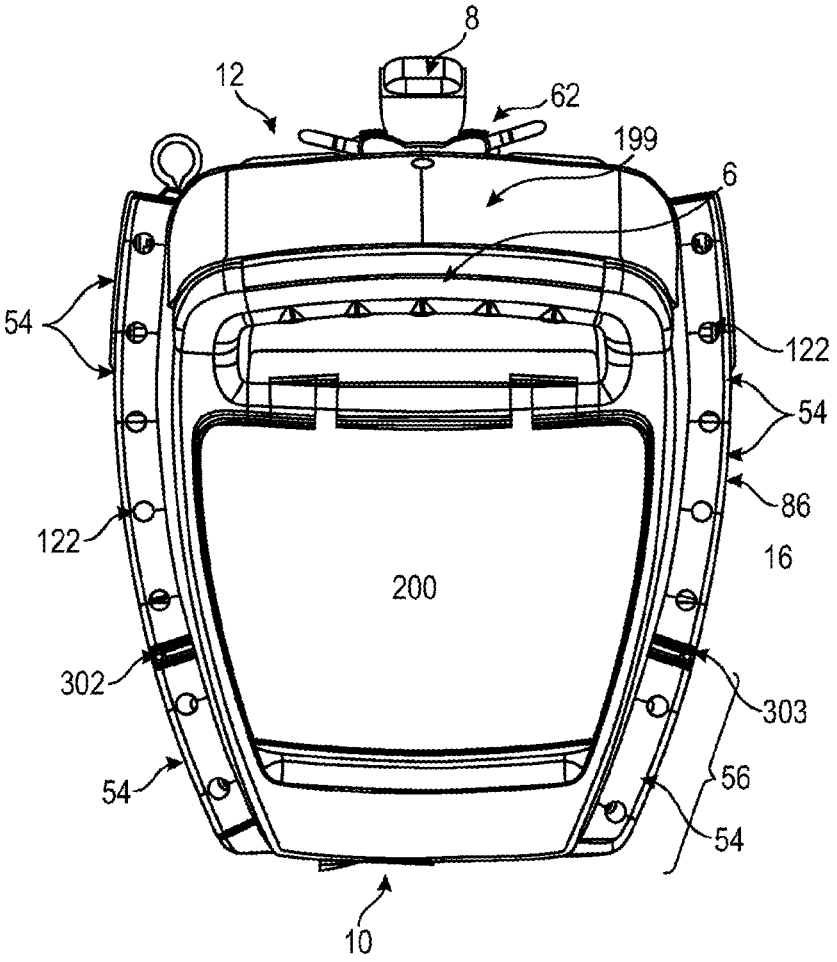
Figure 8:
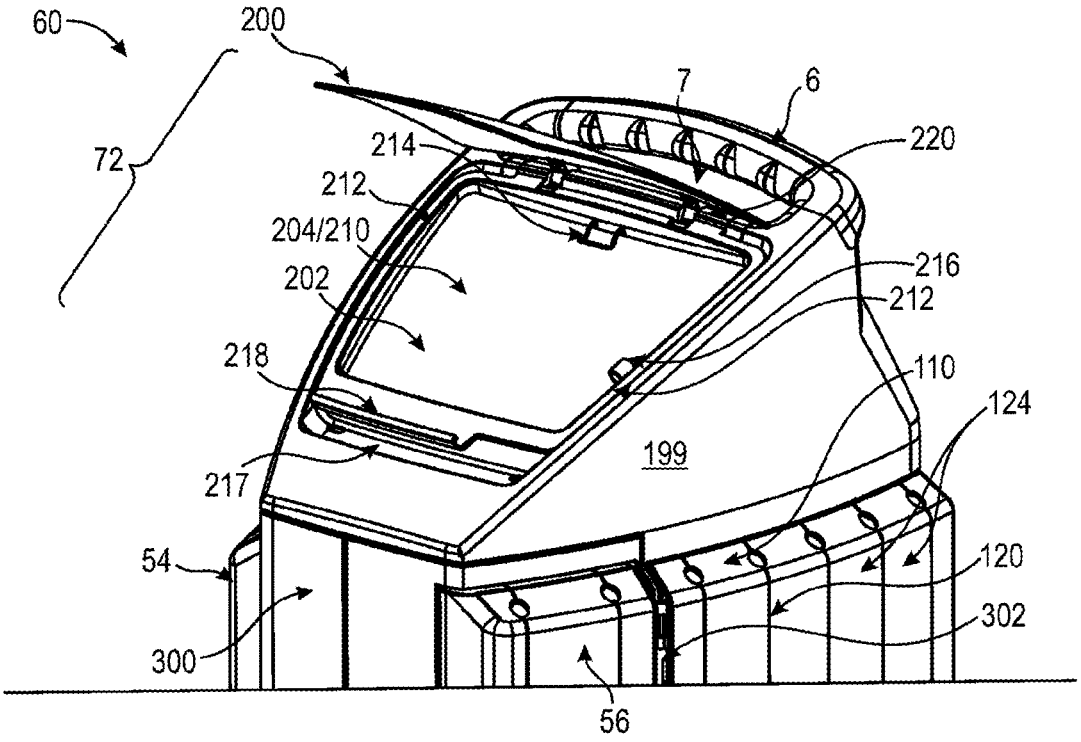
Figure 9:
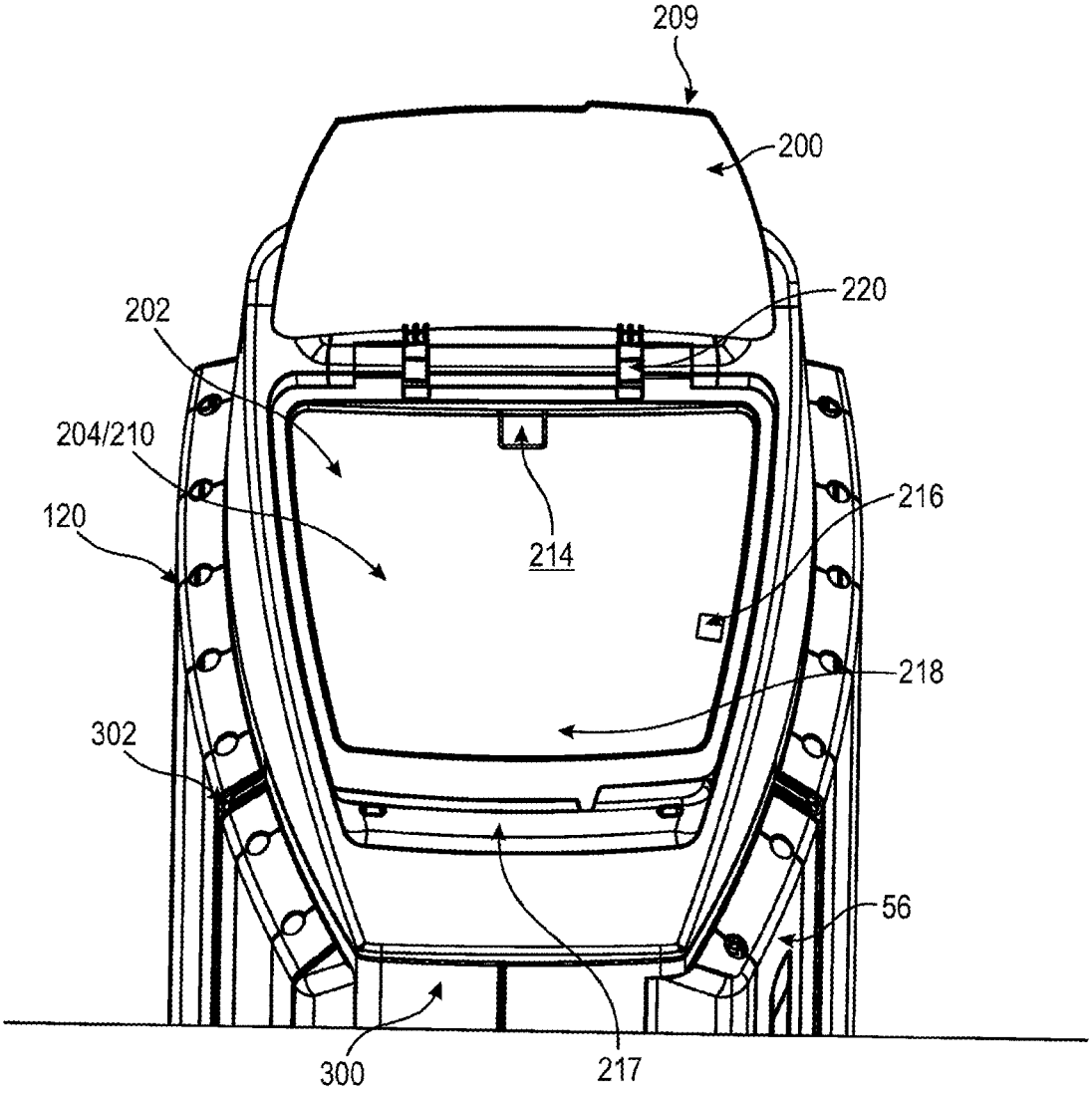
Figure 10:
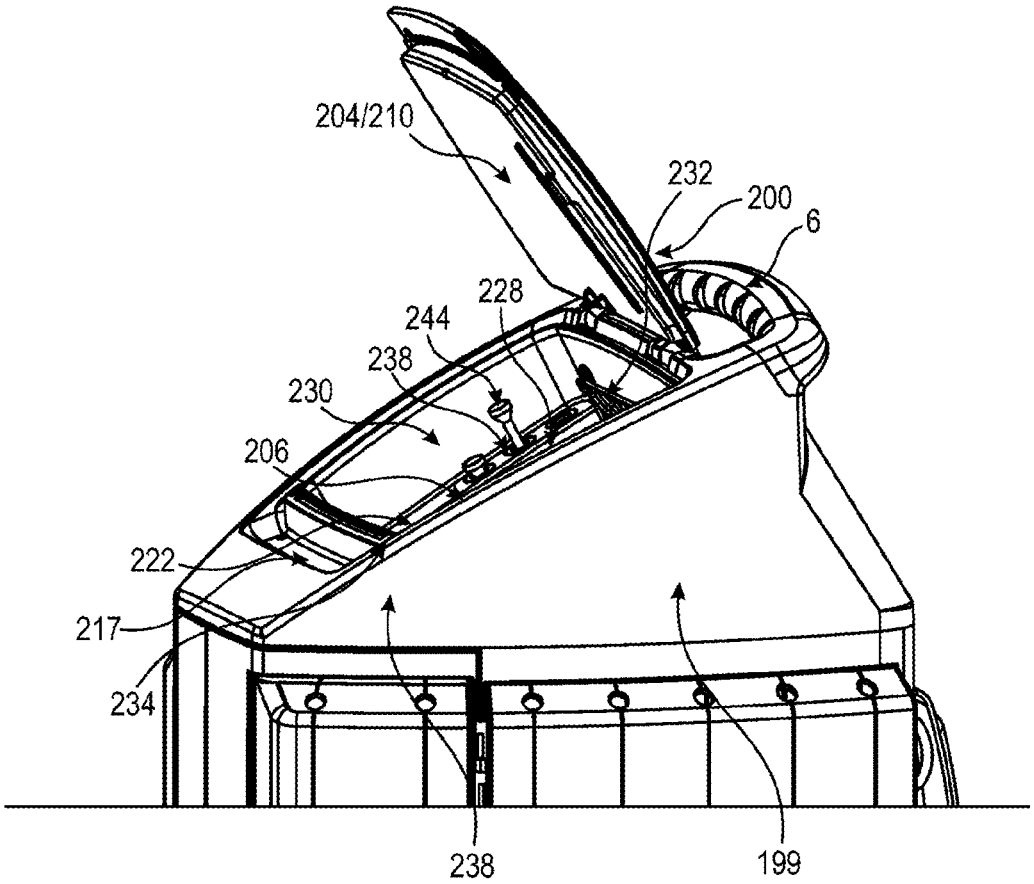
Figure 11:
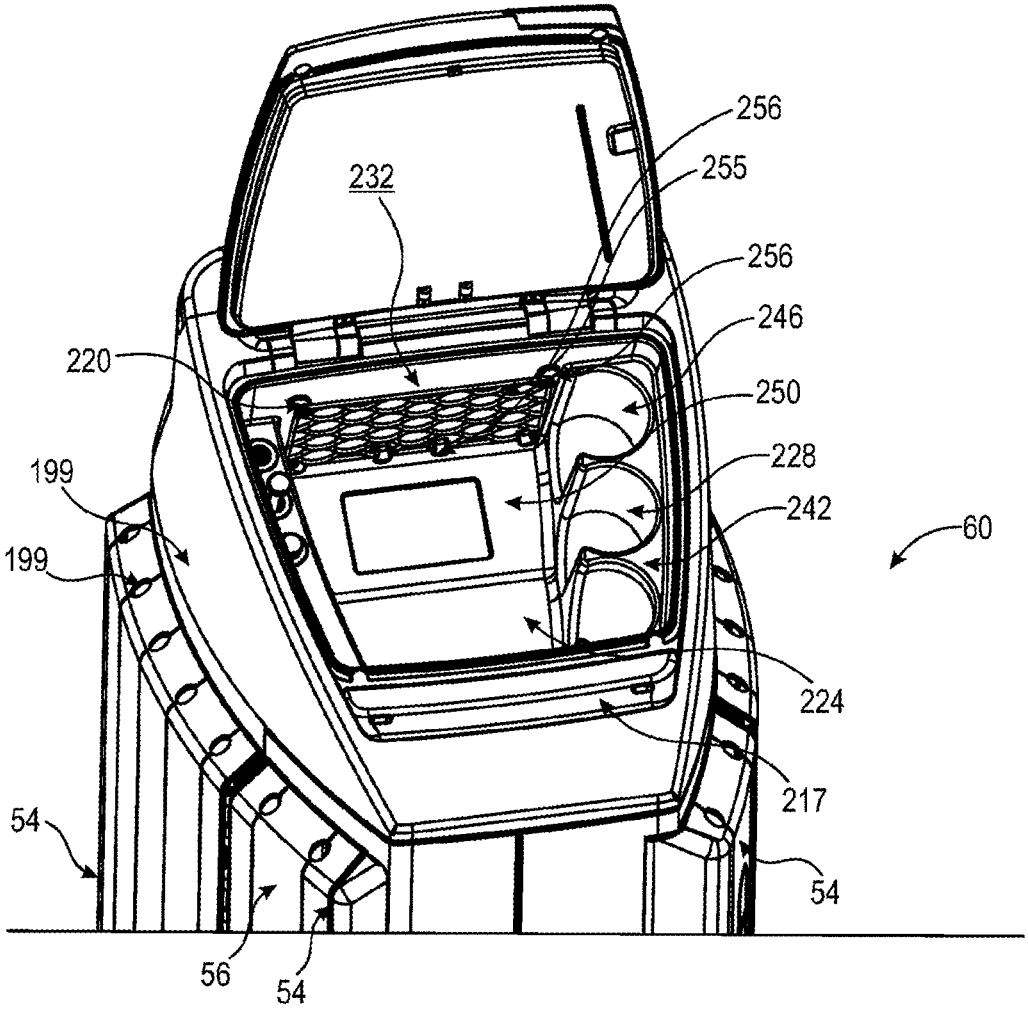

The second upper compartment 206 is located immediately below the first upper compartment 202 such that the base member 210 of the first upper compartment 202 forms the second lid 204 of the second upper compartment 206. As seen in FIG. 6, 8, 9 the first 200 and second 204 lids are both edge pivoted or hinged at the same pivot point by friction hinge (bi stable hinged or soft close) 220 at an upper rear end as seen in FIGS. 8-13, 37, 38 of the upper minor compartment system 72 just immediately in front of the handle aperture 7. The second upper compartment 206 is shown in FIGS. 9-13 as a peripherally surrounded enclosure volumetric space 222 having four planar walls joined together having a compartment floor 224 forming a roof of the lower compartment system. The walls and floor having an inner surface 228 with there being side walls 230, rear wall 232 and front wall 234.

One side wall 222 includes a plinth 240 extending between the rear wall 232 and front wall 234 taking up enough space for in line downward spaced cylindrical recesses 238 there in for removable receipt (friction fitted) of tee members 244 therein. The other side wall 230 includes a larger plinth 242 between the rear wall 232 to the front wall 234, have in line side opening slots 246 for receipt of golf balls (being a width commensurate with a golf ball diameter) there in in an end to downwardly abutting line downwardly in each slot 246. There is a space between the plinths 240, 242 formed as two storage pockets 250 (e.g., rear and front pocket of approximate trapezoidal shape) having a width dimension between plinths 240, 242, for the storage of pocket items. Rear wall 232 has a flexible or elasticated net structure 254 being corner affixed by clips 256 but spaced there from to inner surface 228 forming a generally planar storage space there between for suitable objects. At the bottom of net 254 there is a net clip[s 256. Plinth 240 is smaller in width than plinth 242 which together are much smaller in the width of the pockets 250.

The lower major compartment system 74 is a centralised storage system for storing part of carrier storage system 60 as shown in FIGS. 6, 27, 29. The lower major compartment system 74 includes wall support housing assembly 46 which has cavity 70 is formed in cross section as an approximate U shape, a roof 260 (or floor 224 from above), floor assembly 48 therein with the walls providing a front opening 71 being accessed by movably attached door assembly 52.

Following is one option of carrier assembly 1, 56 without the use of anti-rotation members which includes an elongate shaped body for holding or storing at least one elongate shaped item 2 (e.g., golf club) being in use oriented in an upright orientation. The elongate shaped body includes a wall support housing assembly 46 which includes side walls 76, 80 having a thickness between an inner surface 66 and outer surface 64 having an upper end and lower end which includes a floor assembly 48, and the side walls 76, 80 having a shape defining an internal side storage cavity there between and connectively to an outside of the side walls 76, 80. This carrier assembly includes at least one elongate shaped housing 54 in the form of an elongate shaped space 94 having a front wall 86, rear wall 76, 80, 88 side walls 92, a floor 108 shaped and configured of a volume to be able to house when in use at least one elongate item 2 therein. The front wall 86 comprising a planar member including at least one elongate slit shaped opening 120 extending continuously from at least part of the front wall 86 and the space 94 configured to removably receive a portion of the elongate shaped item 2 to be able to hold the elongate item therein. The at least one elongate item 2 is horizontally and rotationally insertable or removable from the elongate shaped space 94 through the elongate slit shaped opening 120 which flexibly parts temporally to allow this insertion and to allow for the elongate item 2 to be removably held vertically therein. The said internal side there between the housing 46, side walls 76, 80 is an internal storage space which includes an upper minor storage space and a lower major storage space wherein the upper minor storage space includes an upper planar space and a lower wedge-shaped space, and the lower major storage space includes at least one shelf accessed by at least one door. The opening 122 in the roof 110 assists in holding the elongate item within the space 94 of each housing 54 with or without the anti-rotation members. Furthermore, this option can also include yet another option of the carriers 1, 56, without the upper and lower storage areas.

The door assembly 52 includes at least one door 300 located at the front face 10 of the golf carrier assembly 1, elongate side hinge 302 and door storage. In this example, there are two doors 300 each being formed of an elongate body shape having an approximate L shaped cross section and each hinged by their own elongate vertical side hinge 302 to the housing assembly 46.

The elongate body of each door 300 has a shape that includes a top end edge 310, a bottom end edge 312 forming a height distance there between, a hinge side edge 314 and a non-hinged side edge 316, whereby the elongate body has an outer surface 320 and inner surface 322. The L cross section having hinge arm portion 326 and distal arm portion 328, forms an inner space 332 between the arm portions 326, 328 for mounting the door storage there between. Hinge side edge 314 is attached by side hinge 302 to one side pillar 71*a* of each side of opening 71.

Door assembly 52 includes a door latching mechanism including in this example an operating pivoting lever member 318 is located in a recess 319 in one door 300 and lever landing member 324 in another recess 325 in the other door 300 whereby the lever 318 is articulated (has an articulated folded arm underneath) is end pivoted or hinged on or near the door edge and is hinged to be extendable across to the landing member 324 to lock the doors 300 together. One door has the pivoting lever member 318 having a distal latch end and the other door 300 which lever landing member 324 having a latch in such a combined configuration which when closing the doors, this enables the pivoting lever member 318 to be extended by the articulated arm to extend its latch over to the latch or hook over of the lever landing member 324 to latch or interlock together and then fold the lever and arm together, whereby when the doors 300 are to be opened, the pivoting lever member 318 is levered to rotate out of latching engagement extending the lever and arm, to the open the doors.

Door storage includes door pockets 336 which comprise open pockets having a recessed front wall e.g., there are four door pockets 336 oriented vertically spaced therefrom each other on each inner surface 322.

On the outer surface 320 of one door 300 there is located part of the elongate shaped item housing 54 as a non-removable part of the golf carrier assembly and on the outer surface 320 of the other door 300, there is the outer recess 68 which is adapted and configured to removably receive the removable housing of portable carrier assembly 56.

Figure 22:
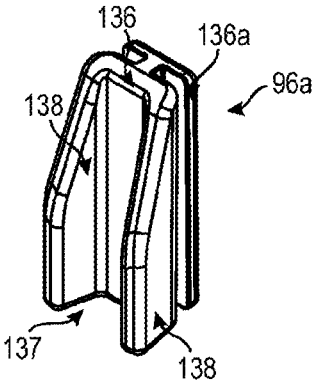
Figure 23:
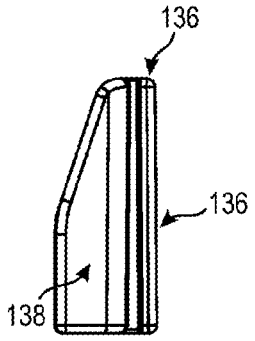
Figure 38:
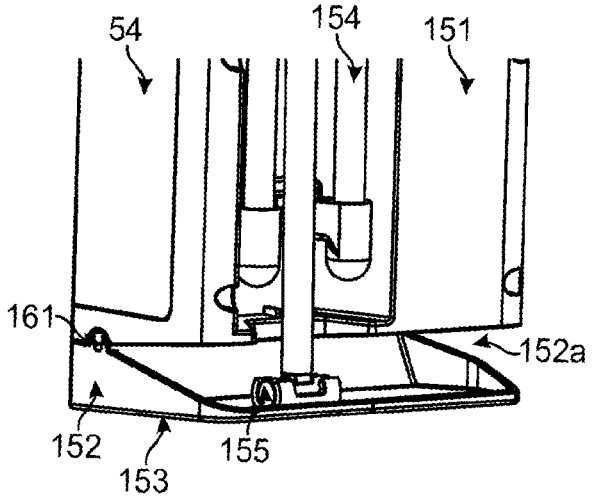
Figure 39:
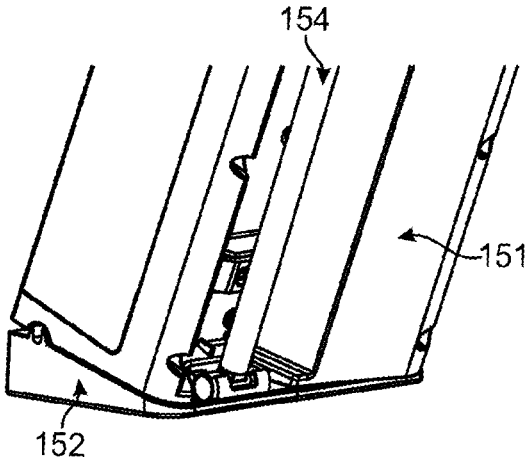
Figure 40:
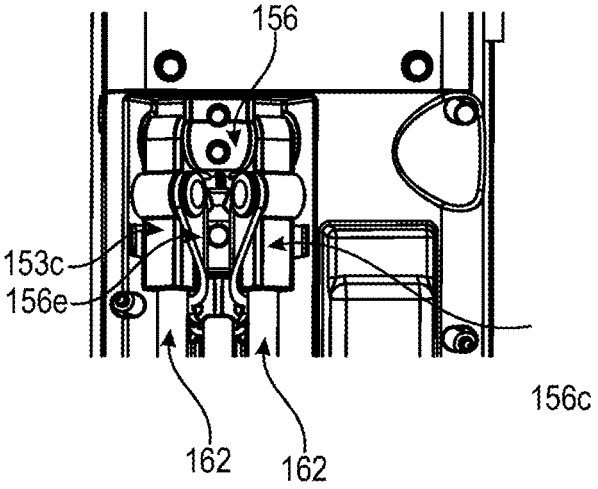

Side hinge 302 as see in FIGS. 15, 23 and 38 in this example extends the entire side edge 314 distance between top end edge 310 and bottom end edge 312 and comprises leaves 304, knuckle 306 and hinge pin 308, from each side from side edge 314 to the pillar 71*a*. As shown in FIG. 22 each door hinge 302 operates with a door in combination with a door opening constraint mechanism 340, whereby the door is prevented in opening outwardly too far towards the elongate shaped item housing 54 as attached to the housing assembly 46 i.e., the door is prevented from abutting the pillar 71*a* and elongate shaped item housing 54. Door opening constraint mechanism 340 comprises a protuberance located on a top end edge of pillar 71*a* being shaped to provide abutment to the door to causing it to be angled away from the pillar 71*a* and elongate shaped item housing 54.

The use of the door(s) 300 with pockets 336—and not zips, aims to provide further storage which is both easier to view and easier to access all stowed gear. Another big advantage of these doors 300 is that they can be centrally opened, secured and locked—see item 450 in FIGS. 15, 16. As seen in FIG. 23, the door hinge 302 is shaped to provide strength and robustness of use in all weathers to fit in with the clean lines of the doors (not interfering with door storage), and includes as seen in FIG. 23 three components i.e., the leaves 304, knuckle 306 and hinge pin 308. The leaves 304 are elongate shaped plates located on each side of the centrally located knuckle 306. The knuckle 306 includes inter-meshed finger portions extending from each door 300 on opposing sides of the hinge providing a vertically aligned aperture for the hinge pin 308 e.g., stainless steel metal rod. Each hinge 302 enables each door 300 to rotate to its fullest extent e.g., almost 180 degrees.

The lower major compartment system 74 for storing part of carrier storage system 60 includes another part of the carrier storage system 60, as shown in FIGS. 6, 27, 29. This part includes several spaced fixed shelves 342 and at least one removable or sliding tray member 344 (see FIG. 29) located within storage cavity and being edge slidably mounted in track members separately mounted or integrally formed in an inner surface of side walls of the cavity 60. Each storage tray/shelf 342, 344 includes a planar floor with peripheral wall 346, and drainage outlets 350—see FIG. 29, and fixing holes 352 in inner surface of side wall. In this example, there are three spaced tray members between a roof (i.e., base of second upper compartment) and floor 356 (roof of floor assembly 358).

The floor housing 48 which provides both a floor as a base for lower compartment system 74 and a roof the floor assembly 48 extends or protrudes beyond the front of the storage cavity having shelves which enables the doors 300 with their own storage system to close and be outwardly flush with the protruding front end of the floor or roof of the floor assembly 48.

In yet another embodiment as related the invention can include a carrier assembly 1, 56 which is an elongate shaped body for holding or storing at least one elongate shaped item being in use oriented in an upright orientation. The elongate shaped body includes a wall support housing assembly 46 which includes side walls 76, 80 having a thickness between an inner surface 66 and outer surface 64 having an upper end and lower end which includes a floor assembly 48.

The side walls 76, 80 have a shape defining an internal side storage cavity there between and connectively to an outside of the side walls 76, 80 includes at least one elongate shaped housing 54 in the form of an elongate shaped space 94 having a front wall 86, side walls 92, a floor 108 and the front wall 86 comprising a planar member including at least one elongate slit shaped opening 120 extending continuously from at least part of the front wall 86.

The space 94 is configured to removably receive a portion of the elongate shaped item to be able to hold the elongate item therein. The at least one elongate item is horizontally and rotationally insertable or removable from the elongate shaped space 94 through the elongate slit shaped opening 120 which flexibly parts temporally to allow this insertion and to allow for the elongate item to be removably held vertically therein.

The said internal side there between the housing 46, side walls 76, 80 is an internal storage space which includes an upper minor storage space and a lower major storage space wherein the upper minor storage space includes an upper planar space and a lower wedge shaped space and the lower major storage space includes at least one shelf accessed by at least one door.

Floor Assembly 48 FIGS. 1-3, 5-7

Floor assembly 48 includes a planar shaped box like housing oriented generally in a horizontal plane, including roof member 358 supported and connected by support walls 359 and a floor 360 to form a fully enclosed housing space therein in the shape of a U with side outwardly directed wing portions 361. Floor 360 is a planar shaped member in use abutting the substrate 4. Roof member 358 comprises a planar member extending beyond the walls 359 to form a peripheral overhang strip in a U shape. The wing portions 361 are recessed enclosed spaces volume connected upwardly to some of the rear elongate shaped spaces 94 (i.e., two on each side) to allow for longer elongate items 2 or golf clubs to be locked downwardly therein.

The floor assembly 48 is sized in area and depth to fit into a back of a golf cart to allow it to be located and then strapped into place.

In the overhang portion of the roof 358 there is also provided an elongate bottom handle recess 364. Support walls 360 include a wheel housing recessed space 362 to allow at least a portion of first rotating apparatus 366 (e.g., at least one front wheel) of the trundler apparatus 58, to be at least partially housed therein and be able to rotate there through to be ready for use.

The end of the walls 359 meet the floor 360 to cause the floor 360 to be recessed inwardly therefrom e.g., 2-3 mm. The overhang also includes a bottom/floor 356/108 of the lower storage 70, 68 above and of elongate shaped item housing 54 being peripherally located there around.

Accessories

Figure 1:
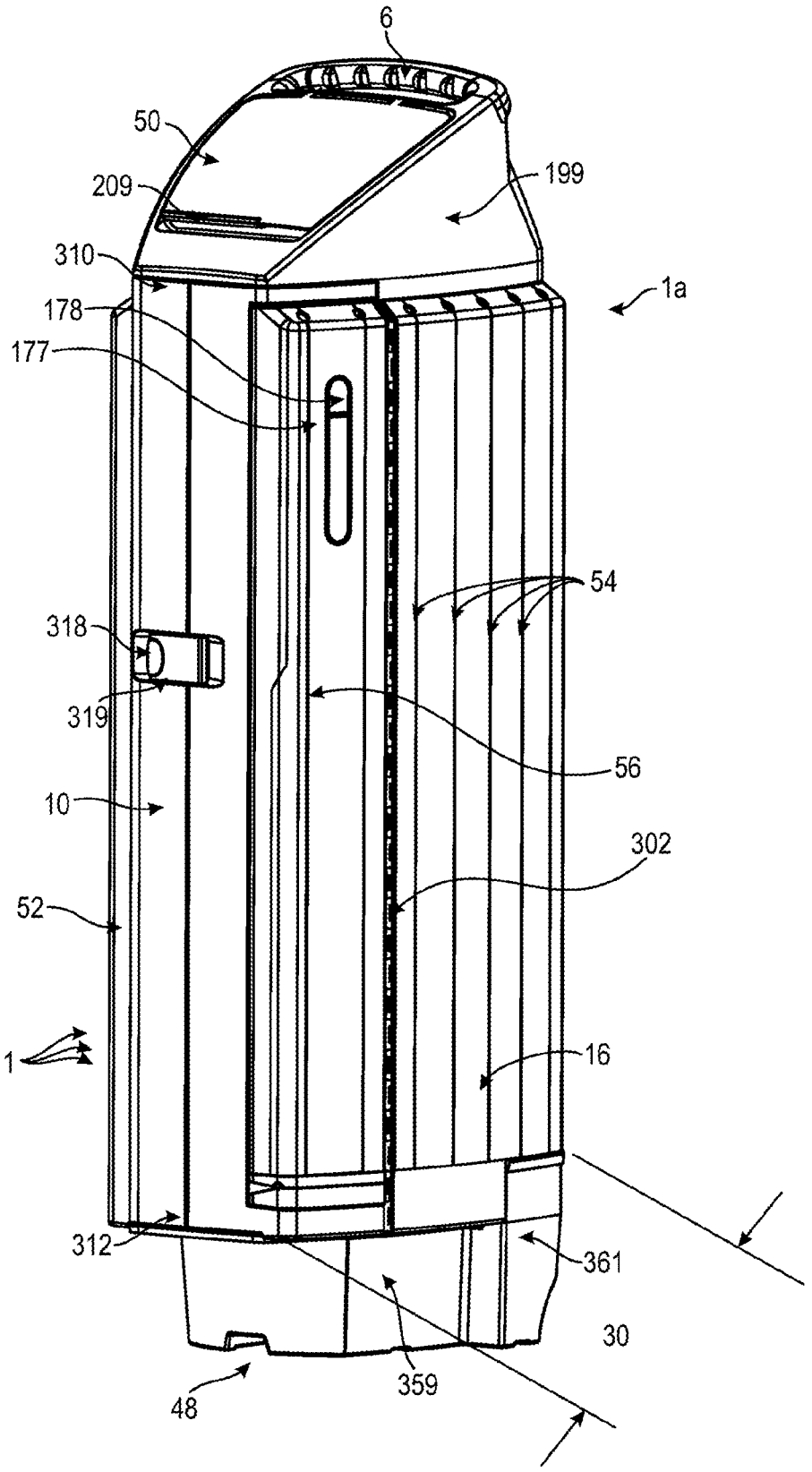
As shown in FIGS. 1-64, the carrier assembly 1 of the present invention includes an elongate shaped body 1*a* anthropometrically shaped to provide storage for at least one elongate shaped item 2 such as a golfing item such as for example a golf club 2 therein (see FIG. 56), for resting on a substrate 4 e.g., ground, floor or platform to be self-supporting.
Figure 2:
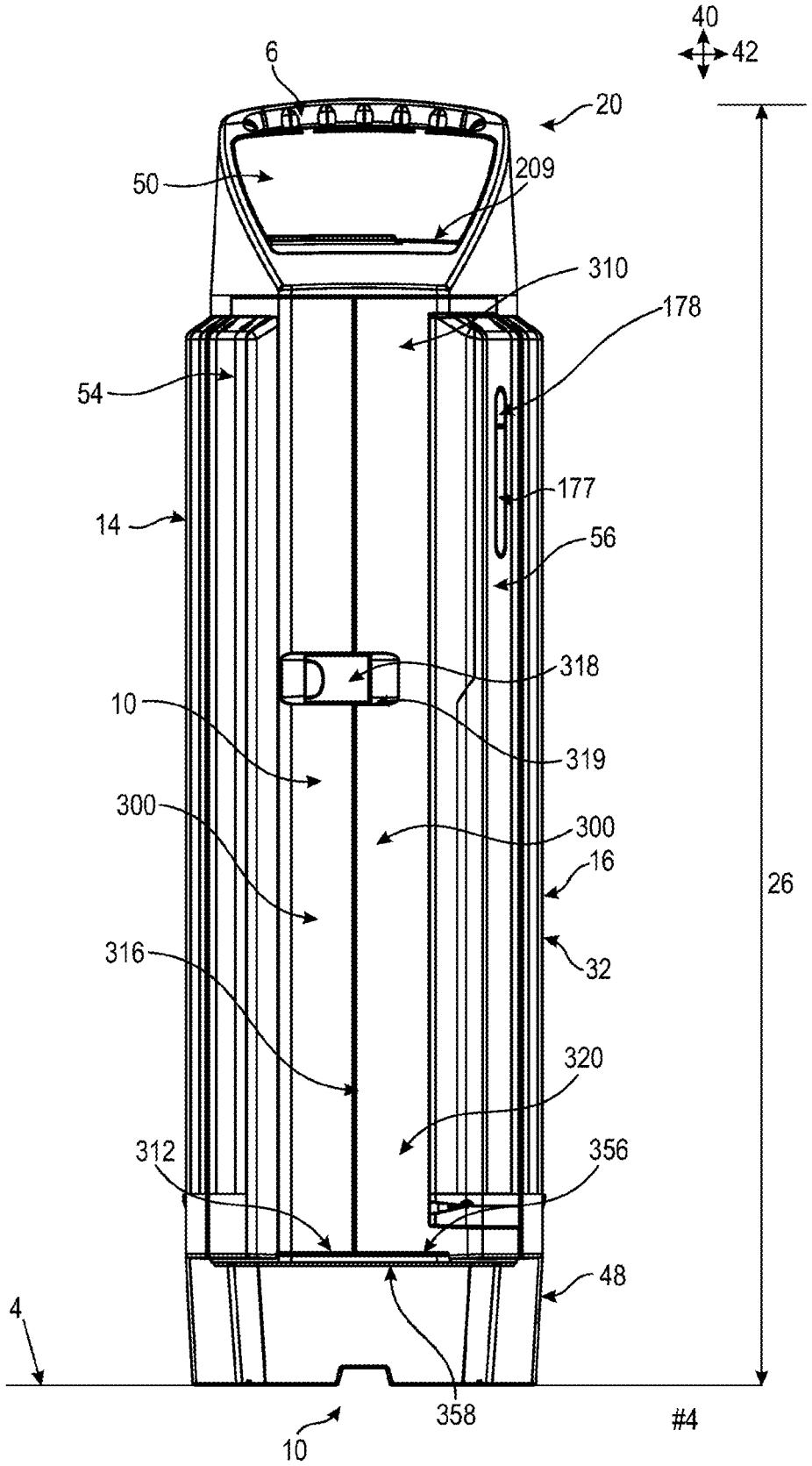
Figure 3:
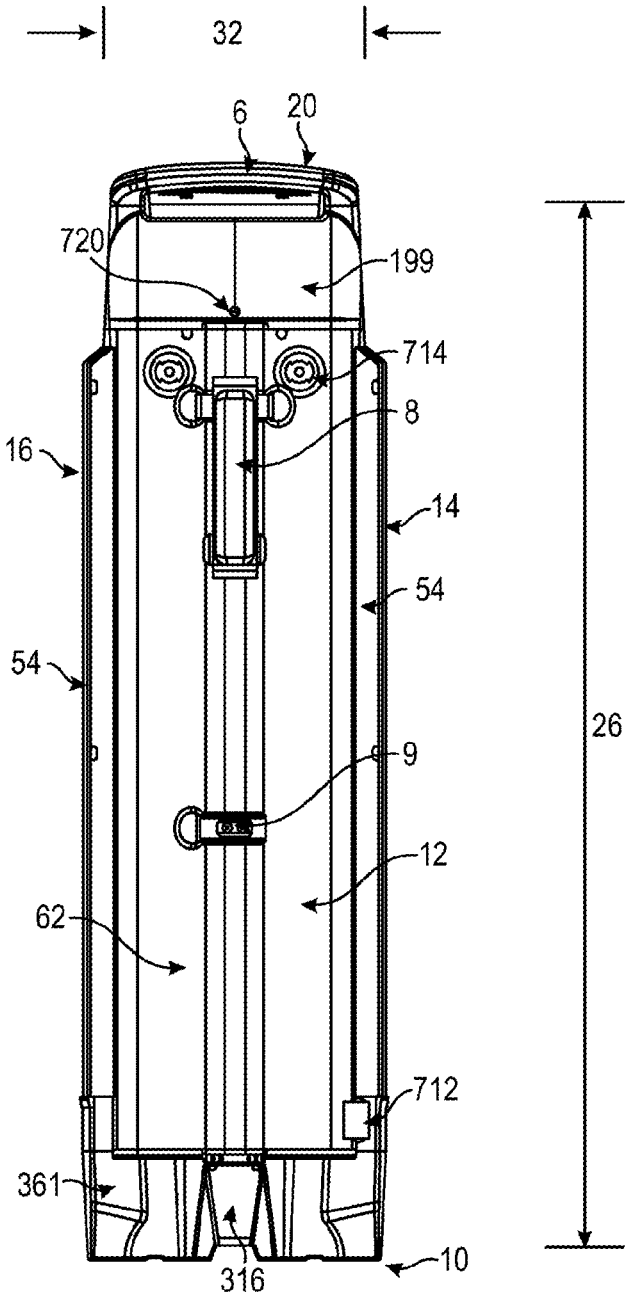
Figure 4:
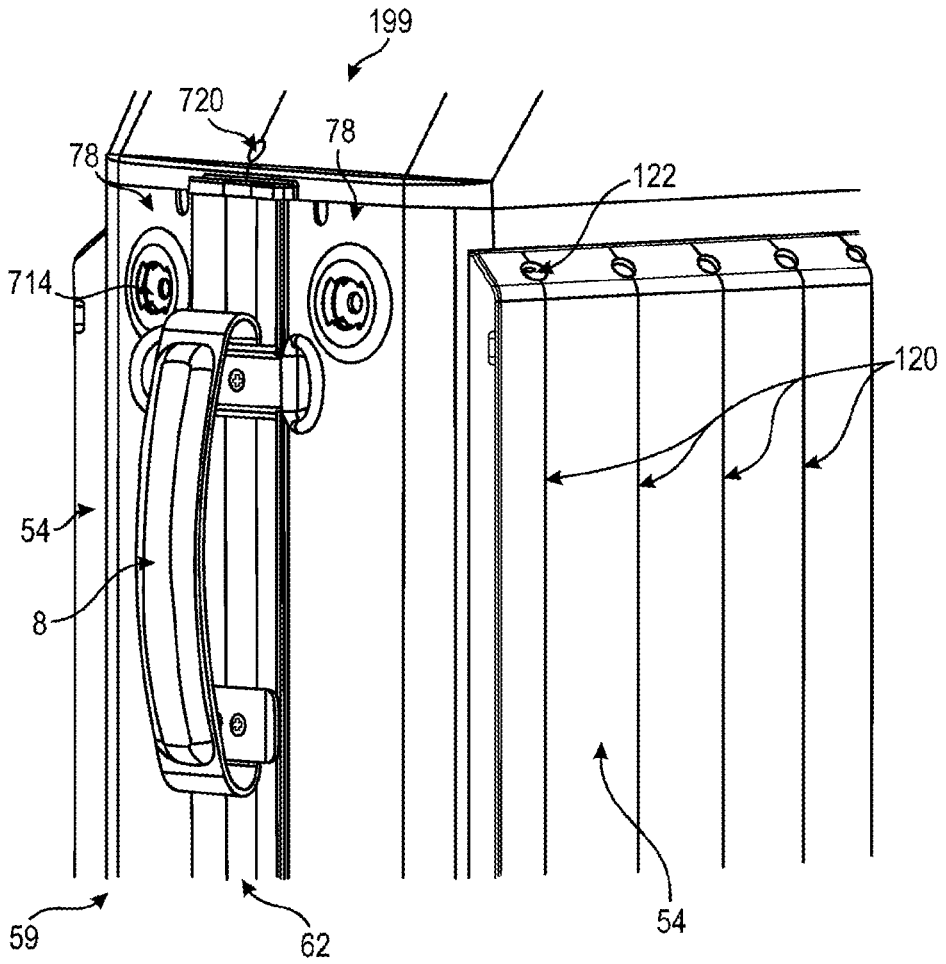
Figure 5:
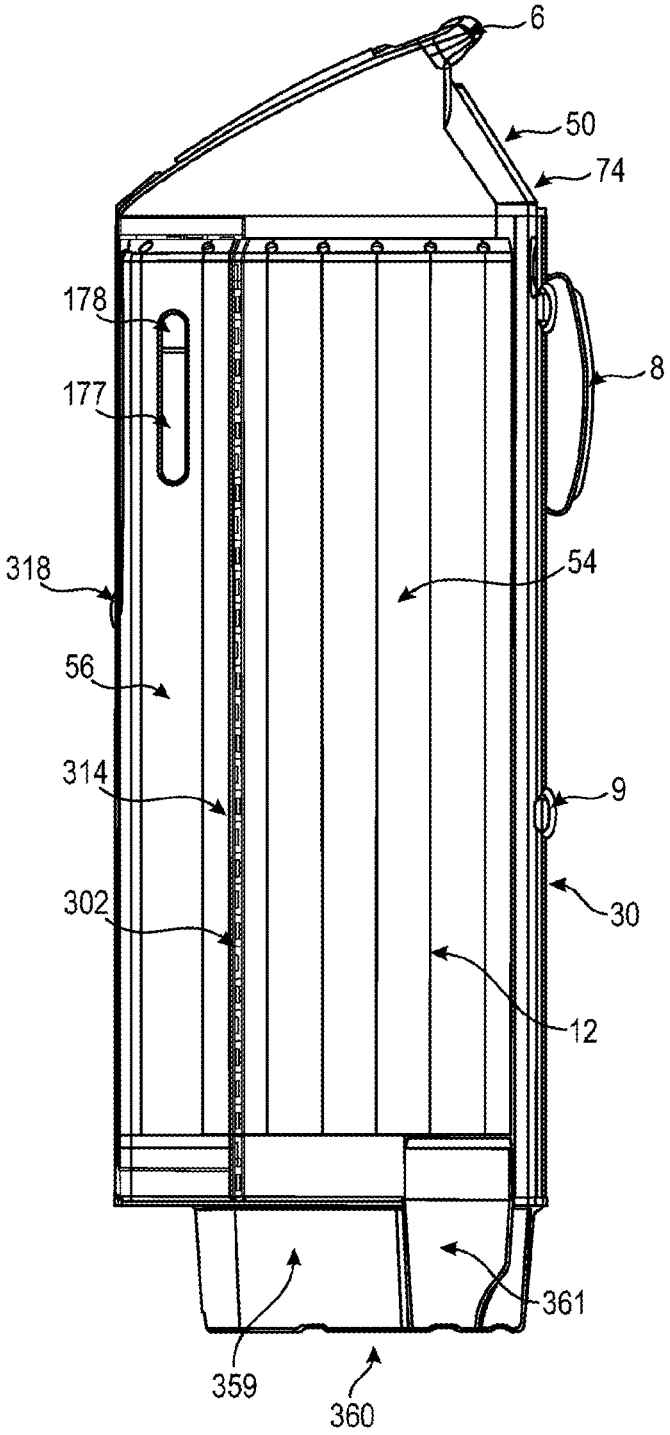
Figure 5A:
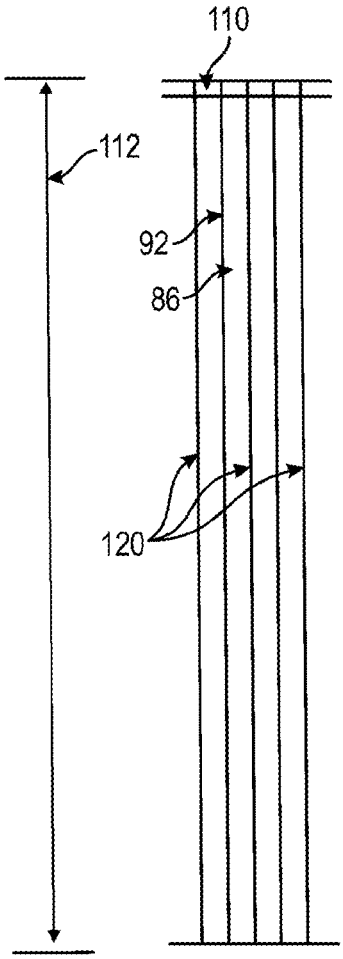
Figure 5B:
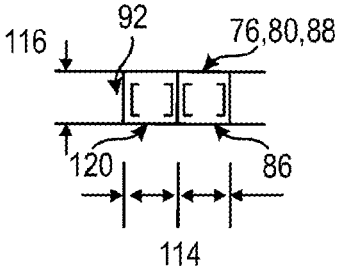
Figure 60:
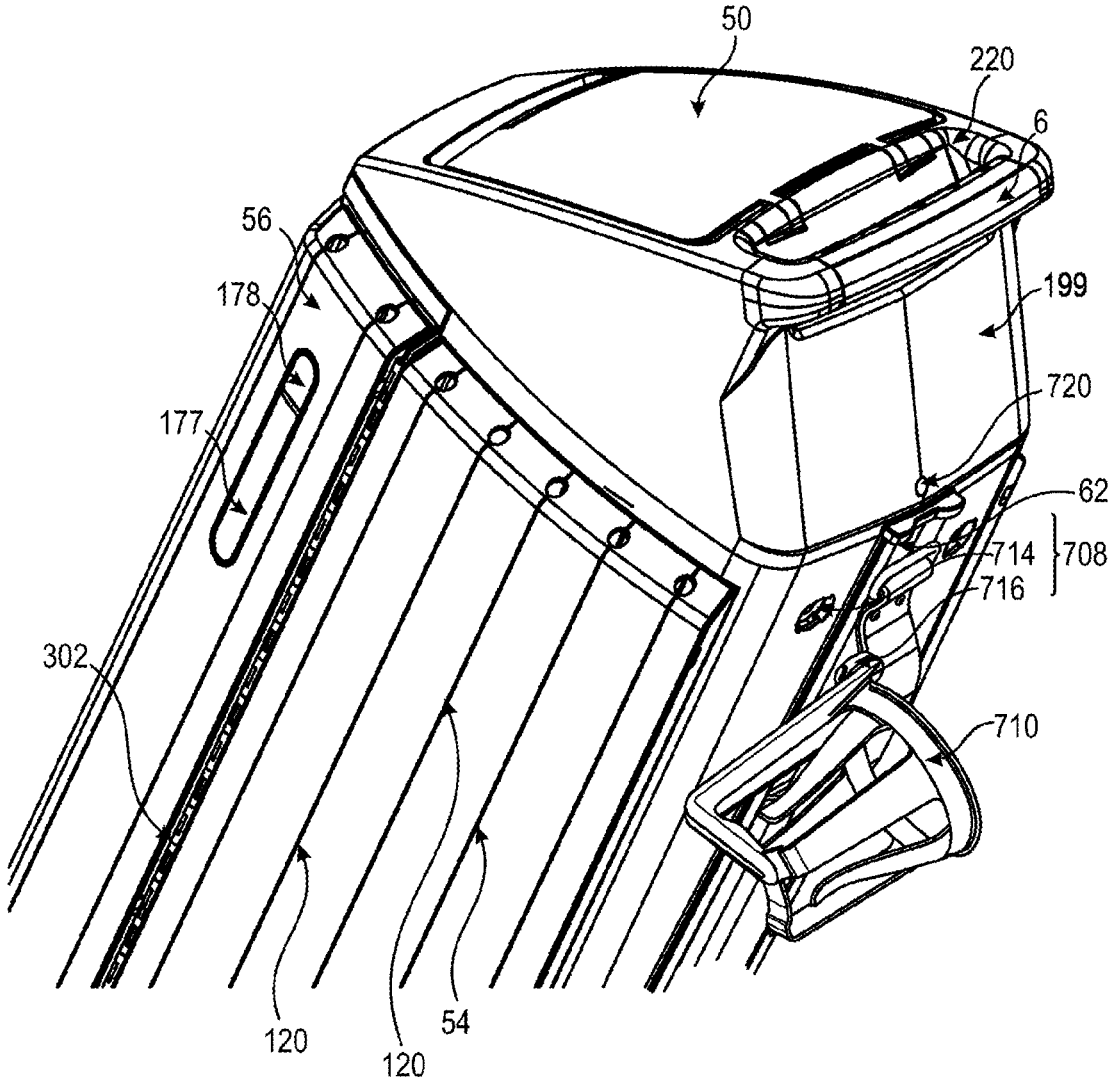
Figure 61:
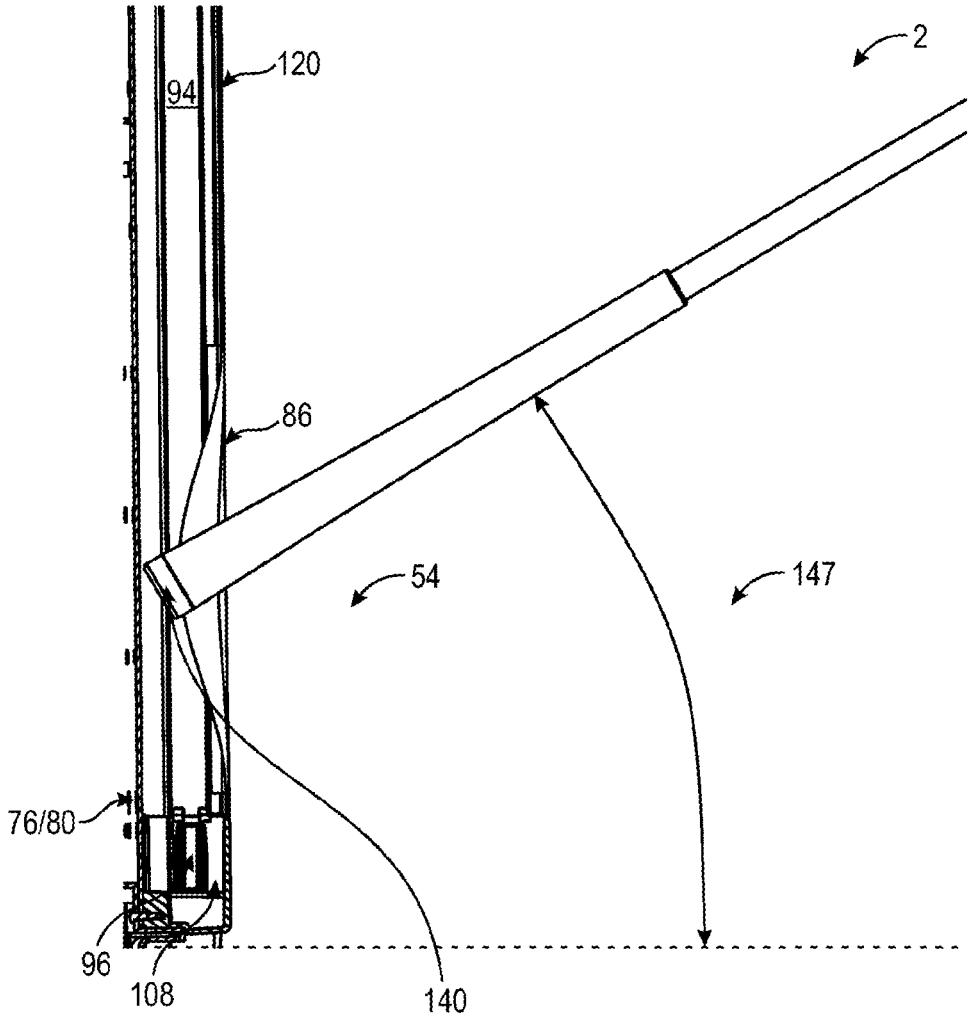
Figure 62:
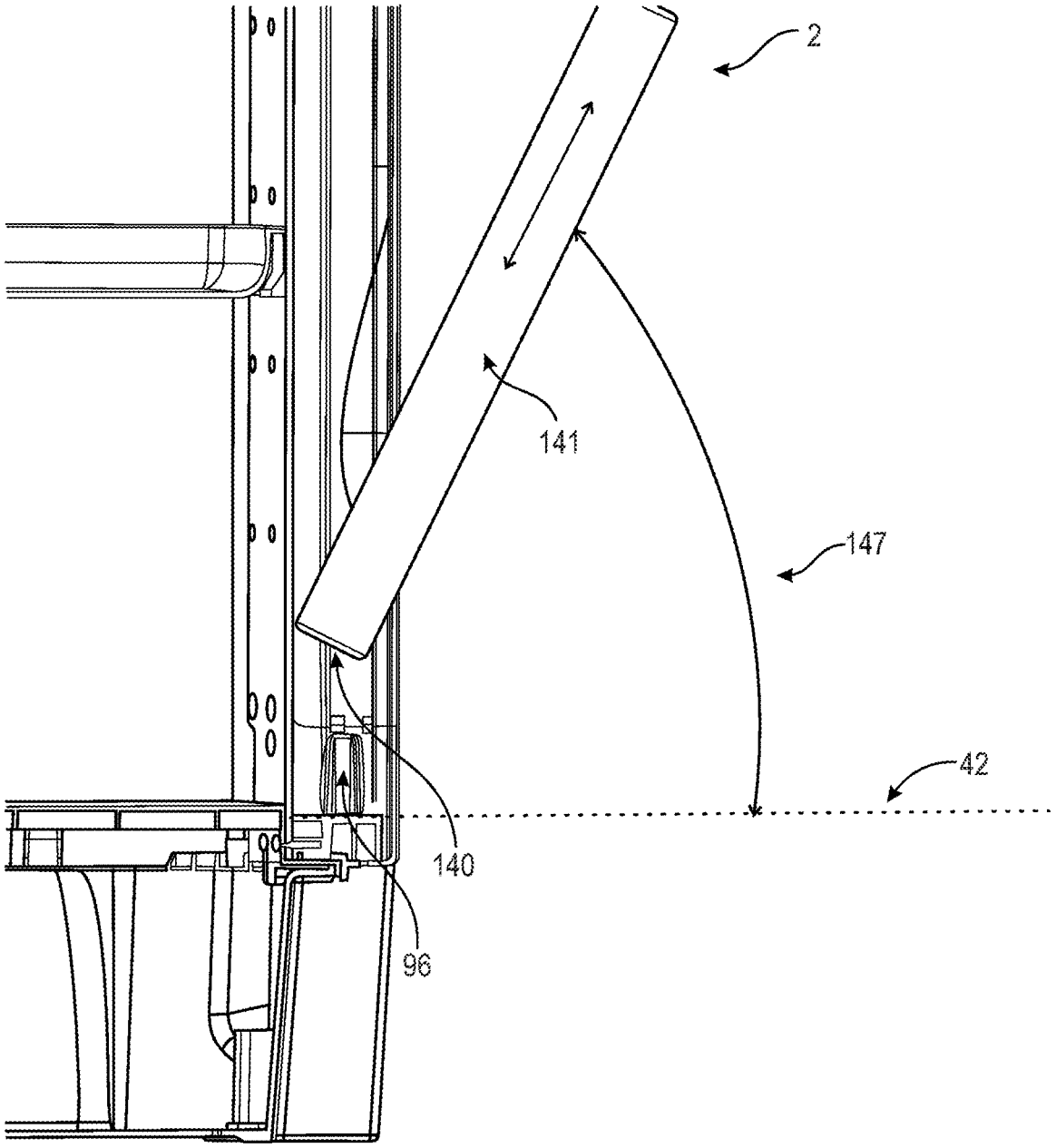
Figure 63:
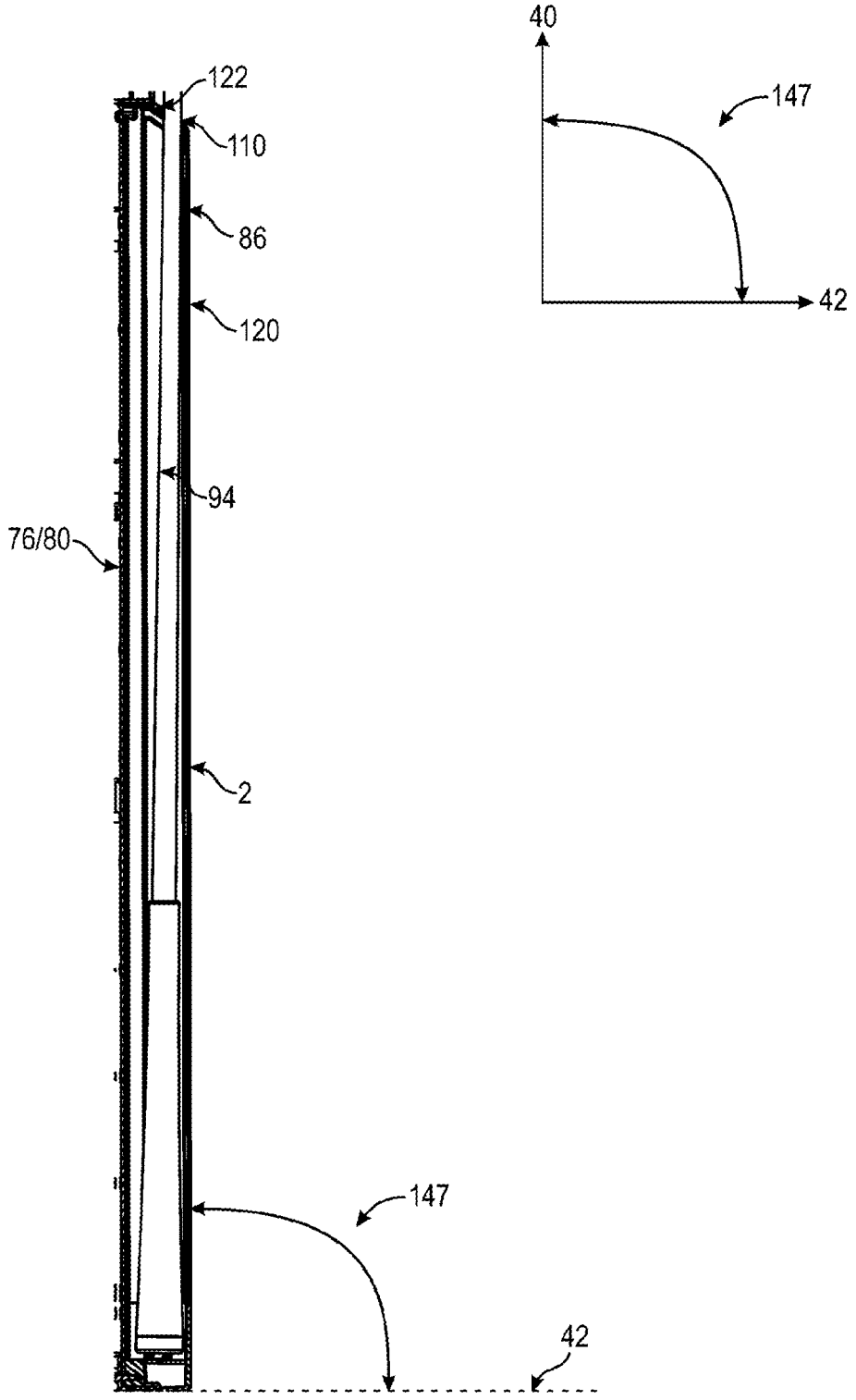

Twist locks 708 (see FIGS. 59, 60) are used where appropriate to removably hang and/or attach any suitable accessories such as for example a cup holder 710 as seen in FIG. 60 38 or an umbrella holder 712 as seen in FIG. 3. Twist locks 708 include a male to female insertion or withdrawal action combined with a twisting or rotation to lock or unlock thereby including a female part 714 and a male part 716. In this example, the female part 714 includes a female socket part which can be provided anywhere suitable or convenient in the wall housing assembly 46 of the carrier assembly and the male part 716 can be provided outwardly of the accessory-see FIG. 59 or vice versa.

Other accessories include motive means including wheeled assemblies and a trundler apparatus which can include its own separate carrier assembly with shoulder strap(s). Further optional accessories include a wet weather canvas bag, lunch box, umbrellas, canvas or leather hat for the carrier and towels, pitch repair kits, water bottles, and extra handles, straps and hooks for removable attachment to the rear of the carrier, to allow removable attachment to a golf cart, trundler and for carrying and removable attachment of the accessories (e.g. back pack) via hooks on the bracket attached to the rear of the carrier. By placing housings on the exterior sides of the carrier assembly the golf clubs can readily be removed from the carrier assembly whether it is free standing or supported on or in a trundler.

The apparatus also includes a portable device holder socket 720 for removable attachment of a mobile phone or camera holder. The socket can be placed anywhere convenient on the assembly 1, e.g., behind and below handle 6 but above the support member 62 see FIGS. 59+, 60.

Yet other options include providing lighting e.g., led's which can be fixed and/or portable and in removable portions useful a torch.

Parts Schedule
- Feature Number
- Golf carrier assembly 1
- Elongate shaped body 1*a*.
- Golf club 2
- Substrate 4
- Carrier handle 6
- Handle aperture 7
- Strap supporting member 8
- Front face 10
- Rear face 12
- Left side 14
- Right side 16
- Base 18
- Top 20
- Height 26
- Depth 30
- Width 32
- Length 34
- Vertical plane 40
- Horizontal plane 42
- Wall support housing member 46
- Floor assembly 48
- Lid assembly 50
- Door assembly 52
- Elongate shaped item housing 54
- Portable carrier assembly 56
- Carrier storage system 60

Wall Support Housing Assembly 46
- Rear support member 62
- Strap Bracket 8
- Planar base 63*a*
- Horizontal slots 63*b*
- Side edges 63*c*
- Lip 63*d*
- Vertical aperture 63*e*
- Side posts 63*f*
- Landings 63*g*
- Outer surface 64
- Inner surface 66
- External recess 68 (for portable carrier assembly 56)
- Internal storage cavity 70
- Front opening 71
- Side edge pillars 71*a*
- Upper minor compartment system 72
- Lower major compartment system 74
- Left side wall 76
- Rear wall 78
- Right side wall 80

Elongate Shaped Housing 54
- Outer planar front wall 86 (e.g., rubber)
- Rear inner planar wall 88
- End side walls 92
- Elongate shaped space 94
- Anti-rotation member—mid member 96
- Anti-rotation member—first end member 96*a*
- Anti-rotation member—second end member 96*b*
- Anti-rotation spacer member 96*c*
- Lattice Floor panel 98
- Floor 108
- Roof 110
- Height 112
- Width 114
- Depth 116
- Elongate slit shaped opening 120
- Circular aperture 122
- Cut sides 124
- Tongue edge 126
- Slotted edge 128
- Base 136, recess 137 and Arms 138 (of anti-rotation members 96)
- T base 136*a*, bridge 136*b*
- Golf Club
- Ends 140
- Grip 141, a shaft 142 and a club head 144
- Angle of rotation of a golf club with respect to the horizontal and vertical planes 147

Portable Carrier Assembly 56
- Support stand apparatus 150
- Rear Housing 151
- Wedge shaped gap 152*a*
- Push plate 152
- Gripping means 153
- Push pull elongate member 154
- Push rod holding clip 155
- Trunnion 156
- Rotation R1
- Rotation R2
- Rotation R3
- Rotation R4
- Trunnion recess 157

Trunnion Mechanism
- Central base 156*a*
- Angled arms 156*b*
- Leg end caps 156*c*
- Push rod end cap 156*d*
- Link arms 156*e*
- Pivot pins 156*f*
- Pivot sleeves 156*g*
- T section end member 156*h*
- Front face 158
- Rear face 159
- Push plate recess 160
- Push plate pivot 161
- Tab members 161
- Leg members 162
- End pivot 164
- Storage box 166
- Camera mounting 167
- Pleated magnetic towel
- Towel recess 170
- Holding system
- Latch 174
- Handle recess 177
- Handle latch 178
- Indentation 198 this is not in FIGS. 17-20

Upper Minor Compartment System 72
- Housing walls 199
- First lid 200
- First upper compartment 202
- Second lid 204
- Second upper compartment 206.

Planar space 208
Lower end tab portion 209
Base member 210
Side walls 212
Score card clip 214
Writing implement storage groove 216
Front slot 217
End lip 218
Friction (soft close) hinge 220
Enclosure volumetric space 222
Compartment floor 224
Inner surface 228
Side walls 230, rear wall 232 and front wall 234
Plinth 240
Spaced cylindrical recesses 238
Tee members 244 therein
Larger plinth 242
Side opening slots 246
Storage pockets 250
Flexible or elasticated net structure 254
Net fixing clips 256

Roof 260 (Lower Major Compartment)
Door 300
Elongate side hinge 302
Leaves 304,
Knuckle 306
Hinge pin 308
Top end edge 310, Bottom end edge 312
Door hinge side edge 314
Door non hinged side edge 316
Pivoting lever door handle 318
Lever recess 319
Outer surface 320
Inner surface 322
Lever landing member 324
Landing recess 325
Hinge arm portion 326 and distal arm portion 328
Inner space 332
Door pockets 336
Door opening constraint mechanism 340
Fixed shelves 342
Sliding tray members 344
Peripheral wall 346
Drainage outlets 350
Fixing holes 352
Floor 356 (roof of floor assembly 358).

Floor Assembly 52 FIGS. 1-3, 5-7
Roof member 358
Walls 359
Floor 360
Wing portion 361
Wheel housing space 362
L slots 363
Handle recess 364
Circular spaced elongate slit shaped drainage openings 365
Twist locks 708
Cup holder 710
Umbrella holder 712
Female part 714
Male part 716
Portable device holder socket 720

Optional Advantages
a) Carrier assembly and/or portable carrier are each able to be carried
b) Carrier assembly and portable carrier assembly are compact design
c) Carrier assembly and portable carrier assembly are self-supporting
d) Carrier assembly and portable carrier assembly are easy to use
e) Carrier assembly and portable carrier assembly have a degree of waterproofness
f) Simple construction and portable
g) Multi-functional golf carrier
h) Pleasing sleek appearance
i) Ergonomic and anthropometric design
j) Reduced rattling of golf clubs
k) All space economically used
l) Little need for golf club head covers
m) Has storage pockets, housings, shelves, trays or drawers
n) Structurally designed
o) Has multi use rear spine
p) Lockable and secure
q) Compact shape
r) Easy to find clubs
s) Has a valuables drawer/tray
t) Has shelves with shelf drainage
u) Includes weather protection
v) Golf ball and tee storage
w) Central storage area
x) Upper storage area
y) Individual club anti-rotation members
z) No parts to rust and is waterproof
aa) Separate storage area at top of carrier assembly which can be fixed or portable
bb) Accessible separate central inner storage area
cc) Handle and strap combinations can be used to lift and move the assembly
dd) Spine useful for strength and holding accessories
ee) Golf clubs are separately peripherally stored
ff) Able to cope with wet weather by not being wettable, the handles are kept dry within the housings as they are protected by the flexible outer cover on each housing.
gg) Able to cope with wet weather by having drainage exits
hh) Clubs do not move around, are removably affixed and easy identification
ii) Don't always need to strap to a golf cart it can include a detachable golf trundler
jj) Peripheral club storage makes it easier to see and retrieve/insert the right club
kk Can be attached to back of electric golf cart with small back strap
ll) Can include electronic connectivity
mm) Can include a separable folding trundler
nn) Includes a separable folding trundler
oo) Two symmetrically hinged doors
pp) Golf clubs able to be held in place by anti-rotation members
qq) Clubs able to be removed substantially horizontally from the carrier
rr) Can include travel console, phone and drinks holder
ss) Has umbrella storage means
tt) Can include means for wireless or wire connection
uu) Can include portable power storage and solar or electric charging
vv) Club elongate shaped spaces that have base drainage
ww) Has a shoulder sling, elastic pockets
xx) Carrier assembly has top handle and straps removably connected to spine
yy) Towels, brush, markers, pitch repair can be removably stored zz) Optional accessories include a hood, food chiller bag, club covers, backpack aaa) Light weight portable free standing portable carrier assembly suitable for putter and wedge with accessories Variations Throughout the description of this specification, the word "comprise" and variations of that word such as "comprising" and "comprises", are not intended to exclude other additives, components, integers or steps.

The anti-rotation member 96 are formed of a flexible but resilient material (e.g., rubber, plastics or similar) to allow repeated flexing, holding or gripping and automatic return to original shape. Though the gripping is not by clipping, this action of clipping may be combined if needed. The combination of the elongate item 2 being held by anti-rotation members 96, resting on the floor 108 of the housing 54 and poking upwardly through the hole 122 serves to provide suitable restraint to the elongate item to hold it therein and significantly reduce any so-called rattling. Each space 94 as a volume is bigger than the space to be taken up by the elongate item 2 and the anti-rotation members 96 to allow insertion, removal and holding therein.

The front wall 86 of housing 54 is formed of a flexible material to allow repeated flexing and return to original shape.

The housing of the carrier assembly land portable carrier assembly 56 are formed of a polymer composite material suitable to allow moulding to shape, have some degree of water resistance and impact resistance for everyday use of elongate items being inserted and retrieved and movement during transport. In yet other options the housing can be formed of a textile or fabric with any joints being formed and joined or connected with threading, zipping, adhesive or heat.

The polymer composite is a multi-phase material in which reinforcing fillers are integrated with a polymer matrix, resulting in synergistic mechanical properties that cannot be achieved from either component alone.

In another option, the minor upper storage can be formed as either as an integral portion of the entire housing 46 or as in another option, can be formed a removable portion. The carrier 1 and carrier assembly 56 can be formed of any suitable material that at least has some water resistance. The shape of the anti-rotation members 96 need not be strictly as shown in the figures i.e., the shape of the channel, space and arms 138 can be varied to suit particular shape and size of the elongate items 2 to be held there in-see FIG. 52*b*. Other accessories can also be used to work with the anti-rotation members including anti rotation spacers 96*c*.

A trundler apparatus can be formed to be detachable from rear of the golf carrier and there can be a smaller version comprising retractable wheels at base.

Portable carrier assembly 56 is portable and is able to be free standing by splaying the legs 162 out of the support stand apparatus 150, which means a golfer does not need to carry all the clubs and so can easily remove just any two clubs e.g., a putter and a wedge. Also reduces need to pick up clubs on the ground or losing single clubs. Portable carrier assembly 56 is also very easy to remove from the carrier having a quick release feature.

As shown in the figures (e.g., FIGS. 1-5, 7, -9, 11-26, 29, 30-33, 53-60) each elongate shaped housing 54 includes an elongate planar substantially spaced shape 94 to allow at least one club to be housed therein. Any shape for the housing 54 is possible as long at least one club can be slotted therein or there out. For example, some shapes 94 include rectangular cuboid or prism shaped member (e.g., long and thin) forming an enclosed elongate planar space 94 located outwardly of outer surface 64 of left & right outer walls 76, 80 of the wall support housing member 46. The shapes, spacing and numbers of the anti-rotation members 96, 96*a*, 96*b* and 96*c* can be varied to suit mounting requirements on any walls 92, 88, 76, 80, of different lengths and numbers on wall(s), symmetrical or not and curvature with different angles or shaped arms 138, at least one arm, combined with or not, with spacers 96*c* and different lengths of base 136 and various methods of attachment e.g., see examples in FIGS. 14-26, 52*b*.

The lower major compartment system 74 for storing as part of carrier storage system 60 is a centralised storage system comprising movable and adjustable shelves in both vertical and horizontal directions which serves to create well organized, easy to view and manage, walk-in wardrobe style space for the storage of player equipment which is much easier to use than the standard handbag method style with zipped side compartments use of all golf bags. These shelves or horizontal spaces of the present invention are much easier to use, making management (e.g., can have separate shelves for valuables, wet gear, food, drinks etc) and retrieval so much easier, with venting and drainage holes for better use under all weathers.

Any number and shape of shelves, drawers and/or trays which can be fixed adjustable or replaceable, are possible. In this example the shelf can include tray(s) or drawer(s) being fixed or movable thereby in this example providing five horizontal vertically spaced spaces and the door storage providing say four vertically spaced pockets 336.

The door(s) 300 are one example of a means to access the lower major compartment system 74, with different forms of movable attachment (e.g., elongate hinges, butt hinges, ball bearing hinges, barrel hinges, concealed hinges, knife hinge, piano hinges, pivot hinges, living hinge etc) to the housing, whereas other means are possible with or without the door pockets 336, such as for example a simple flap, curtain, roller blind (vertical or horizontal), folding flap, bifold etc.

Side walls 92 as located within space 94 of housing 54 though shown as being a continuous elongate walls, can also be formed as spaced wall portions providing at least one space, gap or aperture there between (see FIG. 63), which can be useful for air circulation and/or allowing protruding portions of elongate items to protrude laterally there through e.g., the head of a tennis racket. The holding of each elongate item 2 either by at least one anti-rotation member 96 and/or the enlarged openings 122 in combination but not necessarily all of the shape of space 94 of each housing 54 and the resilience of the front wall 86, is enough to hold each elongate item not rigidly but 'almost loosely' enough to at least reduce any substantial movement/rattling of the elongate item 2 and yet allow easy hand removal or insertion through slit 120.

One option for removably holding each elongate item 2 in the carrier or portable carrier assemblies could even be without the use of the anti-rotation members 96 (see fifth aspect and claim 5) and also in another option without the upper and lower storage areas, whereby by each elongate item 2 e.g., club is held in place by the narrowness of the space 94 in each housing 54 and the size/diameter of opening/hole 122 in the roof 110 of the rubber as extending from the front wall 86.

It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

Push plate 152 and push rod members 154 of the portable carrier assembly 56 can be formed of similar materials and be of similar shape e.g., aluminium tubular members but equally other materials and combinations are also possible like plastic, steel or sold members, square cross section etc. The size, spacing and number of anti-rotation members 96, 96*a*, 96*b* 96*c* can be varied to suit the size of elongate member 2 and/or the housings 54. There can be for example no anti-rotation members or simply one or more on any wall 92, 76, 80, 88 as required.

It will also be understood that where a product, method or process as herein described or claimed and that is sold incomplete, as individual components, or as a "kit of Parts", that such exploitation will fall within the ambit of the invention.

These and other features and characteristics of the present invention, as well as the method of operation and functions of the related elements of structures and the combination of parts and economics of manufacture, will become more apparent upon consideration of the following description with reference to the accompanying drawings, all of which form part of this specification, wherein like reference numerals designate corresponding parts in the various figures.

All or at least some of the components of the carrier assembly and/or portable carrier assembly can be or are to some degree at least water resistant, though is some instances water proof-ness may be achieved. Drainage vents or holes of any suitable shape and pattern, can be provided in any part or component such as the door pockets, trays, shelves, drawers and space 94 of housings 54.

Figure 64:
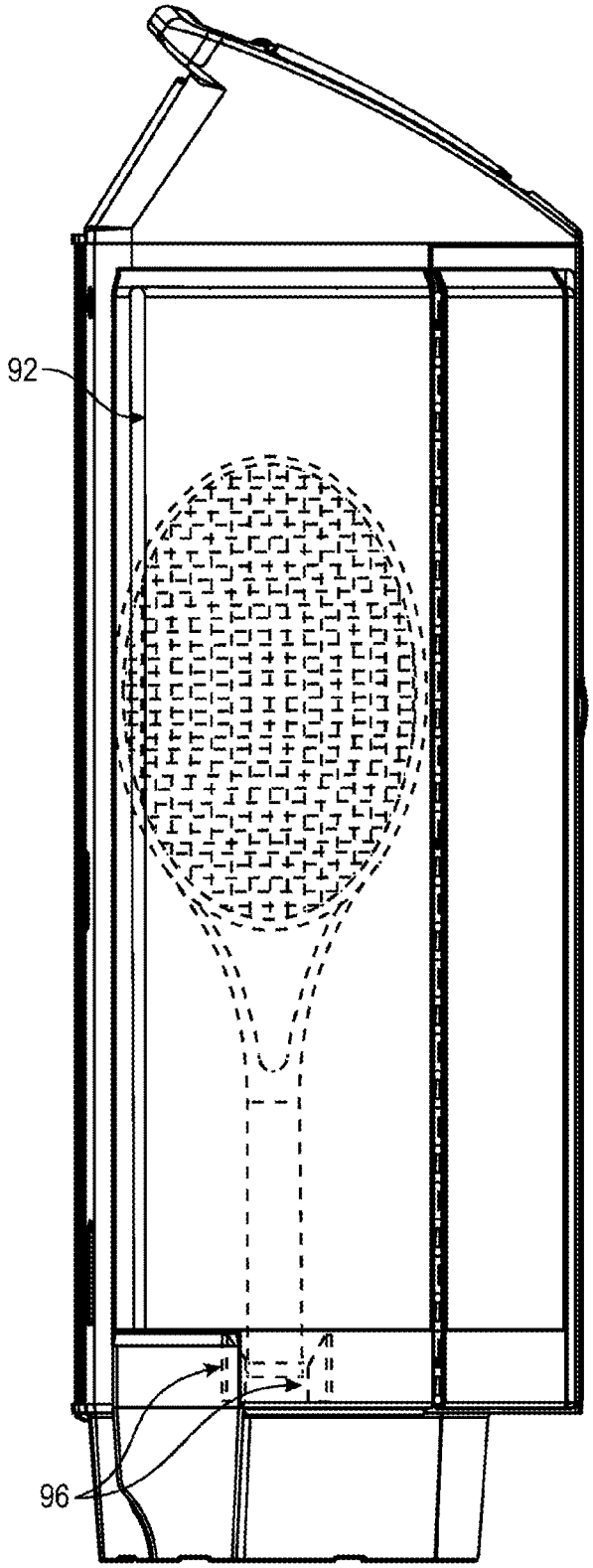

FIG. 64 shows the carrier assembly and or portable carrier assembly adapted for use with different elongate items 2 i.e., for example with tennis rackets whereby the side or end walls 92 of each space 94 of each housing is formed with gaps, apertures, or slits to accommodate the wide racket hitting end, coupled with some nesting or overlapping across several housings 54.

It is also to be understood that the specific devices illustrated in the attached drawings, and described in the following specification are simply exemplary embodiments of the invention. Hence specific dimensions and other physical characteristics related to the embodiments disclosed herein are not to be considered as limiting.

The invention claimed is:

1. A carrier assembly which is an elongate shaped body configured to hold or store at least one elongate shaped item on an exterior thereof being in use oriented in an upright orientation, the carrier assembly that is the elongate shaped body comprising:

a wall support housing assembly including side walls having a thickness between an inner surface and outer surface having an upper end and lower end including a floor assembly, the side walls having a shape defining an internal side therebetween, and at least one elongate shaped housing on an exterior of the side walls in a form of an elongate shaped space having a front wall, a rear wall, side walls, and a floor, the elongate shaped space being shaped and configured of a volume to be able to house, when in use, the at least one elongate item therein, the front wall comprising a planar member including at least one elongate slit-shaped opening extending continuously from at least part of the front wall having an enlarged aperture located at an upper end of the opening, the elongate shaped space being configured to removably receive a portion of the elongate shaped item to be able to hold the elongate item therein; and at least one anti-rotation member configured to removably receive a portion of the elongate shaped item to be able to hold the elongate shaped item therein, the at least one anti-rotation member being removably attachable to at least one of the walls of one housing therein, wherein, in use, the at least one elongate item is insertable or removable from the elongate shaped space through the elongate slit-shaped opening which flexibly parts temporally to allow an insertion and to allow for the elongate item to be removably held vertically therein such that, in use, one elongate item is locatable in space to have a portion upwardly protruding through an enlarged aperture to hold the elongate item in place and the at least one anti-rotation member is configured to prevent rotation of the elongate item about it axis.

2. The carrier assembly as claimed in claim 1, wherein the at least one anti-rotation member has a body having arms extending from a base, which is provided and located in the elongated shaped housing by being affixed to the inside of at least one of the side walls or the rear wall of the elongate shaped housing having the splayed arms outwardly protruding from an inner side of the respective walls of the elongate shaped space, whereby, when inserting or removing each elongate item through the at least one elongate slit-shaped opening, any horizontal side insertion into adjacent recesses of the anti-rotation member causes the elongate item to be removably held within a space between the arms of the anti-rotation member.

3. The carrier assembly as claimed in claim 1, wherein the at least one anti-rotation member is removably mounted to each end wall of the at least one elongate shaped housing.

4. The carrier assembly as claimed in claim 1, further comprising an additional anti-rotation member for use midway in a wall between housings of the at least one elongate shaped housing, the additional anti-rotation member including a base and a central rib between back-to-back splayed walls whereby the base and the central rib form an H shape in cross-section.

5. The carrier assembly as claimed in claim 1, further comprising an additional anti-rotation member for use at one end of a wall at an end of the at least one elongate shaped housing, the additional anti-rotation member including a base and a central rib forming an H shaped in cross-section, a portion of the H shaped forming a T shape outwardly protruding beyond the base.

6. The carrier assembly as claimed in claim 1, wherein the wall support housing assembly includes a rear wall, at least one rear support member being affixed to an outside of the rear wall of the wall support housing assembly to provide strength and rigidity to the carrier assembly and to be configured to receive removably affixable accessories thereon, at least one strap supporting member being configured to be slidably and adjustably attached by gripping to the at least one rear support member to provide a pair of spaced slotted apertures to slide receipt of part of at least one carry strap therethrough to allow, when in use, a user to hold by one or more of a hand, an arm, and a shoulder of the user by itself or in combination with holding the handle to lift or move the carrier assembly.

7. The carrier assembly as claimed in claim 1, wherein the at least one elongate shaped housing comprising a plurality of elongate shaped housings that are parallel and abutting with each other located peripherally around outside a respective wall thereof, and the at least one anti-rotation member is disposed adjacent to a lower end of the elongate shaped space which is at a lower end of the elongate item.

8. The carrier assembly as claimed in claim 1, wherein the at least one anti-rotation member comprises a plurality of anti-rotation members that are channel-shaped members having side walls forming a splayed U cross-sectional shape including a base removably attached to the side walls or the rear wall of the elongate shaped housing and splayed arms and including the elongate shaped space or a recess therebetween the splayed arms, wherein, in each space of the elongate shaped housing, at least one of the anti-rotation members is disposed to allow a part or an end portion of a golf club to be inserted therebetween at least the splayed arms, the splayed arms being formed and configured of a material to allow flexing without deforming to accommodate the elongate item to hold the elongate item therein and therebetween, such that, upon removal of the elongate item, the splayed arms return to a relaxed splayed configuration.

9. The carrier assembly as claimed in claim 1, further comprising a plurality of different shaped anti-rotation members for use in different parts of the space of the at least one elongate shaped housing including at least one mid member, at least one first end member, and at least one second end member, the at least one mid member anti-rotation member includes a channel-shaped member abutting or joined to each side of a base that is a simple elongate member extending the length of a channel, the at least one first end member anti-rotation member including one channel member with a base formed of a T cross-section extending the length of the channel member, the at least one second end member anti-rotation member including one channel member with the base being T shaped in cross-section and extending beyond the length of the channel member.

10. The carrier assembly as claimed in claim 1, wherein the at least one anti-rotation member is formed of a flexible and resilient material to allow repeated flexing, holding and return to an original shape, the front wall of the housing is formed of a flexible material to allow repeated flexing and return to an original shape, the at least one elongate shaped housing of the carrier assembly is formed of a polymer composite material configured to allow molding to shape, have some degree of water resistances and impact resistance for everyday use of elongate items inserted and retrieved and movement during transport.

11. The carrier assembly as claimed in claim 1, wherein the at least one elongate shaped housing has a roof formed of a planar member connected to or formed with the front wall, and the roof includes an elongate slit-shaped opening connected with the elongate slit-shaped opening in the front wall, the elongate slit-shaped opening in the roof being shaped to include a widened area shaped to match a cross-sectional area of the at least one elongate item shaped to removably hold the at least one elongate item in place in the elongate shaped housing.

12. The carrier assembly as claimed in claim 1, wherein an internal storage space is defined between the internal side of the side walls of the housing, the internal storage space including an upper minor storage space and a lower major storage space, the upper minor storage space including an upper planar space and a lower wedge-shaped space, the lower major storage space including at least one shelf accessed by at least one door.

13. The carrier assembly as claimed in claim 12, wherein the upper planar space includes a planar space covered by a see-through planar shaped first lid member, and having a floor, the first lid member and the floor each being hinged at a rear end of the carrier assembly to allow individual hinging or combined hinging, the upper planar space is formed as a space between the first lid member and the floor having a depressed planar portion, and the lower wedge-shaped space including a second lid member which functions as the floor of the upper planar space, the lower wedge-shaped space including a minor plinth on one side and a major plinth on the other side, the minor plinth including recesses shaped and configured to hold at least one tee therein, the major plinth being shaped and configured having at least one recess to hold at least one golf ball therein.

* * * * *